US012746438B2

(12) United States Patent
Galvan

(10) Patent No.: US 12,746,438 B2
(45) Date of Patent: Sep. 29, 2026

(54) GOLF CLUB HEAD INCLUDING A PLURALITY OF SUPPORT MEMBERS

(71) Applicant: Acushnet Company, Fairhaven, MA (US)

(72) Inventor: Darryl C. Galvan, El Cajon, CA (US)

(73) Assignee: Acushnet Company, Fairhaven, MA (US)

( * ) Notice: Subject to any disclaimer, the term of this patent is extended or adjusted under 35 U.S.C. 154(b) by 133 days.

(21) Appl. No.: 18/819,090

(22) Filed: Aug. 29, 2024

(65) Prior Publication Data

US 2026/0061263 A1 Mar. 5, 2026

(51) Int. Cl.
*A63B 53/04* (2015.01)

(52) U.S. Cl.
CPC ..... *A63B 53/045* (2020.08); *A63B 53/0437* (2020.08); *A63B 53/0466* (2013.01)

(58) Field of Classification Search
CPC ..... A63B 53/045; A63B 53/0437; A63B 53/0466
USPC ..... 473/349
See application file for complete search history.

(56) References Cited

U.S. PATENT DOCUMENTS

| | | | |
|---|---|---|---|
| 80,435 | A | 7/1868 | Way |
| 996,937 | A | 7/1911 | Mulock |
| 1,133,129 | A | 3/1915 | Govan |
| 1,167,106 | A | 1/1916 | Palmer |
| 1,322,182 | A | 11/1919 | Duncan |
| 1,534,600 | A | 4/1925 | Mattern |
| 2,163,091 | A | 6/1939 | Held |
| 2,214,356 | A | 9/1940 | Wettlaufer |
| 2,517,245 | A | 8/1950 | Scott |
| 2,545,045 | A | 3/1951 | Rosan |
| 3,064,980 | A | 11/1962 | Steiner |
| 3,212,783 | A | 10/1965 | Jackson et al. |
| 3,220,733 | A | 11/1965 | Saleeby |
| 3,259,404 | A | 7/1966 | Papenguth |
| 3,466,047 | A | 9/1969 | Rodia et al. |
| 3,556,533 | A | 1/1971 | Hollis |
| 3,604,755 | A | 9/1971 | Krekeler |
| 3,652,094 | A | 3/1972 | Glover |
| 3,692,306 | A | 9/1972 | Glover |
| 4,026,183 | A | 5/1977 | Bart |
| 4,043,563 | A | 8/1977 | Churchward |

(Continued)

FOREIGN PATENT DOCUMENTS

| | | |
|---|---|---|
| CN | 101060892 | 10/2007 |
| CN | 102039039 | 5/2011 |

(Continued)

*Primary Examiner* — Michael G Lee
(74) *Attorney, Agent, or Firm* — Mike S. Kim

(57) ABSTRACT

A golf club including support members is disclosed herein. In accordance with the presently disclosed technology, the golf club may include a frontal portion including a striking face and a partially non-metallic rear portion. The partially non-metallic rear portion may include a non-metallic crown portion at an upper portion of the golf club head. The non-metallic crown portion may include a plurality of support members extending from the non-metallic crown portion toward the sole. The plurality of support members may include a central support member being located near a central portion of the golf club head in a heel-to-toe orientation. The non-metallic crown portion and the plurality of support members may form a unibody structural component.

20 Claims, 34 Drawing Sheets

(56) References Cited

U.S. PATENT DOCUMENTS 4,052,075 A 10/1977 Daly
4,085,934 A 4/1978 Churchward
4,194,547 A 3/1980 Sidor et al.
4,340,230 A 7/1982 Churchward
4,423,874 A 1/1984 Stuff
4,443,145 A 4/1984 Peschges
4,450,904 A 5/1984 Volz
4,538,790 A 9/1985 Williams et al.
4,602,787 A 7/1986 Sugioka et al.
4,681,321 A 7/1987 Chen et al.
4,795,159 A 1/1989 Nagamoto
4,867,458 A 9/1989 Sumikawa et al.
4,869,507 A 9/1989 Sahm
4,875,818 A 10/1989 Reinwall
4,883,274 A 11/1989 Hsien
4,930,781 A 6/1990 Allen
4,958,970 A 9/1990 Rose et al.
5,050,879 A 9/1991 Sun et al.
5,067,715 A 11/1991 Schmidt et al.
5,120,062 A 6/1992 Scheie et al.
5,154,424 A 10/1992 Lo
5,168,767 A 12/1992 Morita
5,230,509 A 7/1993 Chavez
5,236,164 A 8/1993 Iorizzo
5,292,129 A 3/1994 Long et al.
5,295,689 A 3/1994 Lundberg
5,297,794 A 3/1994 Lu
5,316,305 A 5/1994 Cabe
5,320,005 A 6/1994 Hsiao
5,344,151 A 9/1994 Anderson et al.
5,354,055 A 10/1994 Mackeil
5,441,274 A 8/1995 Clay
5,451,058 A 9/1995 Price et al.
5,518,243 A 5/1996 Redman
5,547,326 A 8/1996 Overhues
5,547,427 A 8/1996 Rigal et al.
5,571,053 A 11/1996 Lane
5,665,014 A 9/1997 Sanford et al.
5,683,309 A 11/1997 Reimers
5,718,641 A 2/1998 Lin
5,720,674 A 2/1998 Galy
5,776,011 A 7/1998 Su et al.
5,795,245 A 8/1998 Chang et al.
5,839,975 A 11/1998 Lundberg
5,851,160 A 12/1998 Rugge et al.
5,860,779 A 1/1999 Toosky et al.
5,888,148 A 3/1999 Allen
5,904,460 A 5/1999 Kawabata
5,916,042 A 6/1999 Reimers
5,935,019 A 8/1999 Yamamoto
5,935,020 A 8/1999 Stites et al.
5,941,782 A 8/1999 Cook
5,947,840 A 9/1999 Ryan
5,967,905 A 10/1999 Nakahara et al.
6,017,177 A 1/2000 Lanham
6,056,649 A 5/2000 Imai
6,089,994 A 7/2000 Sun
6,123,627 A 9/2000 Antonious
6,162,132 A 12/2000 Yoneyama
6,162,133 A 12/2000 Peterson
6,217,461 B1 4/2001 Galy
6,254,494 B1 7/2001 Hasebe et al.
6,296,574 B1 10/2001 Kaldis
6,306,048 B1 10/2001 Mccabe et al.
6,348,014 B1 2/2002 Chiu
6,364,788 B1 4/2002 Helmstetter et al.
6,379,265 B1 4/2002 Hirakawa et al.
6,409,612 B1 6/2002 Evans et al.
6,436,142 B1 8/2002 Paes et al.
6,440,008 B2 8/2002 Murphy et al.
6,458,044 B1 10/2002 Vincent et al.
6,471,604 B2 10/2002 Hocknell et al.
6,491,592 B2 12/2002 Cackett et al.
6,558,271 B1 5/2003 Beach et al.
6,565,452 B2 5/2003 Helmstetter et al.
6,582,323 B2 6/2003 Soracco et al.
6,592,468 B2 7/2003 Vincent et al.
6,602,149 B1 8/2003 Jacobson
6,623,378 B2 9/2003 Beach et al.
6,638,183 B2 10/2003 Takeda
6,648,772 B2 11/2003 Vincent et al.
6,716,114 B2 4/2004 Nishio
6,719,510 B2 4/2004 Cobzaru
6,739,984 B1 5/2004 Ciasullo
6,773,360 B2 8/2004 Willett et al.
6,811,496 B2 11/2004 Wahl et al.
6,852,038 B2 2/2005 Yabu
6,860,818 B2 3/2005 Greene et al.
6,860,823 B2 3/2005 Lee
6,878,073 B2 4/2005 Takeda
6,881,158 B2 4/2005 Yang et al.
6,913,546 B2 7/2005 Kakiuchi
6,939,247 B1 9/2005 Schweigert et al.
6,964,617 B2 11/2005 Williams
6,988,960 B2 1/2006 Mahaffey et al.
7,025,692 B2 4/2006 Erickson et al.
7,056,228 B2 6/2006 Beach et al.
7,063,628 B2 6/2006 Reyes et al.
7,086,961 B2 8/2006 Wright et al.
7,094,159 B2 8/2006 Takeda
7,121,956 B2 10/2006 Lo
7,137,905 B2 11/2006 Kohno
7,153,220 B2 12/2006 Lo
7,163,470 B2 1/2007 Galloway et al.
7,166,038 B2 1/2007 Williams et al.
7,166,040 B2 1/2007 Chao et al.
7,166,041 B2 1/2007 Evans
7,179,034 B2 2/2007 Ladouceur
7,186,190 B1 3/2007 Beach et al.
7,189,169 B2 3/2007 Billings
7,223,180 B2 5/2007 Willett et al.
7,294,065 B2 11/2007 Liang et al.
7,309,297 B1 12/2007 Solari
7,318,782 B2 1/2008 Imamoto et al.
7,326,472 B2 2/2008 Shimazaki et al.
7,344,452 B2 3/2008 Imamoto et al.
7,351,161 B2 4/2008 Beach
7,396,291 B2 7/2008 Lo
7,404,772 B2 7/2008 Koide et al.
7,407,447 B2 8/2008 Beach et al.
7,410,425 B2 8/2008 Willett et al.
7,410,426 B2 8/2008 Willett et al.
7,419,441 B2 9/2008 Hoffman et al.
7,438,649 B2 10/2008 Ezaki et al.
7,448,963 B2 11/2008 Beach et al.
7,452,285 B2 11/2008 Chao et al.
7,497,789 B2 3/2009 Burnett et al.
7,530,901 B2 5/2009 Imamoto et al.
7,530,903 B2 5/2009 Imamoto et al.
7,530,904 B2 5/2009 Beach et al.
7,540,811 B2 6/2009 Beach et al.
7,549,935 B2 6/2009 Foster et al.
7,568,985 B2 8/2009 Beach et al.
7,578,753 B2 8/2009 Beach et al.
7,582,248 B2 9/2009 Reyes et al.
7,604,548 B2 10/2009 Cole
7,628,711 B2 12/2009 Akinori et al.
7,632,194 B2 12/2009 Beach et al.
7,651,414 B2 1/2010 Rae et al.
7,670,235 B2 3/2010 Lo
7,691,008 B2 4/2010 Oyama
7,713,142 B2 5/2010 Hoffman et al.
7,717,803 B2 5/2010 Dimarco
7,717,804 B2 5/2010 Beach et al.
7,717,805 B2 5/2010 Beach et al.
7,744,484 B1 6/2010 Chao
7,753,806 B2 7/2010 Beach et al.
7,758,452 B2 7/2010 Soracco
7,771,290 B2 8/2010 Bezilla et al.
7,775,905 B2 8/2010 Beach et al.
7,806,781 B2 10/2010 Imamoto
7,828,676 B2 11/2010 Wada et al.
7,850,542 B2 12/2010 Cackett et al.
7,871,339 B2 1/2011 Sanchez et al.

(56) References Cited

U.S. PATENT DOCUMENTS 7,959,522 B2 6/2011 North et al.
8,016,694 B2 9/2011 Llewellyn et al.
8,025,591 B2 9/2011 De La Cruz et al.
8,033,930 B2 10/2011 Tavares et al.
8,043,167 B2 10/2011 Boyd et al.
8,062,151 B2 11/2011 Boyd et al.
8,070,623 B2 12/2011 Stites et al.
8,088,021 B2 1/2012 Albertsen et al.
8,092,316 B2 1/2012 Breier et al.
8,100,781 B2 1/2012 Burnett et al.
8,105,175 B2 1/2012 Breier et al.
8,133,128 B2 3/2012 Boyd et al.
8,133,129 B2 3/2012 Boyd et al.
8,147,354 B2 4/2012 Hartwell et al.
8,182,363 B2 5/2012 Bezilla et al.
8,192,302 B2 6/2012 Knutson et al.
8,197,357 B1 6/2012 Rice et al.
8,197,358 B1 6/2012 Peralta et al.
8,241,143 B2 8/2012 Albertsen et al.
8,292,757 B2 10/2012 Soracco
8,303,433 B2 11/2012 Roach et al.
8,308,582 B2 11/2012 Tanimoto
8,357,057 B2 1/2013 Tavares et al.
8,388,465 B2 3/2013 De La Cruz et al.
8,398,506 B2 3/2013 Stites
8,435,135 B2 5/2013 Stites et al.
8,444,506 B2 5/2013 Watson et al.
8,460,123 B1 6/2013 Demille et al.
8,475,292 B2 7/2013 Rahrig et al.
8,540,588 B2 9/2013 Rice et al.
8,540,589 B2 9/2013 Bezilla et al.
8,585,514 B2 11/2013 Boyd et al.
8,608,589 B2 12/2013 Ferguson et al.
8,622,847 B2 1/2014 Beach et al.
8,636,608 B2 1/2014 De La Cruz et al.
8,636,610 B2 1/2014 Golden et al.
8,661,879 B2 3/2014 Iwatsubo et al.
8,684,863 B2 4/2014 Bezilla et al.
8,690,706 B2 4/2014 Stites et al.
8,696,283 B1 4/2014 Cruz et al.
8,753,226 B2 6/2014 Rice et al.
8,753,227 B1 6/2014 Cackett et al.
8,784,234 B2 7/2014 Lacey et al.
8,834,293 B2 9/2014 Thomas et al.
8,857,647 B2 10/2014 Nakamura
8,858,362 B1 10/2014 Leposky et al.
8,870,679 B2 10/2014 Oldknow
8,938,871 B2 1/2015 Roach et al.
8,944,934 B2 2/2015 Yamamoto
8,956,240 B2 2/2015 Johnson et al.
8,979,671 B1 3/2015 Demille et al.
9,033,822 B1 5/2015 Rice et al.
9,095,753 B2 8/2015 Cleghorn et al.
9,174,096 B2 11/2015 Sargent et al.
9,192,831 B2 11/2015 Stites et al.
9,205,312 B2 12/2015 Zimmerman et al.
9,216,333 B2 12/2015 Bezilla et al.
9,259,627 B1 2/2016 Myers et al.
9,289,660 B1 3/2016 Myers
9,358,431 B2 6/2016 Yamamoto
9,375,618 B2 6/2016 Myers et al.
9,381,410 B2 7/2016 Golden et al.
9,387,373 B1 7/2016 Demille et al.
9,393,471 B2 7/2016 Beno et al.
9,403,071 B2 8/2016 Sander
9,427,637 B2 8/2016 Beach et al.
9,433,836 B2 9/2016 Breier et al.
9,440,126 B2 9/2016 Boyd et al.
9,498,684 B2 11/2016 Motokawa
9,498,688 B2 11/2016 Galvan et al.
9,504,884 B2 11/2016 Bennett et al.
9,504,889 B2 11/2016 Mitzel et al.
9,550,097 B1 1/2017 Seluga et al.
9,623,291 B2 4/2017 Beach et al.
9,623,302 B1 4/2017 Seluga et al.
9,687,700 B2 6/2017 Honea et al.
9,694,256 B2 7/2017 Myers et al.
9,700,767 B2 7/2017 Zimmerman et al.
9,700,770 B2 7/2017 Bezilla et al.
9,707,458 B2 7/2017 Luttrell et al.
9,744,415 B2 8/2017 Frame et al.
9,757,629 B2 9/2017 Seluga et al.
9,814,954 B2 11/2017 Westrum et al.
9,861,864 B2 1/2018 Beach et al.
9,868,036 B1 1/2018 Kleinert et al.
9,908,013 B2 3/2018 Hettinger et al.
9,908,014 B1 3/2018 Wester et al.
9,914,028 B1 3/2018 Cleghorn et al.
9,925,432 B2 3/2018 Morales et al.
9,950,222 B2 4/2018 Albertsen et al.
9,968,834 B1 5/2018 Seluga et al.
9,975,019 B2 5/2018 Frame et al.
9,987,533 B2 6/2018 Oldknow et al.
10,022,602 B2 7/2018 Kingston et al.
10,035,051 B2 7/2018 Cleghorn et al.
10,065,094 B2 9/2018 Wallin
10,092,803 B2 10/2018 Cleghorn et al.
10,092,804 B2 10/2018 Luttrell et al.
10,207,160 B2 2/2019 Bennett et al.
10,258,846 B1 4/2019 Nunez et al.
10,293,225 B2 5/2019 Sargent et al.
10,300,354 B2 5/2019 Morales et al.
10,391,371 B2 8/2019 Bennett et al.
10,434,380 B2 10/2019 Kawaguchi
10,463,928 B2 11/2019 Higdon et al.
10,478,681 B2 11/2019 Ines et al.
10,518,145 B2 12/2019 Cleghorn et al.
10,537,773 B2 1/2020 Nielson et al.
10,576,335 B2 3/2020 Greaney et al.
10,603,555 B2 3/2020 Beach et al.
10,617,916 B2 4/2020 Milleman et al.
10,617,920 B2 4/2020 Nunez et al.
10,675,514 B2 6/2020 Spackman et al.
10,675,520 B2 6/2020 Wallans et al.
10,695,628 B1 6/2020 Yi et al.
10,737,149 B2 8/2020 Boyd et al.
10,751,585 B2 8/2020 Johnson et al.
10,765,922 B2 9/2020 Morales et al.
10,786,713 B2 9/2020 Sanchez et al.
10,799,775 B2 10/2020 Sargent et al.
10,828,543 B2 11/2020 Morales et al.
10,864,413 B2 12/2020 Stokke et al.
10,881,915 B2 1/2021 Sander
10,918,917 B2 2/2021 Northcutt et al.
10,926,143 B2 2/2021 Bennett et al.
10,940,373 B2 3/2021 Stokke et al.
10,940,374 B2 3/2021 Stokke et al.
D919,024 S 5/2021 Bacon
11,013,966 B2 5/2021 Cleghorn et al.
11,020,637 B2 6/2021 Stokke et al.
11,027,178 B2 6/2021 Sugimae et al.
11,033,782 B1 6/2021 Evans et al.
11,040,256 B2 6/2021 Milleman et al.
11,083,937 B2 8/2021 Gibbs et al.
11,090,536 B2 8/2021 Bennett et al.
11,117,026 B2 9/2021 Stokke
11,192,005 B2 12/2021 Murphy et al.
11,207,577 B1 12/2021 Evans
11,213,730 B2 1/2022 Sugimae et al.
11,229,827 B2 1/2022 Sanchez et al.
11,331,546 B2 5/2022 Golden et al.
11,439,879 B2 9/2022 Yi et al.
11,446,555 B2 9/2022 Yi et al.
11,497,970 B2 11/2022 Larsen et al.
11,534,666 B2 12/2022 Morales et al.
11,577,131 B2 2/2023 Golden et al.
11,638,859 B2 5/2023 Milleman et al.
11,654,336 B2 5/2023 Penney et al.
11,684,830 B2 6/2023 Nakamura et al.
11,701,559 B2 7/2023 Murphy et al.
11,857,848 B1 1/2024 Day et al.
2001/0011044 A1 8/2001 Galy
2002/0165041 A1 11/2002 Takeda
2002/0169035 A1 11/2002 Liu

(56) References Cited

U.S. PATENT DOCUMENTS

| | | | |
|---|---|---|---|
| 2003/0032499 | A1 | 2/2003 | Wahl et al. |
| 2003/0083151 | A1 | 5/2003 | Nakahara et al. |
| 2003/0092506 | A1 | 5/2003 | Matsunaga |
| 2003/0139220 | A1 | 7/2003 | Duquette et al. |
| 2003/0148818 | A1 | 8/2003 | Myrhum et al. |
| 2003/0164063 | A1 | 9/2003 | Elliott |
| 2004/0092332 | A1 | 5/2004 | Willett et al. |
| 2004/0132541 | A1 | 7/2004 | MacIlraith |
| 2005/0026723 | A1 | 2/2005 | Kumamoto |
| 2005/0049074 | A1 | 3/2005 | Chen et al. |
| 2005/0119068 | A1 | 6/2005 | Onoda et al. |
| 2005/0239576 | A1 | 10/2005 | Stites et al. |
| 2005/0258568 | A1 | 11/2005 | Hou |
| 2005/0282653 | A1 | 12/2005 | Murphy et al. |
| 2006/0058112 | A1 | 3/2006 | Haralason et al. |
| 2006/0068936 | A1 | 3/2006 | Dewhurst et al. |
| 2006/0100029 | A1 | 5/2006 | Lo |
| 2006/0122004 | A1 | 6/2006 | Chen et al. |
| 2006/0217216 | A1 | 9/2006 | Iizuka |
| 2007/0049417 | A1 | 3/2007 | Shear |
| 2007/0149315 | A1 | 6/2007 | Bennett et al. |
| 2007/0155534 | A1 | 7/2007 | Tsai et al. |
| 2008/0009366 | A1 | 1/2008 | Lo |
| 2008/0020861 | A1 | 1/2008 | Adams et al. |
| 2008/0020862 | A1 | 1/2008 | Chen et al. |
| 2008/0039229 | A1 | 2/2008 | Lo |
| 2008/0132353 | A1 | 6/2008 | Hsiao |
| 2008/0139336 | A1 | 6/2008 | Dimarco |
| 2008/0261715 | A1 | 10/2008 | Carter |
| 2009/0088272 | A1 | 4/2009 | Foster et al. |
| 2009/0093321 | A1 | 4/2009 | Hsu et al. |
| 2009/0143167 | A1 | 6/2009 | Evans |
| 2010/0009771 | A1 | 1/2010 | Newcomer |
| 2010/0029402 | A1 | 2/2010 | Noble et al. |
| 2010/0041494 | A1 | 2/2010 | Boyd et al. |
| 2010/0041495 | A1 | 2/2010 | North et al. |
| 2010/0075774 | A1 | 3/2010 | Ban |
| 2010/0105499 | A1 | 4/2010 | Roach et al. |
| 2010/0125000 | A1 | 5/2010 | Lee |
| 2010/0144461 | A1 | 6/2010 | Ban |
| 2010/0160091 | A1 | 6/2010 | Boyd et al. |
| 2010/0167837 | A1 | 7/2010 | Ban |
| 2010/0222154 | A1 | 9/2010 | Evans |
| 2010/0273571 | A1 | 10/2010 | Foster et al. |
| 2010/0331096 | A1 | 12/2010 | Curtis et al. |
| 2011/0021285 | A1 | 1/2011 | Shimazaki |
| 2011/0151995 | A1 | 6/2011 | Evans |
| 2011/0159986 | A1 | 6/2011 | Chao et al. |
| 2011/0190073 | A1 | 8/2011 | Bennett et al. |
| 2011/0207551 | A1 | 8/2011 | Breier et al. |
| 2011/0224017 | A1 | 9/2011 | Thomas et al. |
| 2011/0275446 | A1 | 11/2011 | Rahrig et al. |
| 2012/0083360 | A1 | 4/2012 | Boyd et al. |
| 2012/0202615 | A1 | 8/2012 | Beach et al. |
| 2012/0289361 | A1 | 11/2012 | Beach et al. |
| 2013/0109501 | A1 | 5/2013 | Stites et al. |
| 2013/0109503 | A1 | 5/2013 | Matsunaga |
| 2013/0150180 | A1 | 6/2013 | Yamamoto |
| 2013/0178306 | A1 | 7/2013 | Beno et al. |
| 2013/0316842 | A1 | 11/2013 | Demkowski et al. |
| 2013/0324283 | A1 | 12/2013 | Boyd et al. |
| 2013/0324294 | A1 | 12/2013 | Oldknow |
| 2013/0331203 | A1 | 12/2013 | Takahashi et al. |
| 2013/0344988 | A1 | 12/2013 | Hettinger et al. |
| 2014/0004972 | A1 | 1/2014 | Thomas et al. |
| 2014/0031141 | A1 | 1/2014 | Myrhum |
| 2014/0038737 | A1 | 2/2014 | Roach et al. |
| 2014/0113741 | A1 | 4/2014 | Bezilla et al. |
| 2014/0113742 | A1 | 4/2014 | Zimmerman et al. |
| 2014/0187347 | A1 | 7/2014 | Yamamoto |
| 2014/0206474 | A1 | 7/2014 | Bezilla et al. |
| 2014/0256463 | A1 | 9/2014 | Knight |
| 2015/0045134 | A1 | 2/2015 | Beno et al. |
| 2015/0111661 | A1 | 4/2015 | Bennett et al. |
| 2015/0273293 | A1 | 10/2015 | Akiyama et al. |
| 2015/0297961 | A1 | 10/2015 | Voshall et al. |
| 2015/0306473 | A1 | 10/2015 | Breier et al. |
| 2015/0306474 | A1 | 10/2015 | Breier et al. |
| 2015/0321055 | A1 | 11/2015 | Golden et al. |
| 2015/0335964 | A1 | 11/2015 | Sander |
| 2015/0360094 | A1 | 12/2015 | Deshmukh |
| 2016/0001146 | A1 | 1/2016 | Sargent et al. |
| 2016/0001918 | A1 | 1/2016 | Orion et al. |
| 2016/0016055 | A1 | 1/2016 | DiMarco et al. |
| 2016/0101330 | A1 | 4/2016 | Harrington et al. |
| 2016/0166893 | A1 | 6/2016 | Akiyama et al. |
| 2016/0236047 | A1 | 8/2016 | Chen et al. |
| 2016/0287954 | A1 | 10/2016 | Sargent et al. |
| 2017/0050091 | A1 | 2/2017 | Shimahara et al. |
| 2017/0157474 | A1 | 6/2017 | Sander |
| 2017/0189770 | A1 | 7/2017 | Hettinger et al. |
| 2017/0246518 | A1 | 8/2017 | Tang et al. |
| 2017/0259128 | A1 | 9/2017 | Greensmith et al. |
| 2017/0361185 | A1 | 12/2017 | Henrikson et al. |
| 2018/0008871 | A1 | 1/2018 | Lafortune et al. |
| 2018/0056154 | A1 | 3/2018 | Wallin |
| 2018/0071591 | A1 | 3/2018 | Seluga et al. |
| 2018/0318676 | A1 | 11/2018 | Kingston et al. |
| 2019/0022478 | A1 | 1/2019 | Greaney et al. |
| 2019/0046845 | A1 | 2/2019 | Greensmith et al. |
| 2019/0046848 | A1 | 2/2019 | Kato |
| 2019/0224538 | A1 | 7/2019 | Spackman et al. |
| 2019/0232129 | A1 | 8/2019 | Nunez et al. |
| 2019/0262672 | A1 | 8/2019 | Seluga et al. |
| 2020/0121999 | A1 | 4/2020 | Sargent et al. |
| 2020/0147458 | A1 | 5/2020 | Gibbs et al. |
| 2020/0188746 | A1 | 6/2020 | Sugimae et al. |
| 2020/0206589 | A1 | 7/2020 | Parsons et al. |
| 2020/0268108 | A1 | 8/2020 | Fiedler |
| 2020/0282273 | A1 | 9/2020 | Chen et al. |
| 2020/0298073 | A1 | 9/2020 | Beach et al. |
| 2020/0330835 | A1 | 10/2020 | Bennett et al. |
| 2021/0093935 | A1 | 4/2021 | Jertson et al. |
| 2021/0113896 | A1 | 4/2021 | Greensmith et al. |
| 2021/0128994 | A1 | 5/2021 | Yi et al. |
| 2021/0138319 | A1 | 5/2021 | Bennett et al. |
| 2021/0138323 | A1 | 5/2021 | Harbert et al. |
| 2021/0162281 | A1 | 6/2021 | Milleman et al. |
| 2021/0169619 | A1 | 6/2021 | Muller et al. |
| 2021/0220709 | A1 | 7/2021 | Johnson et al. |
| 2021/0283473 | A1 | 9/2021 | Stokke et al. |
| 2021/0299525 | A1 | 9/2021 | Mizutani et al. |
| 2021/0339096 | A1 | 11/2021 | Milleman et al. |
| 2021/0394028 | A1 | 12/2021 | Martens et al. |
| 2022/0032135 | A1 | 2/2022 | Kato |
| 2022/0040543 | A1 | 2/2022 | Northcutt et al. |
| 2022/0111263 | A1 | 4/2022 | Yi et al. |
| 2022/0111270 | A1 | 4/2022 | Yi et al. |
| 2022/0118322 | A1 | 4/2022 | Matthews et al. |
| 2022/0126174 | A1 | 4/2022 | Sugimae et al. |
| 2022/0184467 | A1 | 6/2022 | Leblanc et al. |
| 2022/0203183 | A1 | 6/2022 | Harbert et al. |
| 2022/0203184 | A1 | 6/2022 | Johnson et al. |
| 2022/0347530 | A1 | 11/2022 | Northcutt et al. |
| 2023/0030831 | A1 | 2/2023 | Yi et al. |
| 2023/0064631 | A1 | 3/2023 | Sanchez et al. |
| 2024/0042285 | A1 | 2/2024 | Cleghorn |

FOREIGN PATENT DOCUMENTS

| | | |
|---|---|---|
| CN | 102886130 | 1/2013 |
| CN | 103889517 | 6/2014 |
| GB | 194823 | 3/1923 |
| GB | 2133295 | 7/1984 |
| JP | 10137374 | 5/1998 |
| JP | 10234902 | 9/1998 |
| JP | 10248964 | 9/1998 |
| JP | 11319167 | 11/1999 |
| JP | 2000005350 | 1/2000 |
| JP | 2000176059 | 6/2000 |
| JP | 2001000606 | 1/2001 |
| JP | 2001149514 | 6/2001 |
| JP | 200211124 | 1/2002 |
| JP | 2005160947 | 6/2005 |

(56) References Cited

FOREIGN PATENT DOCUMENTS

| | | |
|---|---|---|
| JP | 2006000435 | 1/2006 |
| JP | 200681862 | 3/2006 |
| JP | 2006122334 | 5/2006 |
| JP | 2006187489 | 7/2006 |
| JP | 2006198251 | 8/2006 |
| JP | 2006239154 | 9/2006 |
| JP | 2006288882 | 10/2006 |
| JP | 2006320493 | 11/2006 |
| JP | 2007313304 | 12/2007 |
| JP | 2009254518 | 10/2013 |
| JP | 201619731 | 2/2016 |
| JP | 2019519324 | 8/2020 |
| KR | 20200039768 | 4/2020 |
| WO | 2010019636 | 2/2010 |

GOLF CLUB HEAD INCLUDING A PLURALITY OF SUPPORT MEMBERS

FIELD OF THE DISCLOSURE

The presently disclosed technology relates generally to a new and improved golf club having improved Moment of Inertia (MOI) characteristics, combined with an improved Center of Gravity (CG) location. More specifically, the golf club head in accordance with the presently disclosed technology achieves a relative low Moment of Inertia (MOI) about the Z-axis (MOI-Z), a low MOI about the Shaft Axis (MOI-SA), all combined with a high MOI about the X and Y-axis (MOI-X and MOI-Y) and maintaining a consistently and relatively low CG location measured along a direction normal to the hosel axis along the X-Y plane (CG-B).

SUMMARY

Embodiments of the presently disclosed technology may include a golf club including a golf club head, a shaft having a shaft axis coupled to the golf club head at a first end of the shaft and a grip coupled to the shaft at a second end of the shaft. The golf club head may include an x-axis defined as a horizontal axis tangent to a geometric center of the striking face with the positive direction towards a heel of the golf club head, a y-axis may be a vertical axis orthogonal to the x-axis with a positive direction towards a crown of the golf club head, and a z-axis may be orthogonal to both the x-axis and the y-axis with a positive direction towards a frontal portion of the golf club head. The golf club head may include a frontal portion including a metal and including a striking face having a face center, located at a forward portion of the golf club head. The golf club head may include a partially non-metallic rear portion coupled to and located aft of the frontal portion. The rear portion may include a non-metallic crown portion at an upper portion of the golf club head and a sole on a bottom portion of the golf club head. The crown portion may include a plurality of support members extending from the crown portion toward the sole, the plurality of support members essentially perpendicular to the striking face. The plurality of support members may include a central support member being located near a central portion of the golf club head in a heel-to-toe orientation, extending substantially in line, along the z-axis, with the face center. The crown portion and the plurality of support members may form a unibody structural component. The golf club head may have a moment of inertia about the y-axis (MOI-Y) passing through a center of gravity (CG) of the golf club head, the golf club head may have a moment of inertia about the z-axis (MOI-Z) passing through the CG, and the golf club head may have a moment of inertia about the x-axis (MOI-X) passing through the CG.

In embodiments, the plurality of support members may extend less than about 25% of a total height of the golf club head along a bottom-to-top direction.

In embodiments, the plurality of support members may extend less than about 25% of a total depth of the golf club head along a back-to-front direction.

In embodiments, the crown portion may further include a frontal crown portion on a frontal part of the crown portion. The plurality of support members may extend from the frontal crown portion.

In embodiments, the plurality of support members may extend to the sole.

In embodiments, each of the plurality of support members may include support member holes.

In embodiments, the plurality of support members may include a toe side support member located toeward of the central support member between about 20% and about 70% of a total width of the golf club head, and a heel side support member located heelward of the central support member between about 20% and about 70% of a total width of the golf club head.

In embodiments, the unibody structural component comprises one of a composite and a metal.

In embodiments, the central support member may be offset from the face center less than about 25 mm.

In accordance with some aspects of the presently disclosed technology, golf club head may include an x-axis defined as a horizontal axis tangent to a geometric center of the striking face with the positive direction towards a heel of the golf club head, a y-axis may be a vertical axis orthogonal to the x-axis with a positive direction towards a crown of the golf club head, and a z-axis may be orthogonal to both the x-axis and the y-axis with a positive direction towards a frontal portion of the golf club head. The golf club head may include a frontal portion including a metal and including a striking face having a face center, located at a forward portion of the golf club head. The golf club head may include a partially non-metallic rear portion coupled to and located aft of the frontal portion. The rear portion may include a non-metallic crown portion at an upper portion of the golf club head and a sole on a bottom portion of the golf club head. The crown portion may include a plurality of support members extending from the crown portion toward the sole, the plurality of support members essentially perpendicular to the striking face. The plurality of support members may include a central support member being located near a central portion of the golf club head in a heel-to-toe orientation, extending substantially in line, along the z-axis, with the face center. The crown portion and the plurality of support members may form a unibody structural component. The plurality of support members may extend less than about 25% of a crown-to-sole distance. The golf club head may have a moment of inertia about the y-axis (MOI-Y) passing through a center of gravity (CG) of the golf club head, the golf club head may have a moment of inertia about the z-axis (MOI-Z) passing through the CG, and the golf club head may have a moment of inertia about the x-axis (MOI-X) passing through the CG.

In embodiments, the plurality of support members may extend less than about 25% of a total depth of the golf club head along a back-to-front direction.

In embodiments, the crown portion may further include a frontal crown portion on a frontal part of the crown portion. The plurality of support members may extend from the frontal crown portion.

In embodiments, the plurality of support members may include a toe side support member located toeward of the central support member between about 20% and about 70% of a total width of the golf club head, and a heel side support member located heelward of the central support member between about 20% and about 70% of a total width of the golf club head.

In embodiments, the unibody structural component comprises one of a composite and a metal.

In embodiments, the central support member may be offset from the face center less than about 25 mm.

In accordance with some aspects of the presently disclosed technology, golf club head may include an x-axis defined as a horizontal axis tangent to a geometric center of the striking face with the positive direction towards a heel of the golf club head, a y-axis may be a vertical axis orthogonal to the x-axis with a positive direction towards a crown of the golf club head, and a z-axis may be orthogonal to both the x-axis and the y-axis with a positive direction towards a frontal portion of the golf club head. The golf club head may include a frontal portion including a metal and including a striking face having a face center, located at a forward portion of the golf club head. The golf club head may include a partially non-metallic rear portion coupled to and located aft of the frontal portion. The rear portion may include a non-metallic crown portion at an upper portion of the golf club head and a sole on a bottom portion of the golf club head. The crown portion may include a plurality of support members extending from the crown portion toward the sole, the plurality of support members essentially perpendicular to the striking face. The plurality of support members may include a central support member being located near a central portion of the golf club head in a heel-to-toe orientation, extending substantially in line, along the z-axis, with the face center. The crown portion and the plurality of support members may form a unibody structural component. The plurality of support members may extend to the sole. The golf club head may have a moment of inertia about the y-axis (MOI-Y) passing through a center of gravity (CG) of the golf club head, the golf club head may have a moment of inertia about the z-axis (MOI-Z) passing through the CG, and the golf club head may have a moment of inertia about the x-axis (MOI-X) passing through the CG.

In embodiments, the plurality of support members may include a toe side support member located toeward of the central support member between about 20% and about 70% of a total width of the golf club head, and a heel side support member located heelward of the central support member between about 20% and about 70% of a total width of the golf club head.

In embodiments, each of the plurality of support members may include support member holes.

In embodiments, the unibody structural component comprises one of a composite and a metal.

In embodiments, the central support member may be offset from the face center less than about 25 mm.

These and other features, aspects and advantages of the presently disclosed technology will become better understood with reference to the following drawings, description and claims.

BRIEF DESCRIPTION OF THE DRAWINGS

The foregoing and other features and advantages of the presently disclosed technology will be apparent from the following description of the presently disclosed technology as illustrated in the accompanying drawings. The accompanying drawings, which are incorporated herein and form a part of the specification, further serve to explain the principles of the presently disclosed technology and to enable a person skilled in the pertinent art to make and use the presently disclosed technology.

DETAILED DESCRIPTION

Figure 1:
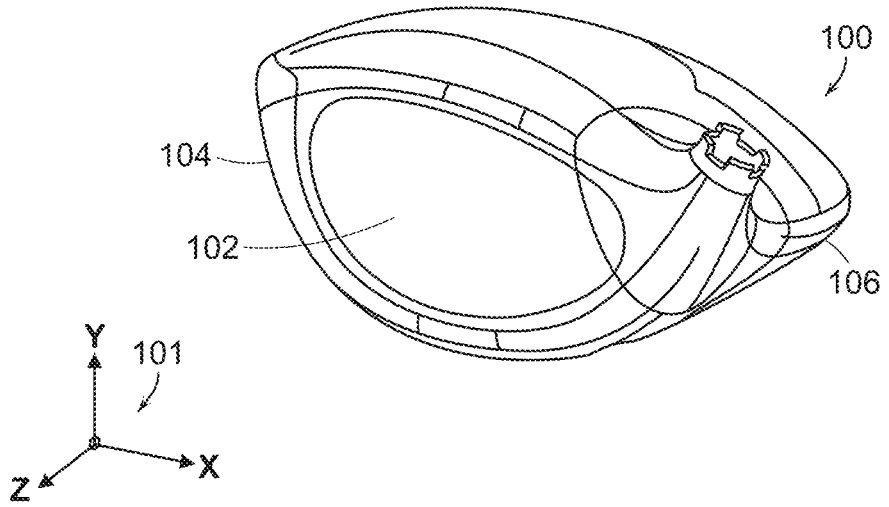
FIG. 1 of the accompanying drawings shows a perspective view of a golf club head in accordance with an exemplary embodiment of the presently disclosed technology.

With the development of the modern day oversized metalwoods, the performance capabilities of these types of golf clubs have increased dramatically over their predecessor, "the persimmon wood". One of the ways these metalwood type golf clubs have been performing better than their predecessors is in the increase in overall distance, generally attributed to the inherent elastic deformation of thin metallic metal materials used by these metalwoods. Another way the metalwood type golf clubs have been outperforming their predecessors is in the increase in overall forgiveness of the golf club head, generally attributed to the increase in the MOI of the golf club head itself.

The MOI of a golf club head generally is a term used to describe the ability of an object to resist rotational movement upon impact with a secondary object. In the case of a golf club head, MOI refers to the ability of the golf club head to resist undesirable twisting upon impact with a golf ball, as such a twisting movement will generally change the face angle of the golf club head away from the intended target line, sending the golf ball away from the intended target.

U.S. Pat. No. 5,354,055 to MacKeil shows one of the earliest attempts to increase the MOI of a golf club head by placing the Center of Gravity (CG) location rearward. U.S. Pat. No. 6,364,788 to Helmstetter et al. shows the utilization of weighting members to help control the MOI of the golf club head. Both of these patents refer to the MOI-y of the golf club head, as it relates to the ability of the golf club head to stay stable when encountering an off-center impact in the heel and toe direction.

U.S. Pat. No. 7,850,542 to Cackett et al. illustrates a further development in the MOI research wherein a recognition of the different axis of rotation of the different MOI's. (Alternatively known as Ixx, Iyy, and Izz instead of MOI-X, MOI-Y, and MOI-Z) Despite the recognition and identification of the difference in MOI values, U.S. Pat. No. 7,850,542 only focuses its attention on Ixx and Iyy (adapted and changes to the current reference nomenclature), without any recognition of the importance of the last MOI number, Izz, nor MOI-SA and how they can affect the performance of the golf club.

Despite the above, none of the references recognizes the importance of the MOI of the golf club head horizontally forward and aft of the face (MOI-Z), and ways to design a golf club that takes advantage of the performance characteristics of golf club with more optimal MOI-Z values along with the minimized MOI-Sa values. Moreover, a closer investigation of the MOI-Z values will yield CG locations that will work in conjunction with the above MOI-Z values to create more performance. Hence, it can be seen from the above there is a need for more research and a design of a golf club capable of achieving better performance by investigating the importance of MOI-Z and MOI-SA as well as the CG location and designing a golf club head.

The following detailed description describes the best currently contemplated modes of carrying out the presently disclosed technology. The description is not to be taken in a limiting sense, but is made merely for the purpose of illustrating the general principles of the presently disclosed technology, since the scope of the presently disclosed technologyis best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Before beginning the discussion on the current inventive golf club head and its performance criteria, it is worthwhile to note here that the discussion below will be based on a coordinate system 101 and axis of measurement that is critical to the proper valuation of the performance numbers. Hence, it is important to recognize here that although the specific names given for the measurements below are important to the understanding of the presently disclosed technology, the naming nomenclature should not be viewed in vacuum. Rather, the importance is the numbers presented below needs to be taken in context with how the coordinate system relates to the golf club head itself. In order to provide sufficient information to avoid any ambiguity, each of the figures provided below referencing a golf club head will all be accompanied by a coordinate system that is all consistent with one another.

Pursuant to the above, and to establish the reference coordinate system for the subsequent discussion, FIG. 1 of the accompanying drawings shows the coordinate system 101 that will be used to define the various measurement and performance figures for the presently disclosed technology. The x-axis used by the current discussion refers to the axis that is horizontal to the striking face from a heel to toe direction. The y-axis used by the current discussion refers to the vertical axis through the club in a crown to sole direction. The z-axis used by the current discussion refers to the horizontal axis that is horizontal front to back in a forward and rear direction. Alternatively speaking, it can be the x-axis is defined as a horizontal axis tangent to a geometric center of the striking face with the positive direction towards a heel of the golf club head, a y-axis is a horizontal axis orthogonal to the x-axis with a positive direction towards a top of the golf club head, and a z-axis being orthogonal to both the x-axis and the y-axis with a positive direction towards a front of the golf club head. The x-y-z coordinate system described above shall be the same for all subsequent discussions.

FIG. 1 of the accompanying drawings shows a perspective view of a golf club head 100 in accordance with an embodiment of the presently disclosed technology. In this perspective view shown in FIG. 1, the golf club head 100 may not look very different than other golf club heads, but the subsequent figures and discussion will show that the internal components and the material properties of this golf club head 100 allows it to achieve unique performance properties consistent with the presently disclosed technology. What FIG. 1 does show is a location of a face center 102 of the frontal portion 104 of the golf club head 100 that contains a striking face insert. The face center, as shown here and referred to by the presently disclosed technology, relates to the geometric center of the striking face portion of the golf club head 100 measured by the USGA provided face center template as it would be commonly known to a person of ordinary skill in the golf club art. Attached to the rear of the frontal portion 104 is a rear portion 106, which makes up the back end of the golf club head 100.

In this embodiment of the presently disclosed technology, the frontal portion 104 may generally be made out of a steel type material having a density of between about 7.75 g/cc and about 8.00 g/cc, allowing a significant portion of the mass of the golf club head 100 to be concentrated at a frontal bottom region of the golf club head 100. The rear portion 106 of the golf club head 100 in this embodiment of the presently disclosed technology may generally be made out of the standard titanium material having a density of between about 4.00 g/cc and about 5.00 g/cc, allowing the rear portion 106 of the golf club head 100 to be relatively lightweight. However, it should be noted that in alternative embodiments of the presently disclosed technology, the frontal portion 104 may also be made out of a standard titanium material such as TI-6-4, Ti-8-1-1, beta-titanium, or any other type of titanium material without departing from the scope and content of the presently disclosed technology.

Figure 2:
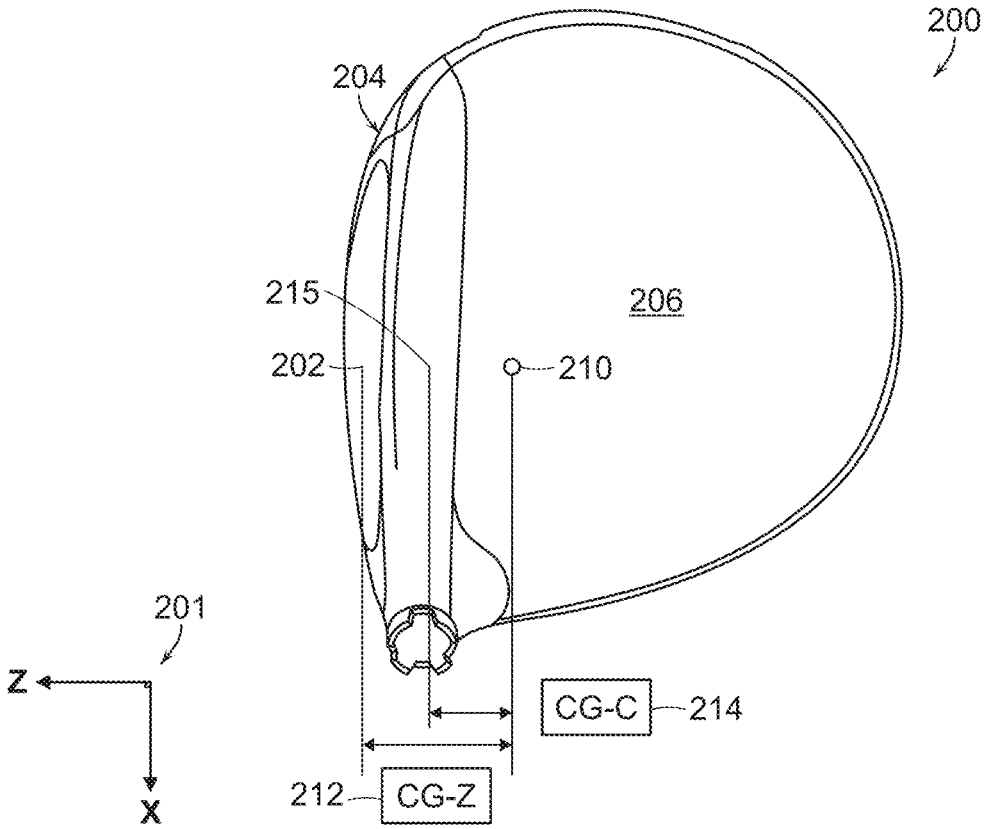
FIG. 2 of the accompanying drawings shows a top view of a golf club head in accordance with an exemplary embodiment of the present presently disclosed technology.
Figure 3:
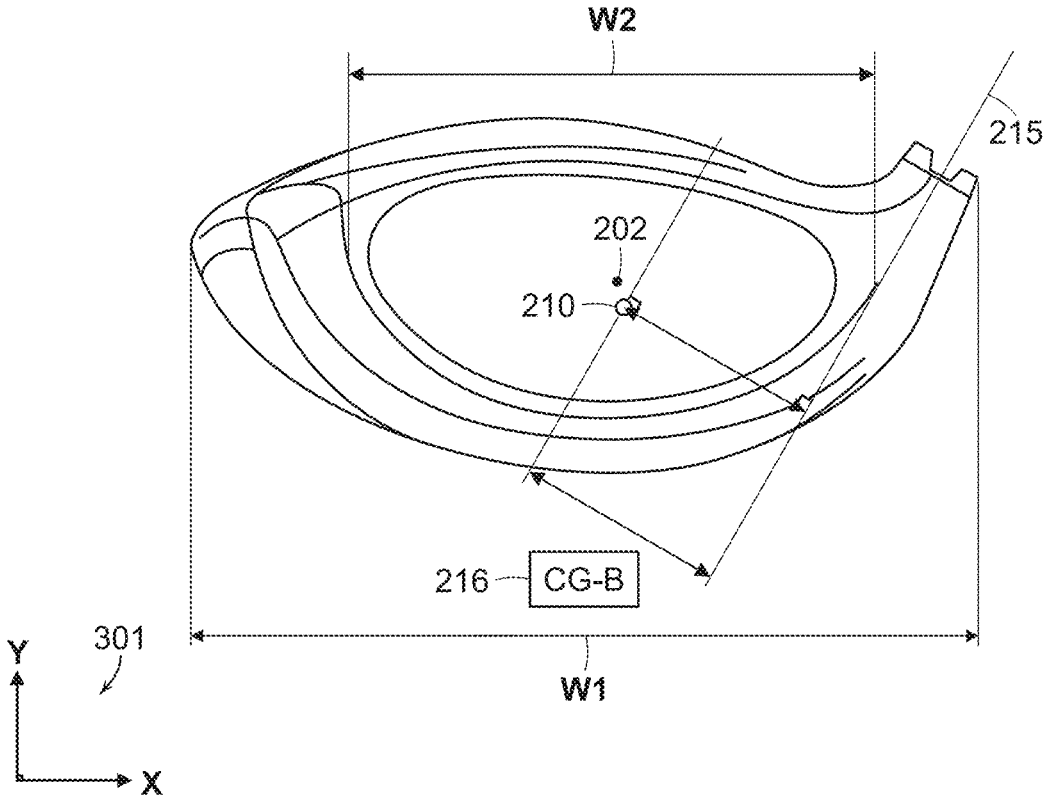
FIG. 3 of the accompanying drawings shows a frontal view of a golf club head in accordance with an exemplary embodiment of the present presently disclosed technology.

In order to illustrate more specific features of the golf club head 100, FIGS. 2 and 3 of the accompanying drawings is provided to give more insight into some of the specific inherent characteristics of the golf club head 200 that will be important to determine its improved performance. First off, FIG. 2 of the accompanying drawings, in addition to illustrating a golf club head 200 with a frontal portion 204 and a rear portion 206, also shows a Center of Gravity (CG) 210 location along the x-z plane on the coordinate system 201. Although the details of the CG location will be discussed in more detail with respect to the inertia properties of the golf club head 200, the general direction of the current inventive golf club head 200 is to have a CG location that is strategically located at a distance back from the frontal portion of the golf club head 200 to yield the most advantageous results.

More specifically, in the presently disclosed technology, the CG location rearward from the striking face, identified here as CG-Z is generally between about 25 mm to about 40 mm, in some embodiments, between about 26 mm and about 38 mm, and, in some embodiments, between about 27 mm and about 36 mm, all measured rearward from the face center 202 along the Z axis shown by the coordinate system 201. In addition to illustrating the CG-Z 212 numbers, an alternative measurement method is provided to measure how far back the CG 210 is located within the club head 200. In this alternative method, the CG 210 is measured from the shaft axis 215, and this measurement is illustrated as CG-C 214 is generally measured to be between about 10 mm to about 25 mm, in some embodiments, between about 12 mm to about 23 mm, and, in some embodiments, between about 14 mm to about 21 mm, all measured rearward from the shaft axis 215 along the Z axis shown by the coordinate system 201.

It should be noted that the strategic location of the CG 210 location rearward along the Z axis, irrespective of whether it is measured from the face center 202 or the shaft axis 215, is critical to the proper functionality of the current inventive golf club head 200. If the CG 210 location is too far forward, the golf club head 200 can result in a low MOI-X and MOI-Y as well as too low of a backspin when contacting a golf ball to yield desirable results. However, in the alternative, if the CG 210 location is too far rearward, the golf club head 200 can produce too much spin to yield desirable results. Hence, it can be seen that the criticality of the CG location rearward of along the Z axis is a fine balance of a very specific range of numbers that can severely hinder the performance of the golf club head 200 if it deviates from the ranges articulated above.

FIG. 3 of the accompanying drawings shows another important CG 210 measurement that is important to the proper functionality of the presently disclosed technology. More specifically, FIG. 3, in addition to illustrating all of the basic components of the golf club head 200 as previously shown, now introduces another measurement of the CG 210 location from the shaft axis 215 along an x-y plane shown by coordinate system 301. More specifically, FIG. 3 shows a CG 210 measurement that is perpendicular to the shaft axis 215 along this x-y plane away from the actual shaft axis 215 itself, called CG-B for the purpose of this application. The CG-B of the golf club head 210 may generally be between about 32 mm and about 39 mm, in some embodiments, between about 33 mm and about 38 mm, and, in some embodiments, about 35 mm.

In addition to illustrating the very important CG-B measurement of the golf club head, FIG. 3 of the accompanying drawings also shows measurements W1 and W2, indicative of the width of the golf club head 200 itself and the width of the face of the golf club head 200 respectively. In this embodiment of the presently disclosed technology, the width of the golf club head W1 may generally be between about 130 mm to and about 140 mm, in some embodiments, between about 132 mm to about 138 mm, and, in some embodiments, about 136 mm. The width of the face W2 may generally be between about 95 mm and about 105 mm, in some embodiments, between about 97 mm and about 103 mm, and, in some embodiments, about 100 mm.

Now that the CG location of the golf club head 200 has been defined, the other important features associated with the presently disclosed technology relates to the Moment of Inertia (MOI) of the golf club head 200. The MOI of a golf club head generally depicts the ability of the golf club head to resist twisting when it impacts an object at a location that is not aligned with the CG location previously discussed. More specifically, the MOI of a golf club head relates to the ability of the golf club head to resist twisting relative to the CG location. The MOI of the golf club head 200 may generally be broken down to three unique components, relating to the ability of the golf club head 200 to resist rotation along three different axes. The three axes of rotation for which the MOI is generally referred coincides with the coordinate system 101, 201, and 301 (shown in FIG. 1, FIG. 2, and FIG. 3 respectively).

As the previously discussion already hinted, the current inventive golf club head 200 may generally have a high value for the MOI about the X and Y axis, while maintaining a low MOI about the Z axis. More specifically, the current inventive golf club head 200 may generally have a MOI about the X axis (MOI-X) that is greater than about 300 kg-mm$^2$, in some embodiments, greater than about 310 kg-mm$^2$, and, in some embodiments, greater than about 320 kg-mm$^2$without departing from the scope and content of the presently disclosed technology. As for MOI about the Y axis (MOI-Y), the present inventive golf club head 200 may generally have a MOI about the Y axis that is greater than about 400 kg-mm$^2$, in some embodiments, greater than about 410 kg-mm$^2$, and, in some embodiments, greater than about 420 kg-mm$^2$ all without departing from the scope and content of the presently disclosed technology.

While the large MOI number about the X and Y axis discussed previously are not necessarily new in the world of golf club head 200 designs, the ability to maintain those number while decreasing the MOI about the Z axis (MOI-Z) and holding the MOI about the Shaft axis (MOI-SA) to a minimum is what makes the presently disclosed technology. While the majority of the golf industry are focusing their attention so intently on the ability of the golf club head 200 to offer forgiveness on off center hits by trying to increase the MOI-Y to astronomical numbers, they have failed to recognize the ability of the golf club head 200 to offer more club head speed and more ball speed by decreasing the MOI about the Z axis (MOI-Z) in concert with the minimization of MOI about the Shaft axis (MOI-SA). The presently disclosed technology focuses its attention on that very specific unrecognized characteristic, and has developed a golf club head 200 design to take advantage and maximize the performance of the golf club head 200 by focusing on the MOI about the Z axis. More specifically, a golf club head 200 in accordance with the presently disclosed technology may generally have a MOI about a Z axis that is less than about 268 kg-mm$^2$, in some embodiments, less than about 260 kg-mm$^2$, and, in some embodiments, less than about 250 kg-mm$^2$. Additionally, the golf club head 200 may generally have a MOI about a Shaft axis that is less than about 850 kg-mm$^2$.

It should be noted here that the low MOI-Z numbers mentioned above cannot by itself accurately depict and describe the presently disclosed technology; as old school golf club heads with much smaller footprint may inherently have a low MOI-Z number, combined with a low MOI-X and MOI-Y number. Hence, it is important to recognize here that the presently disclosed technology is predicated on the interrelationship between the different numbers achieved by the MOI-X and MOI-Y numbers as it relates to MOI-Z and MOI-SA, in combination with the CG location articulated above.

In order to capture the essence of the presently disclosed technology, a ratio can be created between the MOI-X, MOI-Y, and MOI-Z to help provide one way to quantify this relationship. In one first example, a MOI-X to MOI-Z Ratio can be created to help quantify the current golf club head 200 as illustrated by Eq. (1) below. In one exemplary embodiment of the presently disclosed technology, the MOI-X to MOI-Z Ratio is greater than about 1.10, in some embodiments, greater than about 1.20, and, in some embodiments, greater than about 1.28.

$$MOI\text{-}X \text{ to } MOI\text{-}Z \text{ Ratio} = \frac{MOI\text{-}X}{MOI\text{-}Z} \quad \text{Eq. (1)}$$

Similarly, a comparable ratio can be established called a MOI-Y to MOI-Z Ratio to quantify the current golf club head 200 as illustrate by Eq. (2) below. In one exemplary embodiment of the presently disclosed technology, the MOI-Y to MOI-Z ratio is greater than about 1.50, in some embodiments, greater than about 1.57, and, in some embodiments, greater than about 1.68.

$$MOI\text{-}Y \text{ to } MOI\text{-}Z \text{ Ratio} = \frac{MOI\text{-}Y}{MOI\text{-}Z} \quad \text{Eq. (2)}$$

As it can be seen from the relationship established by the Eqs (1) and (2) above, the presently disclosed technology relates to a specific relationship between the MOI of the golf club head 200 with an extra focus on minimizing the MOI-Z about the Z axis while maintaining a high MOI-Y: In order to further illustrate this, a graphical representation of the relationship is provided as FIG. 4.

Figure 4:
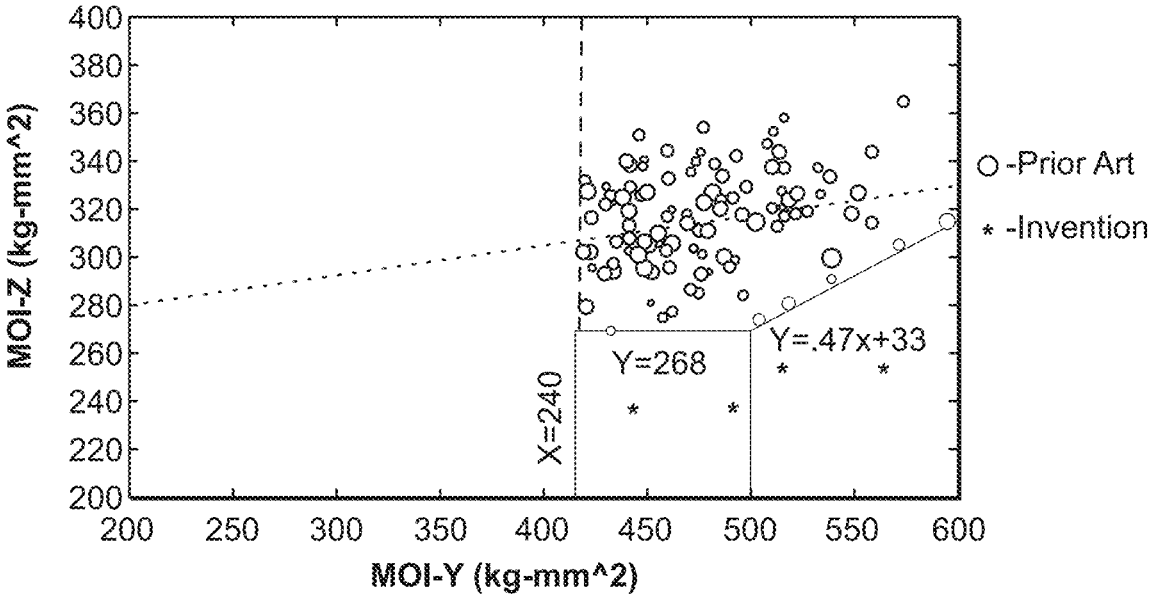
FIG. 4 of the accompanying drawings shows a plot of MOI-Z vs MOI-Y numbers for the current presently disclosed technology, compared to prior art golf club heads.

FIG. 4 of the accompanying drawings shows a plot of various data points of various golf club head and their respective MOI-Z numbers as well as their MOI-Y number. In FIG. 4 the X-axis represents the MOI-Y while the Y-axis represents the MOI-Z. The data points shown in FIG. 4 have been separated into circular dots and asterisks. The circular dots are representative of the data of "prior art" golf club heads, whereas the asterisk data points represent the presently disclosed technology.

A closer examination of the prior art data points will show that none of the golf club heads in the prior art are capable of achieving a MOI-Z number of lower than 268 kg-mm$^2$, for all modern day golf club heads that have a MOI-Y of greater than 420 kg-mm$^2$. However, an even closer examination of the graph of FIG. 4 will show that as the MOI-Y numbers of the golf club heads exceeds 500 kg-mm$^2$, an additional relationship can be established to quantify the ability of the presently disclosed technology to achieve the optimal MOI-Z to MOI-Y relationship. In fact, that relationship is shown in FIG. 4 as $Y \leq 0.47x+33$. Combining the two conditions articulated above can result in another unique way to quantify the presently disclosed technology whereas, for golf club heads having a MOI-Y of between 420 kg-mm$^2$ and 500 kg-mm$^2$, the golf club head generally has a MOI-Z of less than about 268; however, for golf club heads having a MOI-Y of greater than 500 kg-mm$^2$, the golf club head may have a MOI-Z that satisfies Eq. (3) below:

$$MOI\text{-}Z \leq (0.47 * MOI\text{-}Y) + 33 \quad \text{Eq. (3)}$$

Alternatively speaking, it can be said that in one embodiment of the presently disclosed technology, the golf club head 200 may have a MOI-Z that satisfies the relationship $MOI\text{-}Z \leq (0.47*MOI\text{-}Y)+33$ if the MOI-Y number is greater than 500 kg-mm$^2$, and a MOI-Z that is less than 268 kg-mm$^2$ if the MOI-Y number is between 420 kg-mm$^2$ and 500 kg-mm$^2$.

Figure 5:
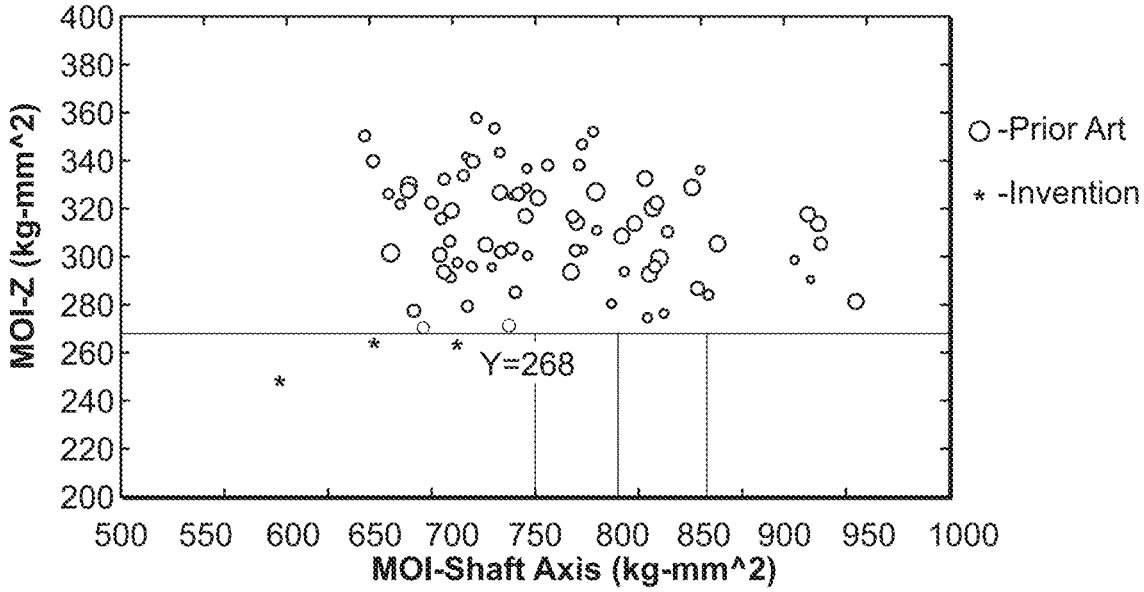
FIG. 5 of the accompanying drawings shows a plot of MOI-Z vs MOI-Shaft Axis numbers for the current presently disclosed technology, compared to prior art golf club heads.

FIG. 5 of the accompanying drawing introduces another MOI value relating to a golf club head not previously discussed named MOI-Shaft Axis (MOI-SA). The MOI of a golf club head as it relates to the shaft axis is defined as the ability of the golf club head to resist twisting upon impact with a golf ball at a location that is not aligned with the shaft axis. A golf club head in accordance with the presently disclosed technology may generally have a MOI-SA of less than about 850 kg-mm$^2$, in some embodiments, less than about 800 kg-mm$^2$, and, in some embodiments, less than about 750 kg-mm$^2$. The relationship between the MOI-SA and MOI-Z is highlighted in FIG. 5 and is important to the presently disclosed technology. FIG. 5 of the accompanying drawings shows that irrespective of the MOI-SA numbers, all of the prior art golf club heads have a MOI-Z of greater than about 268 kg-mm$^2$, while all of the current inventive golf club heads have a MOI-Z of less than about 268 kg-mm$^2$.

Figure 6:
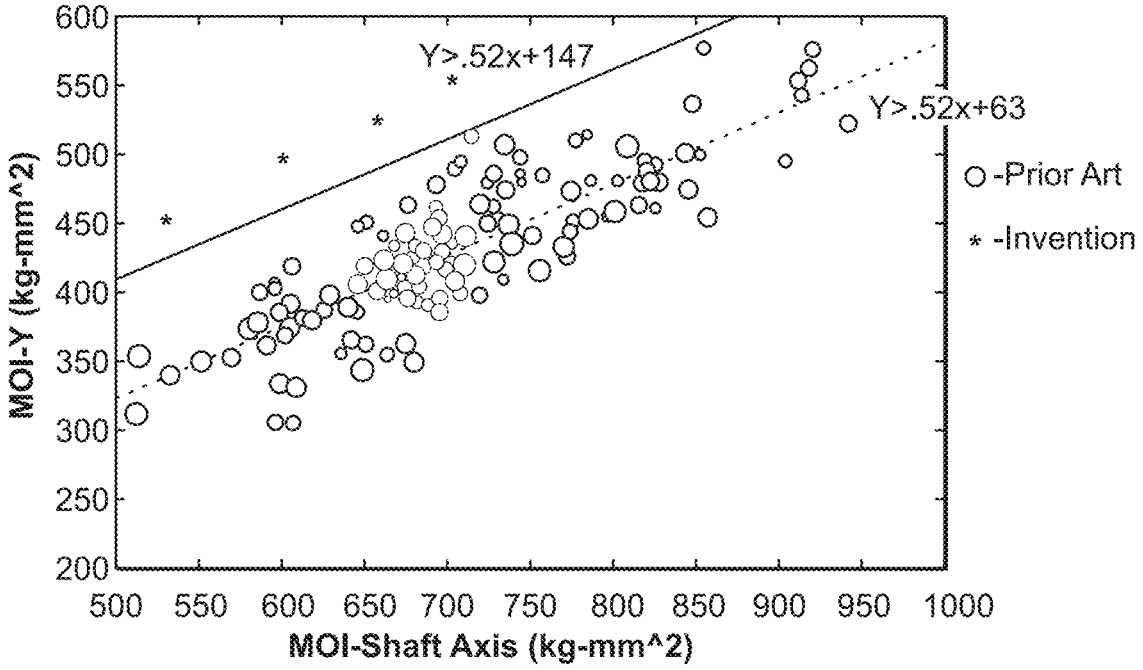
FIG. 6 of the accompanying drawings shows a plot of MOI-Y vs MOI-Shaft Axis numbers for the presently disclosed technology, compared to prior art golf club heads.

FIG. 6 of the accompanying drawings establishes a graphical relationship between the MOI-Y of the golf club head with the newly introduced MOI-SA. As a closer examination of the graph shown in FIG. 6 will show, the presently disclosed technology is capable of achieving a higher than average MOI-Y, all while keeping a relatively small MOI-SA. Similar to previous plots, the circular points on the plot will refer to prior art golf club heads, while the asterisks will refer to the presently disclosed technology. Hence, it can be seen that the presently disclosed technology occupies a previously unachieved space delineated by an equation $Y \geq 0.52x+147$, which when put into context with the variables used in this plot, yields Eq. (4) below:

$$MOI\text{-}Y \geq (0.52 * MOI\text{-}SA) + 147 \quad \text{Eq. (4)}$$

Figure 7:
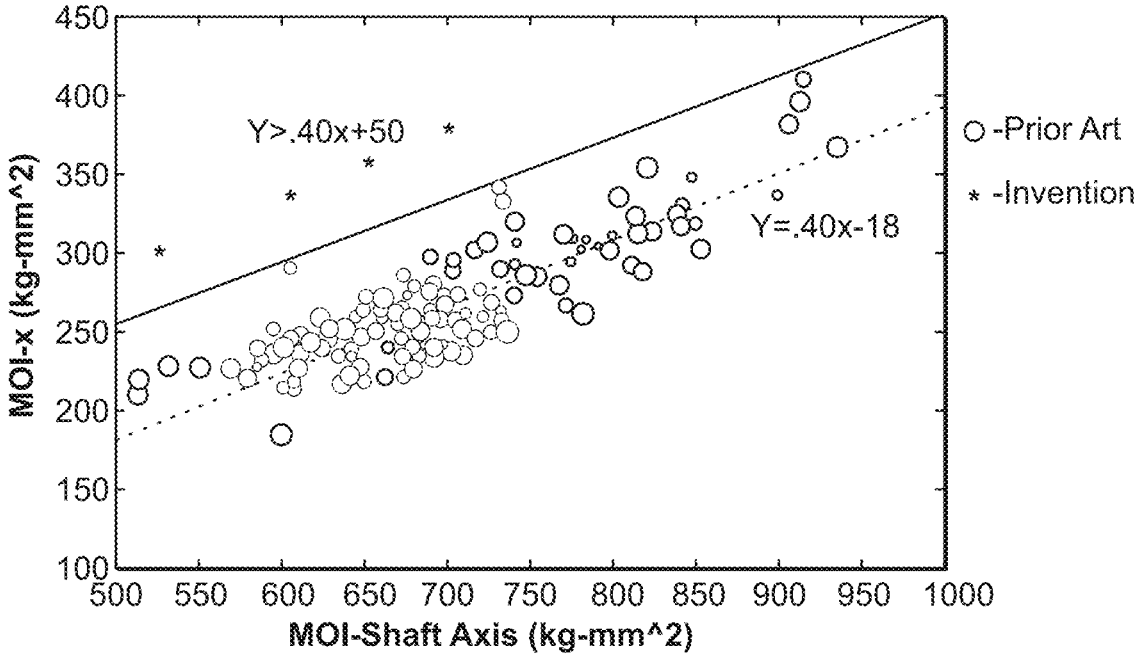
FIG. 7 of the accompanying drawings shows a plot of MOI-X vs MOI-Shaft Axis numbers for the presently disclosed technology, compared to prior art golf club heads.

FIG. 7 of the accompanying drawings establishes a graphical relationship between the MOI-X of the golf club head with now a familiar MOI-SA. As a closer examination of the graph shown in FIG. 7 will show, the presently disclosed technology is capable of achieving a higher than average MOI-X, all while keeping a relatively small MOI-SA. Hence, it can be seen that the presently disclosed technology occupies a previously unachieved space delineated by an equation $Y \geq 0.40x+50$, which when put into context with the variables used in this plot, yields Eq. (5) below:

$$MOI\text{-}X \geq (0.40 * MOI\text{-}SA) + 50 \quad \text{Eq. (5)}$$

Figure 8:
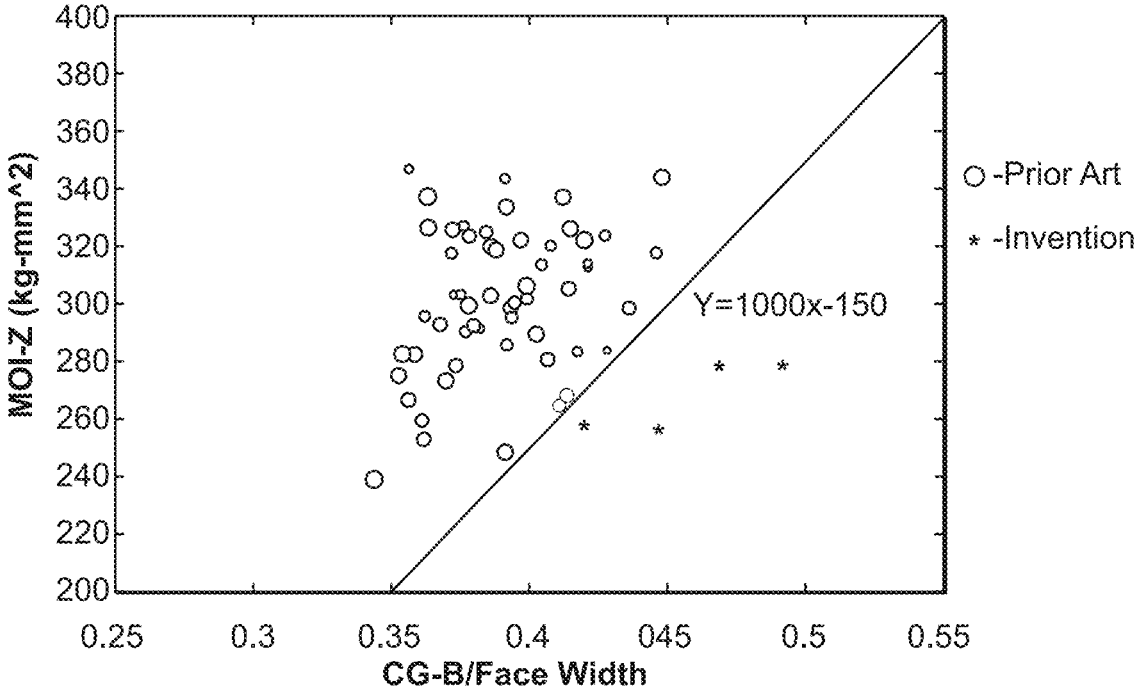
FIG. 8 of the accompanying drawings shows a plot of MOI-Z vs CG-B/Face Width numbers for the presently disclosed technology, compared to prior art golf club heads.

FIG. 8 of the accompanying drawings establishes a graphical relationship between the MOI-Z of the golf club head with a ratio of CG-B/Face Width. Both the measurement for CG-B. and Face Width can be found in FIG. 3 of the accompanying drawings as well as the accompanying discussion above. The CG-B measurement is explicitly shown in FIG. 3, while the Face Width referred to by the chart in FIG. 8 is shown as W2. A closer examination of the graph shown in FIG. 8 will show that the presently disclosed technology is capable of achieving a lower MOI-Z, while keeping the CG-B/Face Width number fairly consistent above 0.4. CG-B/Face Width is indicative of the location of the center of gravity while keeping a moderately sized face golf club head.

In the chart shown in FIG. 8, it can be seen that the presently disclosed technology occupies a previously unachieved space delineated by an equation Y≤1000x−150, which when put into context with the variable used in this plot, yields Eq. (6) below:

$$MOI-Z \leq \left(1000 * \frac{CG-B}{\text{Face Width}}\right) - 150 \quad \text{Eq. (6)}$$

Figure 9:
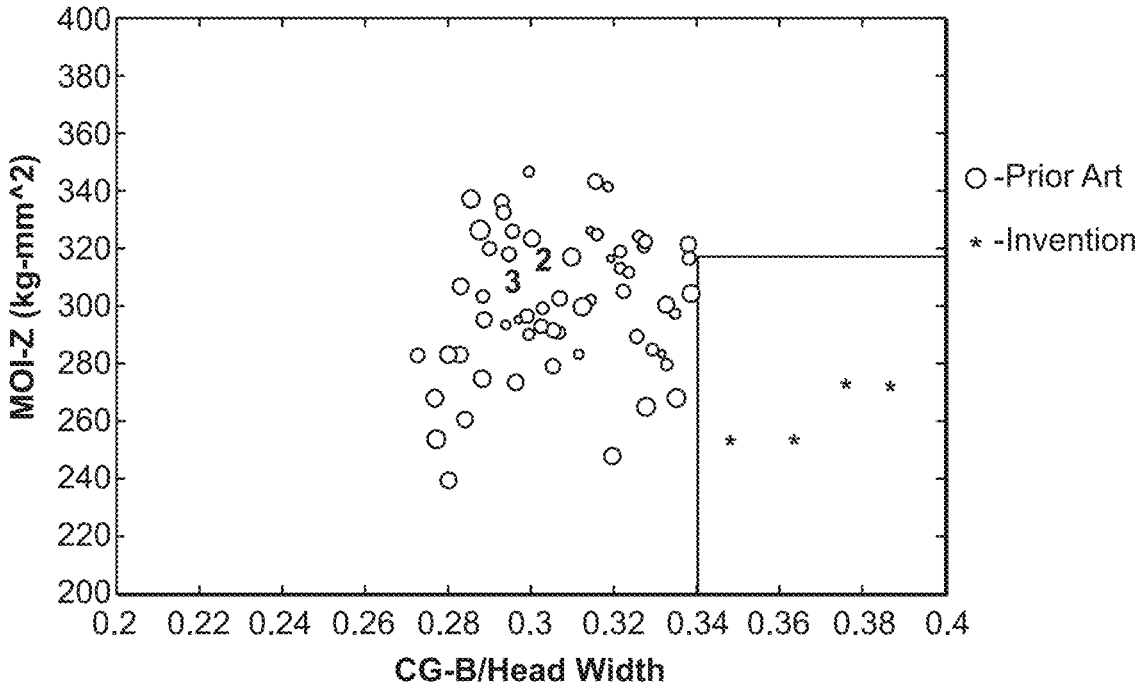
FIG. 9 of the accompanying drawings shows a plot of MOI-Z vs CG-B/Head Width numbers for the presently disclosed technology, compared to prior art golf club heads.

FIG. 9 of the accompanying drawings establishes a graphical relationship between the MOI-Z of the golf club head with a ratio of CG-B/Head Width. Both the measurement for CG-B and Head Width can be found in FIG. 3 of the accompanying drawings as well as the accompanying discussion above. The CG-B measurement is explicitly shown in FIG. 3, while the Head Width referred to by the chart in FIG. 9 is shown as W1. A closer examination of the graph shown in FIG. 9 will show that the presently disclosed technology is capable of achieving a lower MOI-Z, while keeping the CG-B/Head Width number fairly consistent above 0.34. CG-B/Head Width is indicative of the location of the center of gravity while keeping a moderately sized head width of the golf club head.

In the chart shown in FIG. 9, it can be seen that the presently disclosed technology occupies a previously unachieved space delineated by a MOI-Z number that is lower than 320 kg-mm$^2$ combined with a CG-B/Head Width number that is greater than about 0.34.

Figure 10:
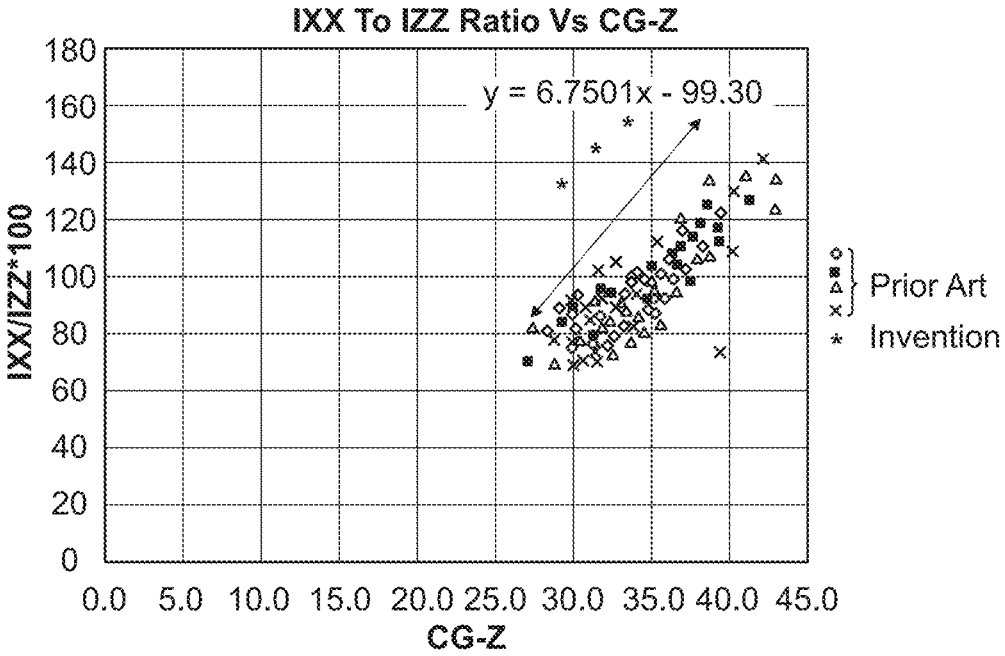
FIG. 10 of the accompanying drawings shows a plot of MOI-X/MOI-Z vs CG-Z numbers for the presently disclosed technology, compared to prior art golf club heads.

FIG. 10 of the accompanying drawings establishes another graphical relationship of the performance of a golf club in accordance with an embodiment of the presently disclosed technology. More specifically, FIG. 10 of the accompanying drawings shows a relationship between MOI-X/MOI-Z and CG-Z. (MOI-X is used interchangeably with Ixx, MOI-Y is used interchangeably with Iyy, and finally MOI-Z is used interchangeably with Izz) The definition and measurement for CG-Z of a golf club head can be found in the earlier discussion relating to FIG. 2 of the accompanying drawings, while the background information establishing MOI-X and MOI-Z have already been discussed previously. Although the selection of the plot for the X and Y axis may appear random initially to a person not versed in golf club design, but a closer examination will reveal that the relationship created here is absolutely critical to the proper performance of the presently disclosed technology. On the Y axis of the plot shown in FIG. 10, a ratio between MOI-X and MOI-Z is created here. This ratio created illustrates the ability of the current inventive golf club head to maximize the value of one variable (MOI-X) while minimizing the value of another variable (MOI-Z); which resonates with the theme of the presently disclosed technology. The MOI-Z used in the X axis of the plot shown in FIG. 10 is indicative of the CG location of the golf club head rearward from the front of the golf club head, and it is desirable to maintain that in the range described above.

A further examination of the plot shown in FIG. 10 will show that the presently disclosed technology occupies a portion of the graph that was previously unachieved. This portion of the graph is delineated from other prior art data points by an equation Y≥6.7501x−99.3, which when put into context with the variable used in this plot, yields Eq. (7) below:

$$\frac{MOI-X}{MOI-Z} \geq (6.7501 * CG-Z) - 99.30 \quad \text{Eq. (7)}$$

Figure 11:
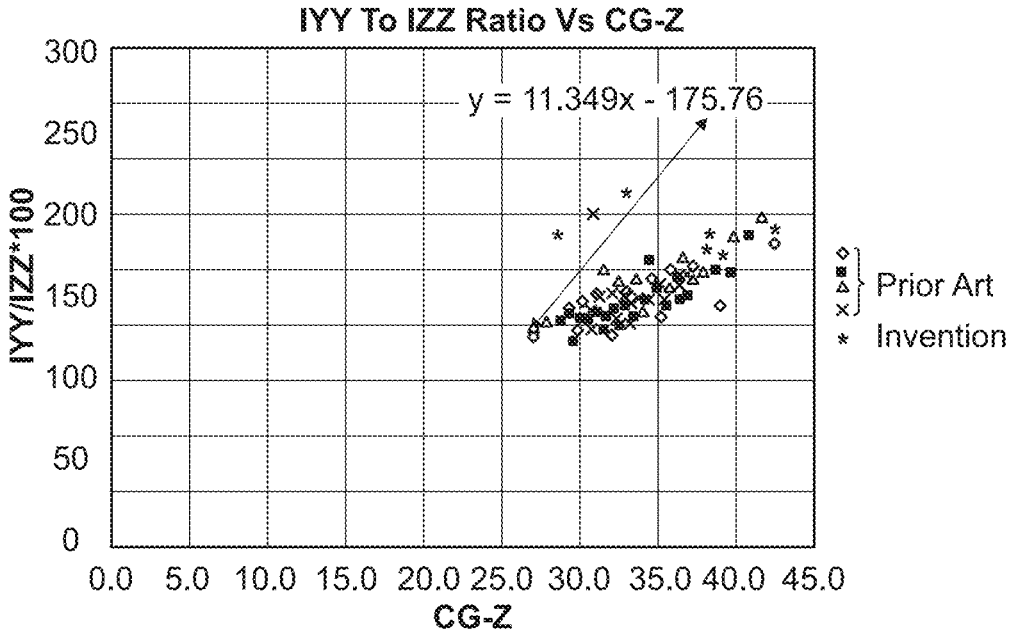
FIG. 11 of the accompanying drawings shows a plot of MOI-Y/MOI-Z vs CG-Z numbers for the presently disclosed technology, compared to prior art golf club heads.

FIG. 11 of the accompanying drawings establishes another graphical relationship of a golf club in accordance with an embodiment of the presently disclosed technology by creating a relationship between the MOI-Y/MOI-Z and CG-Z. The definition and measurement for CG-Z of a golf club head can be found in the earlier discussion relating to FIG. 2 of the accompanying drawings, while the background information establishing MOI-Y and MOI-Z have already been discussed previously. Similar to the previous discussion, the relationship between MOI-Y and MOI-Z is indicative of the ability of a golf club to achieve great forgiveness along the MOI-Y axis, while minimizing the MOI-Z of a golf club head to achieve a higher ball speed, as previously discussed. Similar to previous discussion, FIG. 11 of the accompanying drawings shows that the presently disclosed technology is capable of achieving performance characteristics that was previously unachieved. This portion of the graph is delineated from other prior art data points by an equation Y≥11.349x−175.76, which when put into context with the variable used in this plot, yields Eq. (8) below:

$$\frac{MOI-Y}{MOI-Z} \geq (11.349 * CG-Z) - 175.76 \quad \text{Eq. (8)}$$

Figure 12:
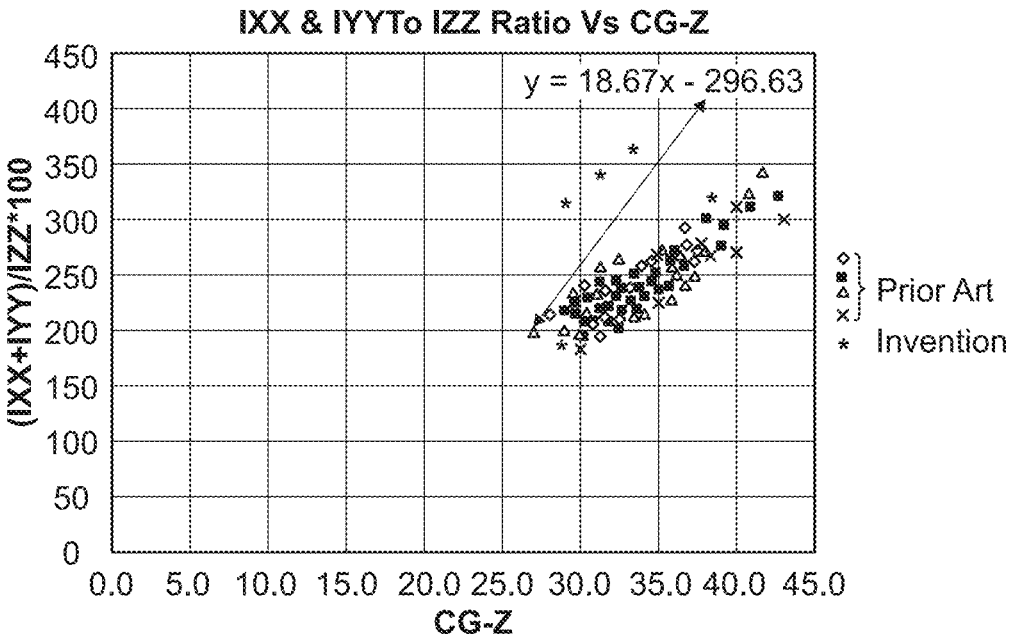
FIG. 12 of the accompanying drawings shows a plot of (MOI-X+MOI-Y)/MOI-Z vs CG-Z numbers for the presently disclosed technology, compared to prior art golf club heads.

FIG. 12 of the accompanying drawings establishes another graphical relationship of a golf club in accordance with an embodiment of the presently disclosed technology by creating a relationship between the (MOI-X+MOI-Y)/MOI-Z and CG-Z. The definition and measurement for CG-Z of a golf club head can be found in the earlier discussion relating to FIG. 2 of the accompanying drawings, while the background information establishing MOI-X, MOI-Y, and MOI-Z have already been discussed previously. Similar to the previous discussion, the relationship between MOI-X, MOI-Y, and MOI-Z is indicative of the ability of a golf club to achieve great forgiveness along both the MOI-X and MOI-Y axes, while minimizing the MOI-Z of a golf club head to achieve a higher ball speed, as previously discussed. Similar to previous discussion, FIG. 12 of the accompanying drawings shows that the presently disclosed technology is capable of achieving performance characteristics that was previously unachieved. This portion of the graph is delineated from other prior art data points by an equation Y≥18.67x−296.63, which when put into context with the variable used in this plot, yields Eq. (9) below:

$$\frac{(MOI-X + MOI-Y)}{MOI-Z} \geq (18.67 * CG-Z) - 296.63 \quad \text{Eq. (9)}$$

Figure 13:
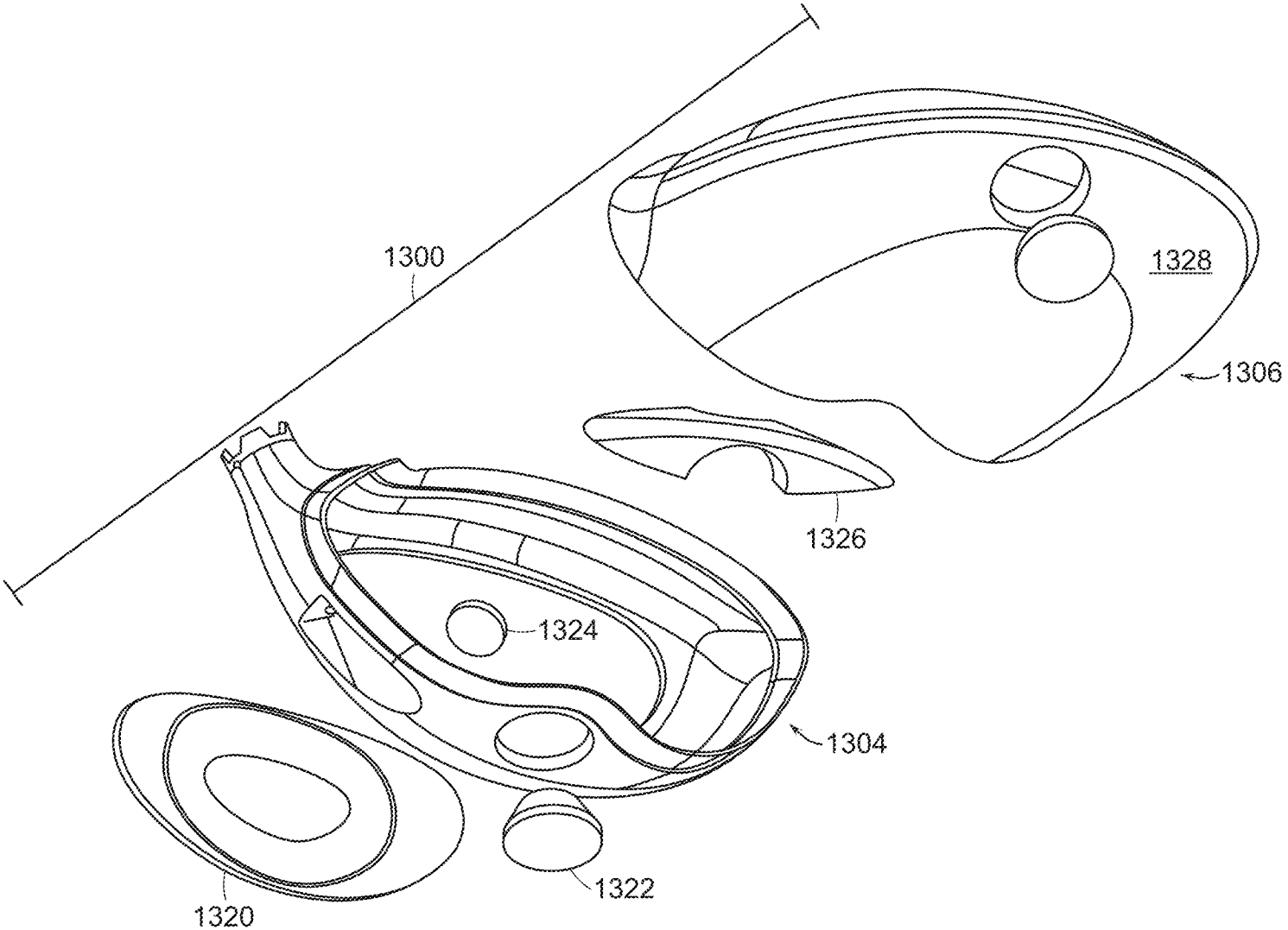
FIG. 13 of the accompanying drawings shows an exploded sole perspective view of a golf club head in accordance with an exemplary embodiment of the presently disclosed technology.
Figure 14:
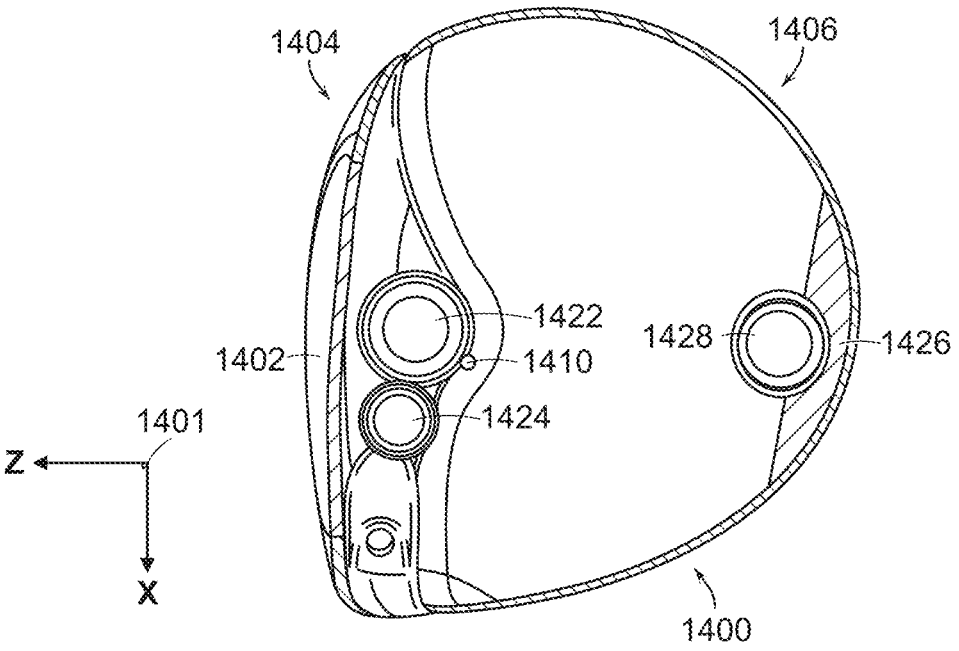
FIG. 14 of the accompanying drawings shows a horizontal cross-sectional view of a golf club head in accordance with an exemplary embodiment of the presently disclosed technology.
Figure 15:
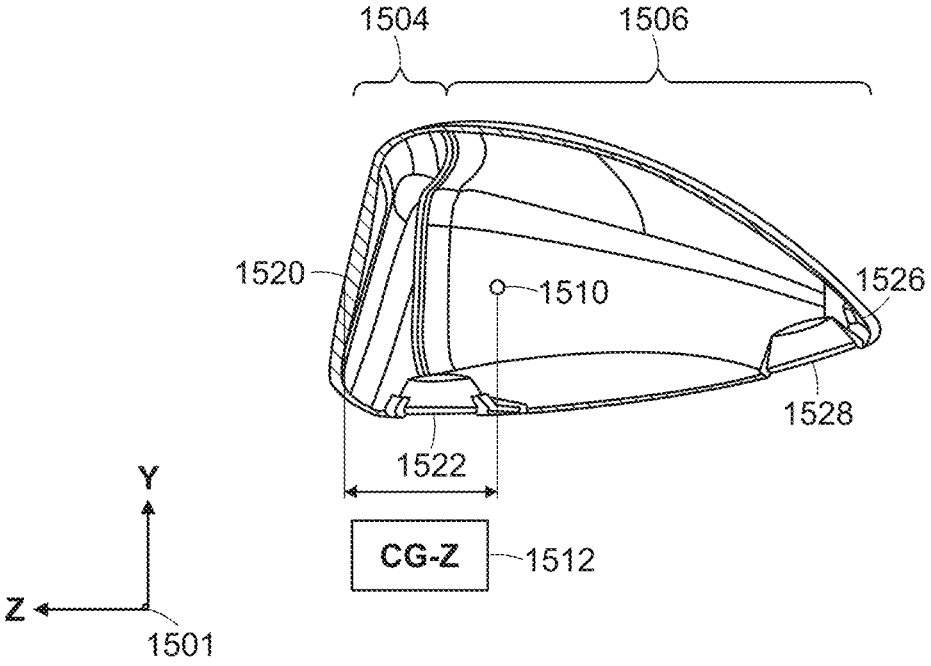
FIG. 15 of the accompanying drawings shows a vertical cross-sectional view of a golf club head in accordance with an exemplary embodiment of the presently disclosed technology.

FIGS. 13 through 15 show different exploded and cross-sectional view of golf club heads and their internal components that are used to achieve the performance characteristics described above. FIG. 13 shows an exploded perspective view of an exemplary design of a golf club head 1300 in capable of achieving the performance characteristics previously discussed. The golf club head 1300 is made out of the essential components previously discussed in FIG. 1 in terms of a frontal portion 1304 and a rear portion 1306. However, this exploded view of golf club head 1300 allows additional components to be shown in more detail. More specifically, FIG. 13 illustrates that, as often the case in a golf club head construction, the frontal portion 1302 may further be comprised out of a separate component called the striking face insert 1320 to form the striking portion of the golf club head 1300. The rear portion 1306 of the golf club head 1300 is where it gets more interesting. In order to achieve the performance numbers above of a higher MOI-Y, a higher MOI-X, and a lower MOI-Z, a significant amount of mass is re-allocated towards the center of the golf club head away from the perimeter. In order to achieve this, the presently disclosed technology utilizes four weighting members that are all comprised out of a high density material that have a higher density than the frontal portion 1302 or the rear portion 1306. The four weighting members can be separated into a frontal sole weight 1322, frontal internal weight 1324, rear internal weight 1326, and rear sole weight 1328, and these weighting members may all generally have a material density of greater than 13 g/cc, in some embodiments, greater than about 15 g/cc, and, in some embodiments, greater than or about about 17 g/cc.

It should be noted that in this exemplary embodiment of the presently disclosed technology, all of the weighting members 1322, 1324, 1326, and 1328 are all made out of the same material having the same heavy density discussed previously. However, in alternative embodiments of the presently disclosed technology, different densities of tungsten may be used for different weighting members depending on the design criteria and desired CG location all without departing from the scope and content of the presently disclosed technology.

FIG. 14 of the accompanying drawings shows a cross-sectional view of a golf club head 1400 in accordance with an exemplary embodiment of the presently disclosed technology. The cross-sectional view of the golf club head taken across a horizontal plane across the face of the golf club head 1400 to allow some of the relationship between the golf club head 1400 and the various weighting member 1422, 1424, 1426, and 1428 to be shown more clearly. In addition to the weighting members, the cross-sectional view of the golf club head 1400 shown in FIG. 14 also allows the face center 1402 and the CG location 1410 to be re-introduced as it relates to the weighting members. It can be seen from this view that at least one weighting member is located near a central portion of the golf club head in a heel to toe direction, and substantially in line with and behind the face center.

FIG. 15 of the accompanying drawings shows a cross-sectional view of a golf club head 1500 in accordance with an exemplary embodiment of the presently disclosed technology taken along a vertical plane that passes through the center of the face. This cross-sectional view of the golf club head 1500 shown in FIG. 15 provides a little more information on the interworking relationship between the components. More specifically, FIG. 15 shows a striking face insert 1520 being located in the frontal portion 1504 of the golf club head 1500. In addition to the above, FIG. 15 also shows that the frontal sole weight 1522 is located in a receptacle that is created within the frontal portion 1504. Although not shown in this cross-sectional view in FIG. 15, the frontal internal weight is also located in the frontal portion 1504. Attached to the rear of the frontal portion 1504 is the rear portion 1506. The rear portion 1506 forms the aft body portion of the golf club head 1500, and contains the rear internal weight 1526 and the rear sole weight 1528. These weighting members, combined with the unique materials used to form the frontal portion 1504 and the rear portion 1506, allow the golf club head 1500 to achieve the unique performance characteristics outlined previously.

FIGS. 16 through 20 show various perspective and cross-sectional views of a golf club head 1600 in accordance with an alternative embodiment of the presently disclosed technology that is capable of achieving the performance goals previously mentioned. Similar to the previous embodiment illustrated by FIGS. 1-3 and 13-15, a lot of weighting member is located near the center of the golf club head 1600 in a heel to toe orientation along the x-axis behind the face center 1602 to help minimize the MOI-Z of the golf club head 1600.

Figure 16:
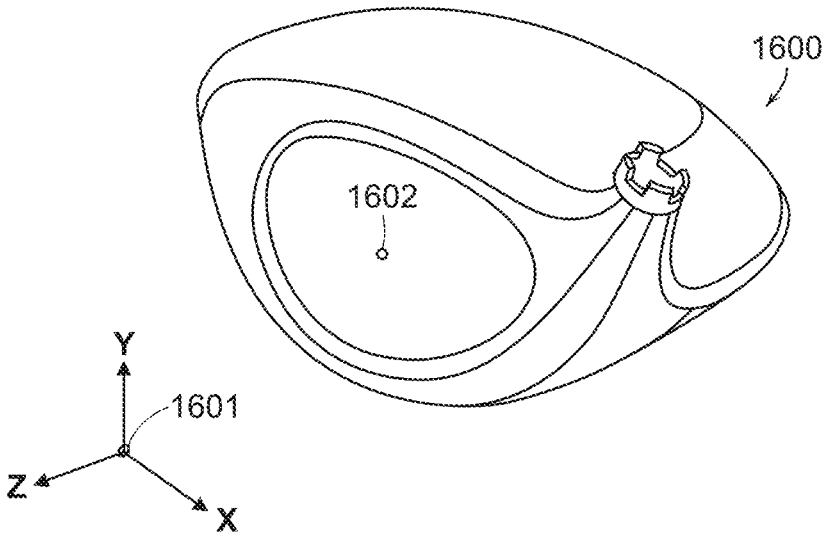
FIG. 16 of the accompany drawings shows a perspective view of a golf club head in accordance with an alternative embodiment of the presently disclosed technology.

More specifically, FIG. 16 of the accompanying drawings shows a perspective view of a golf club head 1600 in accordance with this alternative embodiment of the presently disclosed technology. Although not much can be gleamed from this perspective view of the golf club head 1600, it does lay the ground work for the subsequent discussion relating to this particular embodiment of the presently disclosed technology. Finally, FIG. 16, similar to previous figures that illustrate a golf club head, provides a coordinate system 1601 to guide the subsequent discussions.

Figure 17:
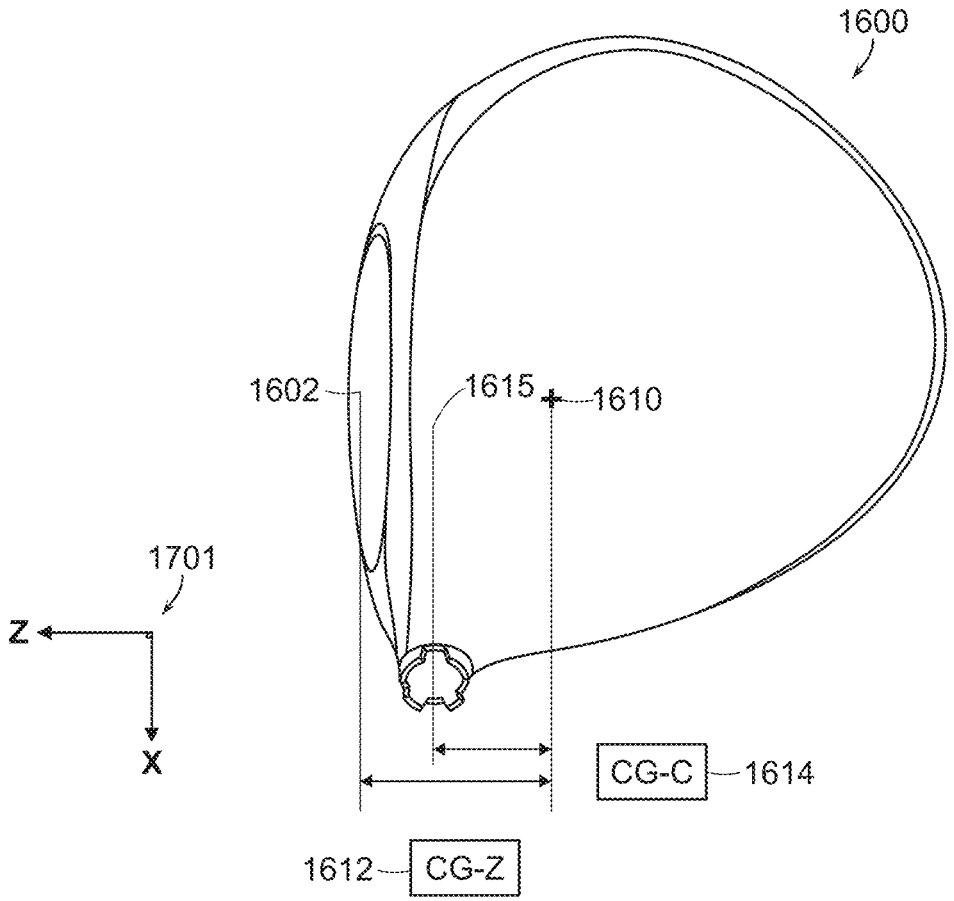
FIG. 17 of the accompanying drawings shows a top view of a golf club head in accordance with an alternative embodiment of the presently disclosed technology.

FIG. 17 of the accompanying drawings shows a top view of a golf club head 1600 in accordance with this alternative embodiment of the presently disclosed technology. In this top view, a couple of familiar dimensions are reintroduced here. First and foremost, the top view of the golf club head 1600 shown in FIG. 17 allows the relationship between the face center 1602 and the CG 1610 to be shown in more detail. When measured along the Z-axis, the measurement CG-Z is shown as 1612. The location of the CG, when referenced against the shaft axis 1615 yields another way to measure the CG location along the Z-axis called CG-C 1614. The number ranges for the CG-Z 1612 and CG-C 1614 measurements are not much different from previous discussions, but this embodiment of the presently disclosed technology provides an alternative way to achieve those targets with a slightly different construction without the need for a multi-material chassis.

Figure 18:
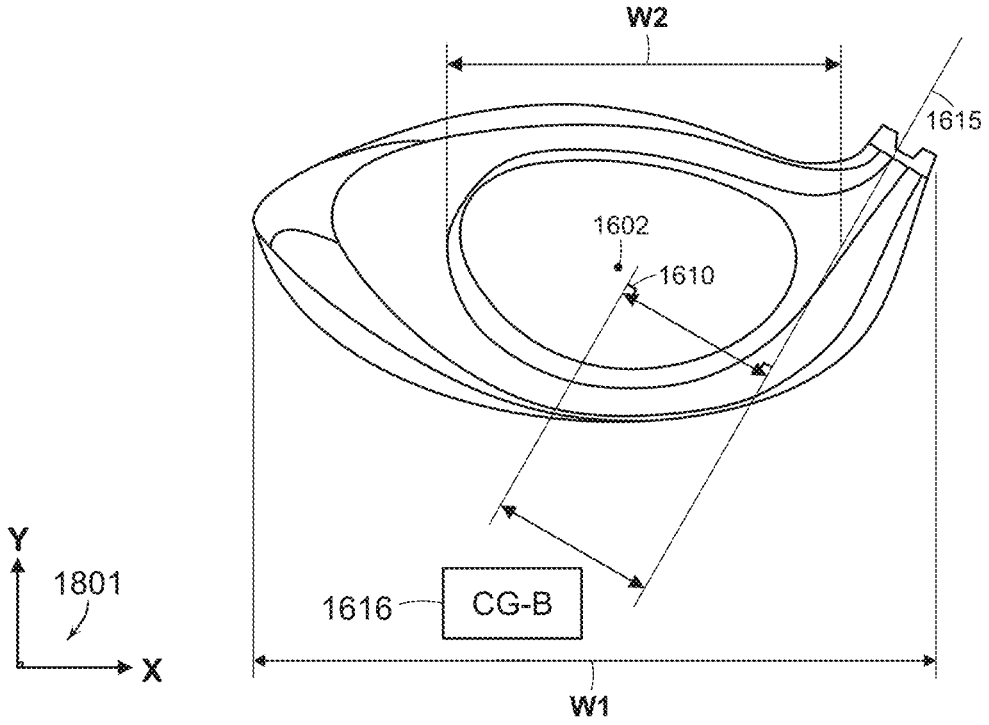
FIG. 18 of the accompanying drawings shows a frontal view of a golf club head in accordance with an alternative embodiment of the presently disclosed technology.

FIG. 18 of the accompanying drawings shows a frontal view of a golf club head 1600 in accordance with this alternative embodiment of the presently disclosed technology. In this frontal view, we can see another feature utilized by the present embodiment to help achieve the performance criteria of the presently disclosed technology. More specifically, FIG. 18 shows that in this embodiment of the presently disclosed technology, in order to minimize the MOI-Z of the golf club head 1600, weight is removed from the extremities of the golf club head 1600 via a reshaping of the contour at the toe portion of the golf club head 1600. This reshaping of the contour at the toe portion of the golf club head 1600 not only removes weight from the extremities, but also tightens up the face profile of the golf club head 1600 to create a unique performing golf club head 1600.

In addition to illustrating this toe contour profiling, FIG. 18 also shows a CG-B 1616 measurement relating to the shaft axis 1615 similar to the previous discussion. Once again, the CG-B 1616 measurement range is in line as the previous discussion have mentioned, and does not deviate much from the design intent of the presently disclosed technology.

Figure 19:
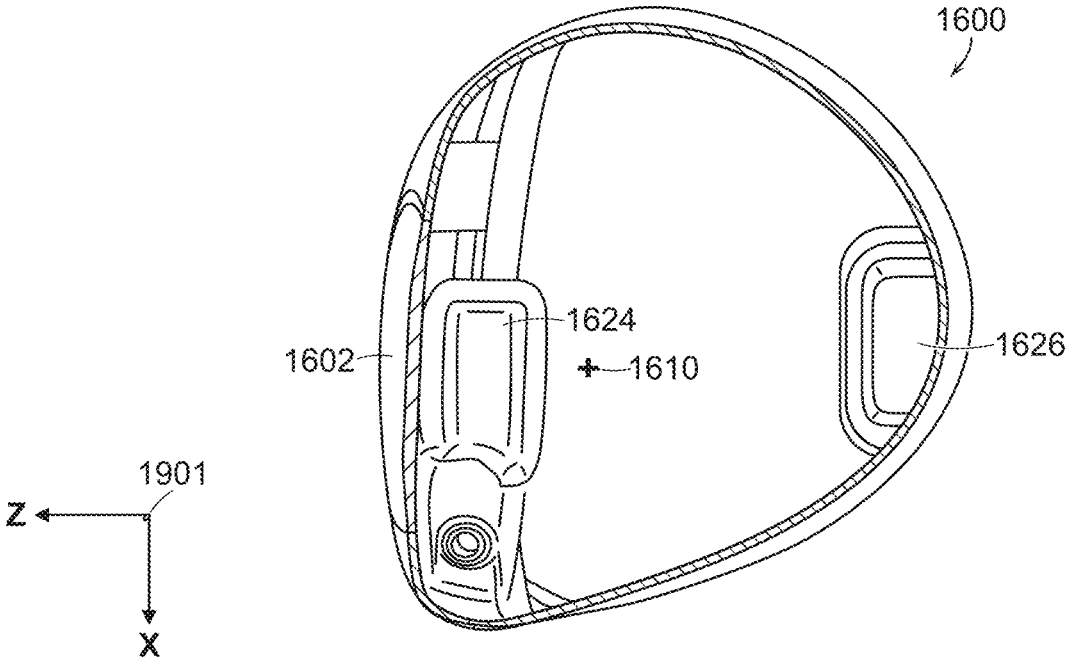
FIG. 19 of the accompanying drawings shows a horizontal cross-sectional view of a golf club head in accordance with an alternative embodiment of the presently disclosed technology.

FIG. 19 of the accompanying drawings shows a cut open cross-sectional view of a golf club head 1600 in accordance with this alternative embodiment of the presently disclosed technology taken along a horizontal plane. In this embodiment of the presently disclosed technology, the overarching theme of placing the weights along the central portion of the golf club head 1600 reemerges again. More specifically, the golf club head 1600 further comprises of a frontal internal weight 1624 and a rear internal weight 1626. These weights, however, different from prior embodiments of the presently disclosed technology in that they can be made out of the same material as the body portion of the golf club head 1600 such as titanium and be directly cast into the body without departing from the scope and content of the presently disclosed technology. These weighting members 1624 and 1626 may also be made out of a tungsten type material having a total weight of 20-23 grams to further improve the performance of the golf club head 1600 without departing from the scope and content of the presently disclosed technology.

Figure 20:
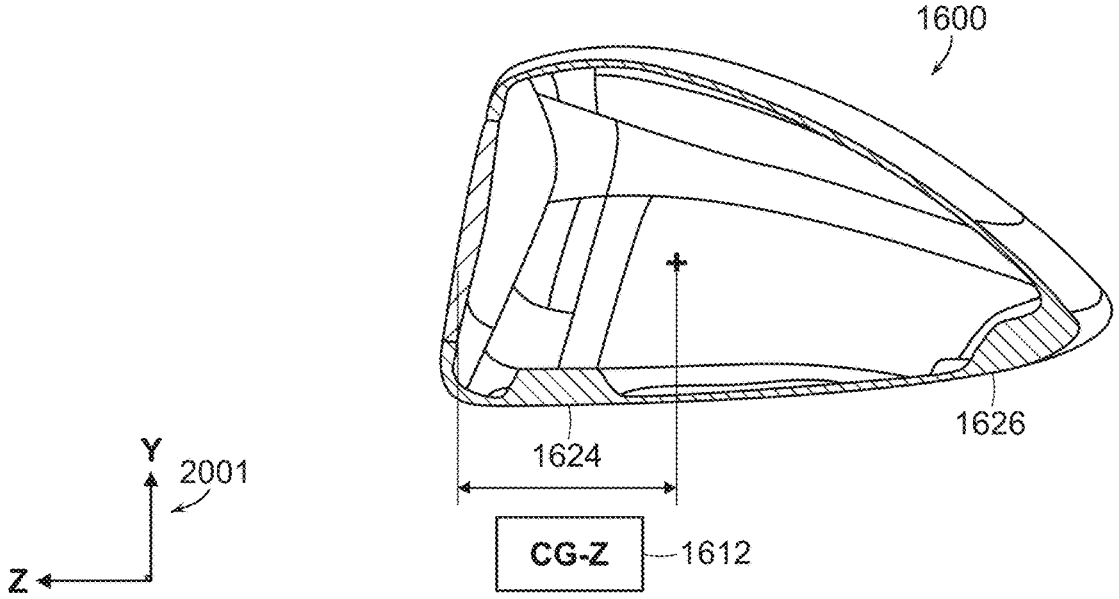
FIG. 20 of the accompanying drawings shows a vertical cross-sectional view of a golf club head in accordance with an alternative embodiment of the presently disclosed technology.
Figure 21:
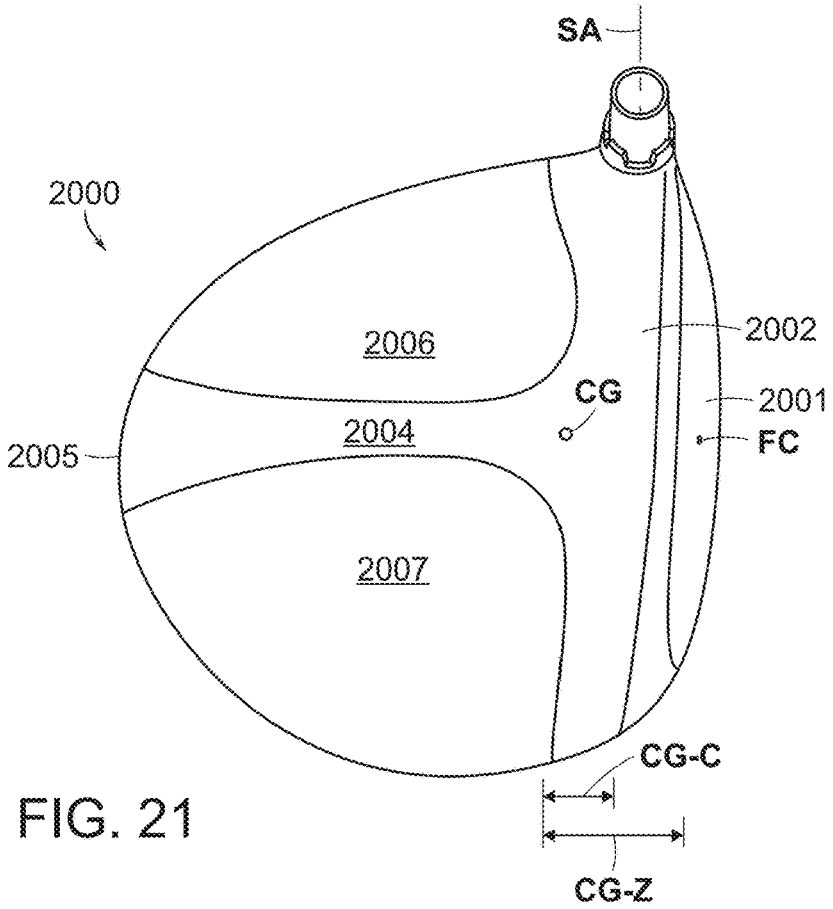
FIG. 21 of the accompanying drawings shows a top view of a golf club head in accordance with an alternative embodiment of the presently disclosed technology.

FIG. 20 of the accompanying drawings provides another cross-sectional cut open view of the golf club head 1600 in accordance with an alternative embodiment of the presently disclosed technology taken along a vertical plane. Once again, the measurements here are very similar to the discussion previously relating to prior embodiments and the CG-Z 1612 number remain within the same range as the prior discussion. This cross-sectional cut open view of the golf club head 1600 taken along this line allows the profile and geometry of the frontal internal weight 1624 and the rear internal weight 1626 to be shown more clearly and their relationship together with the body portion of the golf club head 1600.

Referring to FIGS. 21-25 the golf club head 2000 has all of the mass and inertial properties discussed above. Further, the golf club head 2000 comprises frontal portion comprising a striking face 2001 having a face center FC, a crown on the upper portion of the golf club head 2000 and a sole on the bottom portion of the golf club head 2000. The golf club head 2000 further comprises a crown return 2002 and a sole return 2003 as part of the frontal portion and a central body member 2004 that are all formed of metal. The central body member 2004 is located near the central portion of the golf club head 2000 in a heel-to-toe orientation, substantially in line along the z-axis as set forth above, and extends from the crown return 2002 and the sole return 2003 to a back edge 2005 of the golf club head. The golf club head 2000 is further comprised of a heel body member 2006 made of a non-metallic material and coupled to a heel side of the central body member 2004 and the crown return 2002 and the sole return 2003. The golf club head 2000 also includes a toe body member 2007 made of a non-metallic material and coupled to a toe side of the central body member 2004 and the crown return 2002 and the sole return 2003. The heel body member 2006 and the toe body member 2007 are essentially taco shell shaped, taco-shaped, in that they form a portion of the crown and a portion of the sole such that they have a c-shaped cross section. In some embodiments, as set forth above, the metal portions can be formed of a standard titanium materials such as TI-6-4, Ti-8-1-1, beta-titanium, and others that have a specific gravity of about 4 g/cc to 5 g/cc. Alternatively, the metal portions can be formed of a standard steel materials that have a specific gravity of about 7 g/cc to 9 g/cc The heel body member 2006 and the toe body member 2007 are formed of a standard composite fiber composite laminate, chopped fiber composite generally referred to as fiber-reinforced plastic (FRP), or a composite material such as those disclosed in U.S. Publication No. 2015-0360094, which is incorporated by reference in its entirety herein. Alternatively, the heel body member 2006 and the toe body member 2007 are formed of structural material having a density of less than 3.0 g/cc such as a thermoplastic material such as those disclosed in U.S. application Ser. No. 16/528,210, filed on Jul. 31, 2019, which is incorporated by reference in its entirety herein, polyetherimide (PEI), polyether ether ketone (PEEK), polyphenylene sulfide (PPS), polysulfone (PSU), polyacryletherketone (PEAK), polyetherketoneketone (PEKK) and polyvinyl chloride (PVC). The heel body member 2006 and the toe body member 2007 are formed by compression molding, injection molding or 3D printing.

The golf club head 2000 further has a center of gravity CG that is located a distance back from the face center, CG-z, a vertical distance up from the ground plane, CG-y, a perpendicular distance from the shaft axis, GC-SA, a horizontal distance from the face center toward the heel side, CG-x and a distance back, parallel to the z-axis, from the shaft axis, CG-C. As stated above, in the presently disclosed technology, the CG-z is generally between about 25 mm to about 40 mm, in some embodiments, between about 26 mm and about 38 mm, and, in some embodiments, between about 27 mm and about 36 mm, all measured rearward from the face center FC along the z-axis shown by the coordinate system above. In addition to the CG-z numbers, an alternative measurement method is provided to measure how far back the CG is located within the club head 2000. In this alternative method, the CG is measured from the shaft axis SA, and this measurement is illustrated as CG-C is generally measured to be between about 10 mm to about 30 mm, in some embodiments, 10 mm to 25 mm, in some embodiments, between about 12 mm to about 28 mm, and, in some embodiments, 12 mm to 23 mm, and in some embodiments, between about 14 mm to about 21 mm, all measured rearward from the shaft axis SA along the z-axis direction shown by the coordinate system above.

As stated above, it is important that the strategic location of the CG rearward along the z-axis be correct, irrespective of whether it is measured from the face center FC or the shaft axis SA, for the proper functionality of the current inventive golf club head 2000. If the CG location is too far forward, the golf club head 2000 can have a low MOI-X and MOI-Y and low backspin when contacting a golf ball. However, in the alternative, if the CG location is too far rearward, the golf club head 2000 can produce too much spin to yield desirable results. Hence, the CG location rearward along the z-axis is important for the performance of the golf club head 2000.

Figure 22:
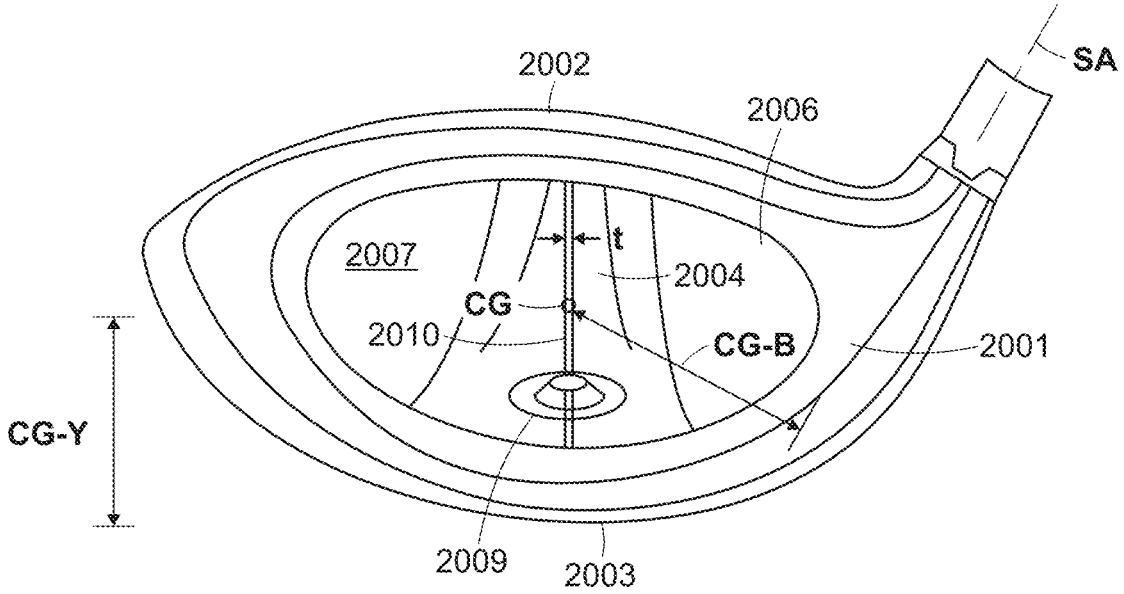
FIG. 22 of the accompanying drawings shows a frontal view of a golf club head in accordance with an alternative embodiment of the presently disclosed technology.

FIG. 22 of the accompanying drawings shows another important CG measurement that is important to the proper functionality of the presently disclosed technology. More specifically, FIG. 22, in addition to illustrating all of the components of the golf club head 2000 as previously discussed, shows another measurement of the CG location from the shaft axis SA along an x-y plane. More specifically, FIG. 22 shows a CG measurement that is perpendicular to the shaft axis SA along this x-y plane, called CG-B for the purpose of this application. The CG-B of the golf club head 2000 may generally be between about 32 mm and about 39 mm, in some embodiments, between about 33 mm and about 38 mm, and, in some embodiments, about 35 mm.

As shown in FIG. 22, the golf club head 2000 can further include a central support member 2010 such as wall member 2010 that is coupled to a crown portion of the central body member 2004 and a sole portion of the central body member 2004. The wall member 2010 has a thickness t that is between 0.2 mm and 5 mm, and in some embodiments, between about 0.4 mm and 2 mm.

Figure 23:
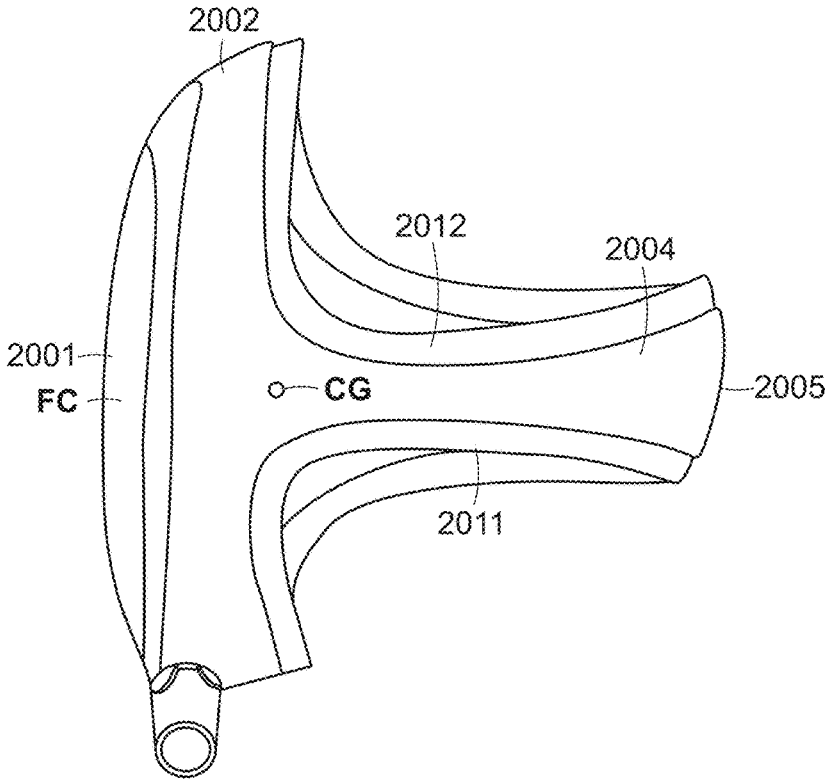
FIG. 23 of the accompanying drawings shows a top view of a body portion of the golf club head in accordance with an alternative embodiment of the presently disclosed technology shown in FIG. 21.

As shown in FIG. 23, the central body member 2004 has a heel side circumferential attachment edge 2011 and a toe side circumferential attachment edge 2012 for coupling the heel body member 2006 and the toe body member 2007, respectively, to the central body member 2004 and the crown return 2002 and the sole return 2003. The heel side circumferential attachment edge 2011 and the toe side circumferential attachment edge 2012 extend from approximate the crown return 2002 and the sole return 2003 to a back edge 2005 of the golf club head 2000.

Figure 24:
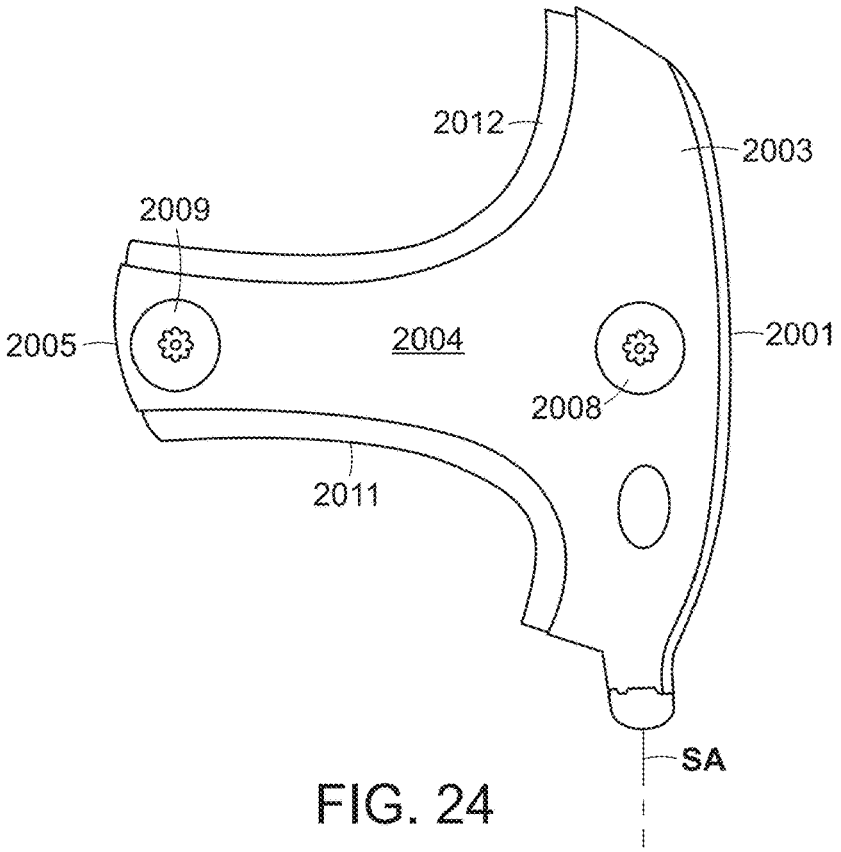
FIG. 24 of the accompanying drawings shows a bottom view of a body portion of the golf club head in accordance with an alternative embodiment of the presently disclosed technology shown in FIG. 21.

As shown in FIG. 24, the golf club head 2000 can further include at least one weight member 2008 or 2009, and in some embodiments, includes two weight members 2008 and 2009. The first weight member 2008 is located on the sole portion of the club head, forward near the striking face 2001 and the second weight member 2009 is located on the sole portion of the club head, aft near the back edge 2005. At least one of the weight members 2008 and 2009 may generally have a material density of greater than 13 g/cc, and, in some embodiments, greater than about 15 g/cc. The weight members 2008 and 2009 have a mass of between about 0 grams and 50 grams, in some embodiments, between about 3 grams and 35 grams and, in some embodiments, between 5 grams and 25 grams. In one embodiment, the first weight member 2008 has a mass of at least two times the mass of the second weight member 2009. In another embodiment, the first weight member 2008 has a mass of less than half the mass of the second weight member 2009. In some embodiments, the weight members 2008 and 2009 are interchangeable so that the CG can be adjusted forward and rearward to control the club head's launch and spin characteristics. Furthermore, the center of the first weight member 2008 is located less than 30 mm from the striking face 2001 along the z-axis and the center of the second weight member 2009 is located less than 20 mm from the back edge 2005 along the z-axis such that the interchangeable weights can have a maximum effect on the spin and launch characteristics of the club head.

Figure 25:
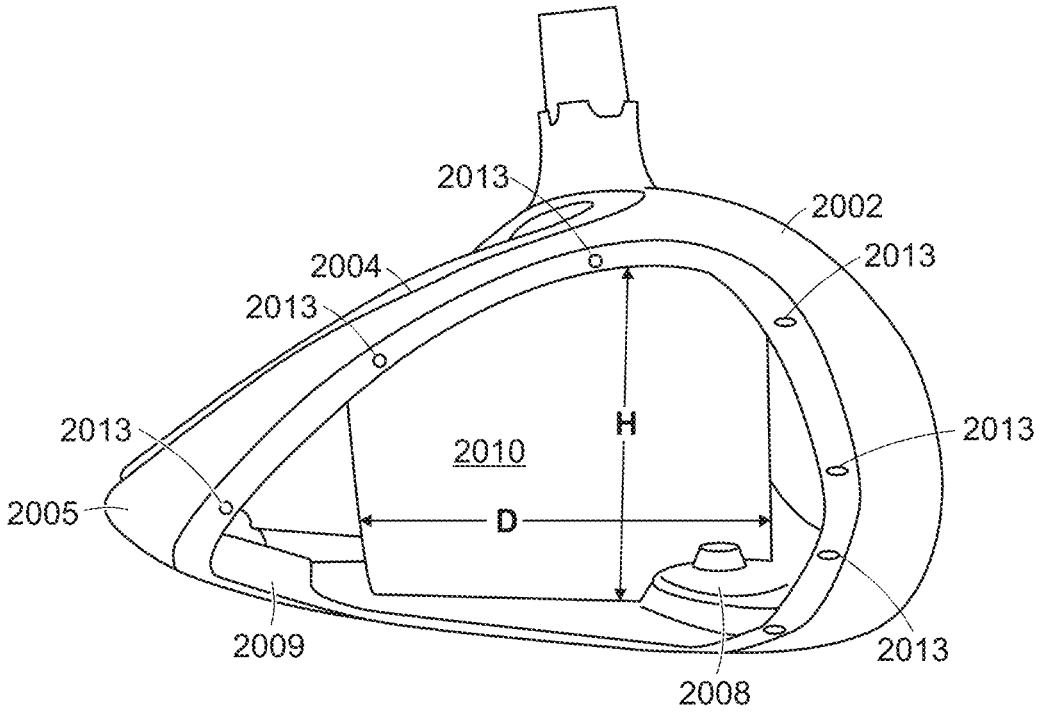
FIG. 25 of the accompanying drawings shows a vertical side view of a body portion of a golf club head in accordance with an alternative embodiment of the presently disclosed technology.

In one embodiment of the presently disclosed technology and as shown in FIG. 25, the central support member or wall member 2010 is coupled to a crown portion of the central body member 2004 and a sole portion of the central body member 2004 and extends between the first and second weight members 2008 and 2009. The central support member 2010 has a maximum height H parallel to the y-axis and a maximum depth D parallel to the z-axis. The depth D is greater than the maximum height H. Also shown in FIG. 25, the heel side circumferential attachment edge 2011 and the toe side circumferential attachment edge 2012 for coupling the heel body member 2006 and the toe body member 2007 to the central body member 2004 can include a plurality of recesses or apertures 2013 that adhesive can enter into and better lock the components together. Alternatively, the heel side circumferential attachment edge 2011 and the toe side circumferential attachment edge 2012 may have a plurality of protrusions on the outer surface to create a gap between the heel body member 2006 and the toe body member 2007 to the central body member 2004 such that an adhesive can fill the gap and create a stronger bond therebetween.

Figure 26:
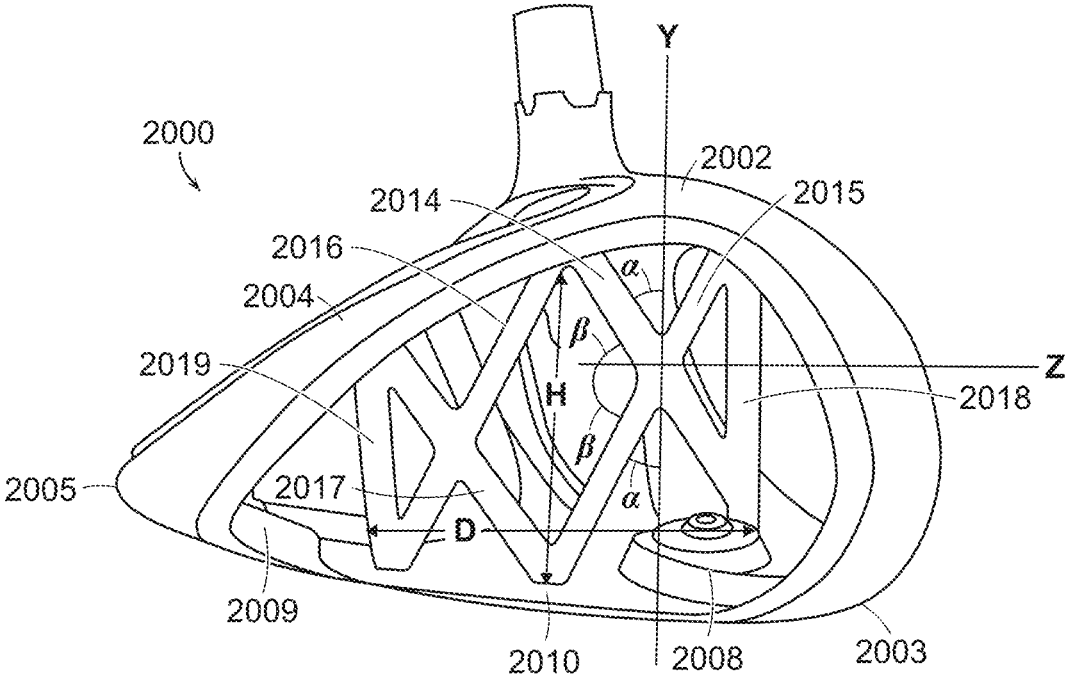
FIG. 26 of the accompanying drawings shows a vertical side view of a body portion of a golf club head in accordance with an alternative embodiment of the presently disclosed technology.

In another embodiment of the presently disclosed technology as shown in FIG. 26, the golf club head's central support member 2010 can be comprised of a plurality of strut members 2014, 2015, 2016, 2017, 2018 and 2019 that extend form the crown to the sole of the central body member 2004 between the two weight members 2008 and 2009. Again, the central support member 2010 has a maximum height H parallel to the y-axis and a maximum depth D parallel to the z-axis. The depth D is greater than the maximum height H. In some embodiments, a first angled strut member 2014 extends from a crown portion of the central body member 2004 to the sole and a second angled strut member 2015 extends from a sole portion of the central body member 2004 to the crown, and the first and second angled strut members 2014 and 2015 cross each other. In some embodiments, the first and second angled strut members 2014 and 2015 extend at an angle $\alpha$ of between 15 degrees and 75 degrees from the y-axis and an angle $\beta$ of between 15 degrees and 75 degrees from the z-axis. in some embodiments, the first and second angled strut members 2014 and 2015 extend at an angle $\alpha$ of between 15 degrees and 45 degrees from the y-axis and an angle $\beta$ of between 45 degrees and 75 degrees from the z-axis. The golf club head 2000 can further comprise a third angled strut member 2016 that extends from a crown portion of the central body member 2004 to the sole and a fourth angled strut member 2017 that extends from a sole portion of the central body member 2004 to the crown, and the third and fourth angled strut members cross each other. The third and fourth angled strut members also extend at angles $\alpha$ and $\beta$ of between 15 degrees and 75 degrees from both the y-axis and the z-axis respectively. in some embodiments, the third angled strut member 2016 is coupled to the first angled strut member 2014 at the crown and the fourth angled strut member 2017 is coupled to the second angled strut member 2015 at the sole. Furthermore, the third angled strut member 2016 is substantially parallel to the second angled strut member 2015 and the fourth angled strut member 2017 is substantially parallel to the first angled strut member 2014. The golf club head 2000 can further comprise a vertical strut member 2018 extending vertically, substantially parallel to the y-axis, between the first angled strut member 2014 and the second angled strut member 2015 approximate the first weight member 2008. in some embodiments, the golf club head 2000 can further comprise a second vertical strut member 2019 extending vertically, substantially parallel to the y-axis, between the fourth angled strut member 2017 and the third angled strut member 2016 adjacent to the second weight member 2009.

The advantage of the central support member 2010, either in the form of the wall member 2010 or the angled strut members 2014, 2015, 2016 and 2017 is that it prevents the crown portion of the central body member 2004 from deflecting relative to the sole portion of the central body member 2004 in the y-axis and also prevents the portions from shearing with respect to each other in the z-axis.

The advantage of multiple weight members 2008 and 2009 is that the weight members can have equal mass, for example between 10 and 15 grams each, such that the CG of the club head 2000 is in a neutral position. However, the weight members 2008 and 2009 can also be comprised of a heavy weight, for example greater than 15 grams, and a light weight, for example less than 10 grams, such that the CG can be moved forward or back depending on the placement of the weights. With the heavy weight located in the aft weight member 2009, the MOI-Y is increased and is greater than about 450 kg-mm$^2$. Thus, in golf club head 2000, the MOI-Y is greater than or equal to approximately 2 times the MOI-Z. Conversely, when the heavy weight is in the forward weight member 2008, the CG-C can be significantly decreased. For example, a golf club head 2000 can have a GC-C of between 14 mm to 21 mm.

The advantages of the club head 2000 discussed above can also apply to fairway woods and hybrids. In those embodiments, it is understood that the numerical values for the club properties will be lower and the metal will be generally steels and high strength steels known in the art. However, the construction of the golf club head 2000 can be easily applied to these smaller heads.

Figure 27:
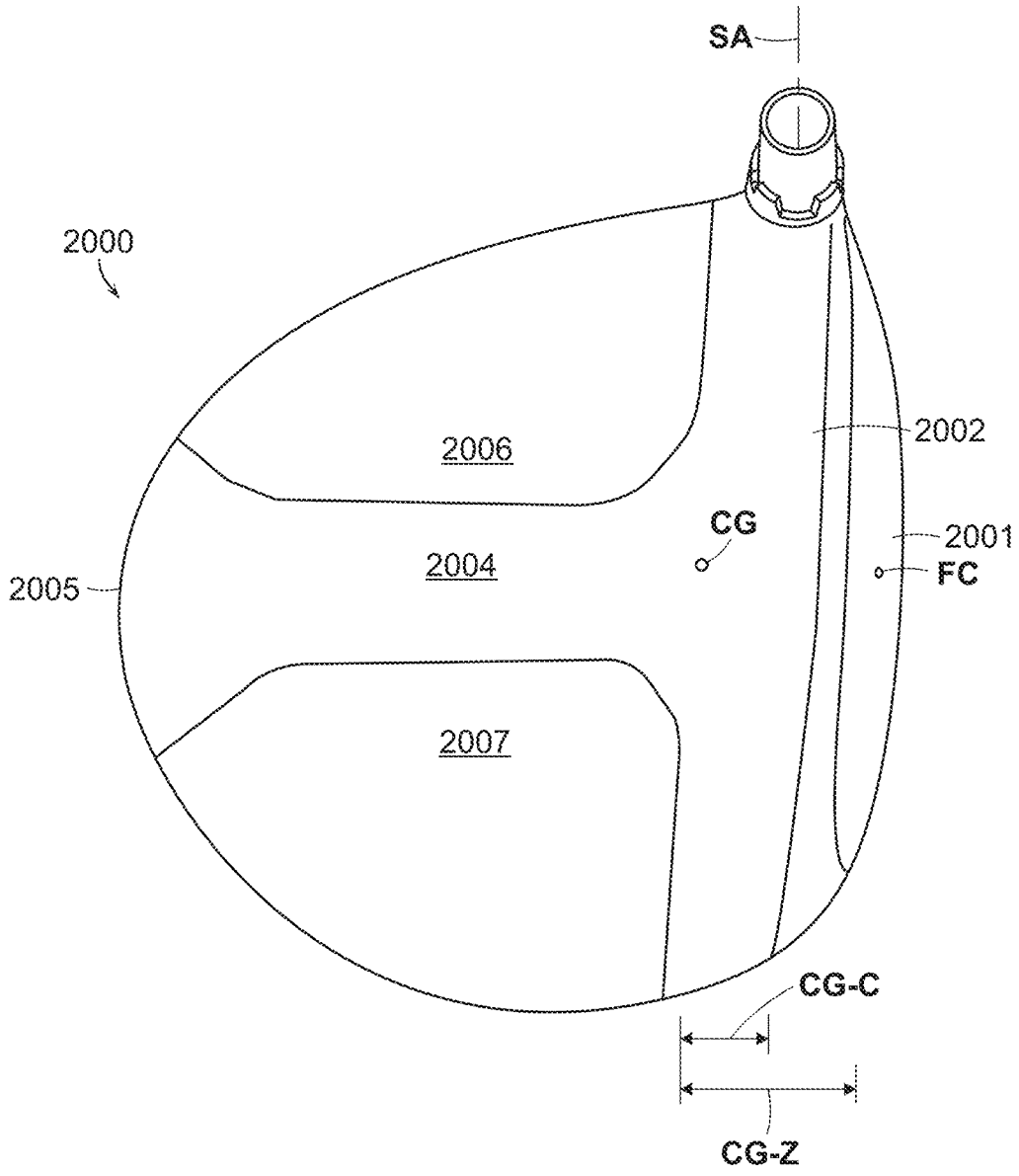
FIG. 27 of the accompanying drawings shows a top view of a golf club head in accordance with an alternative embodiment of the presently disclosed technology.
Figure 28:
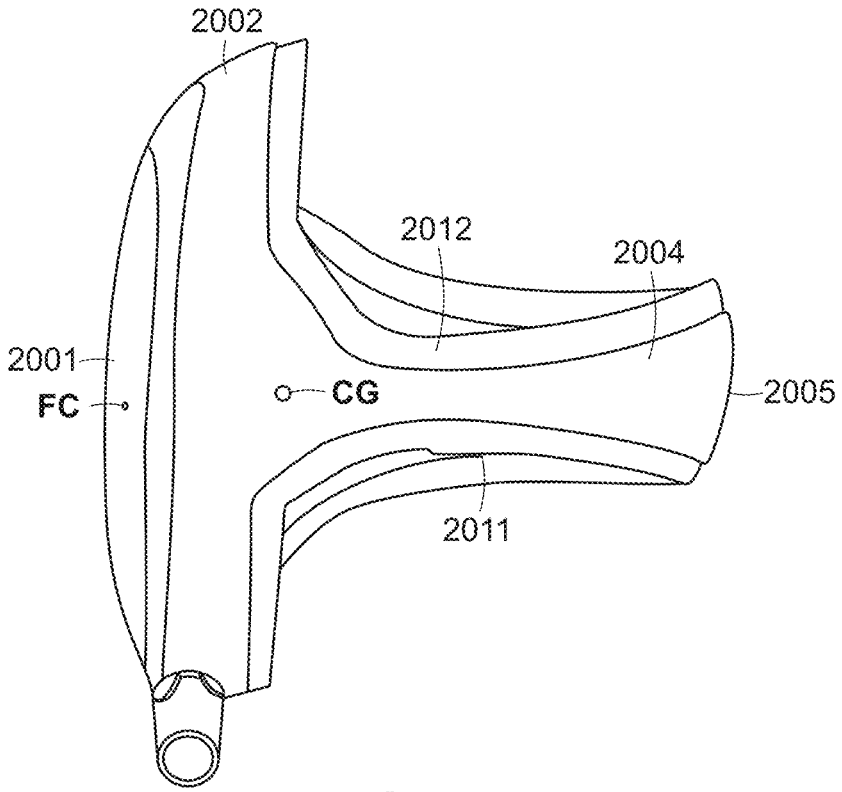
FIG. 28 of the accompanying drawings shows a top view of a body portion of the golf club head in accordance with an alternative embodiment of the presently disclosed technology shown in FIG. 27.
Figure 29:
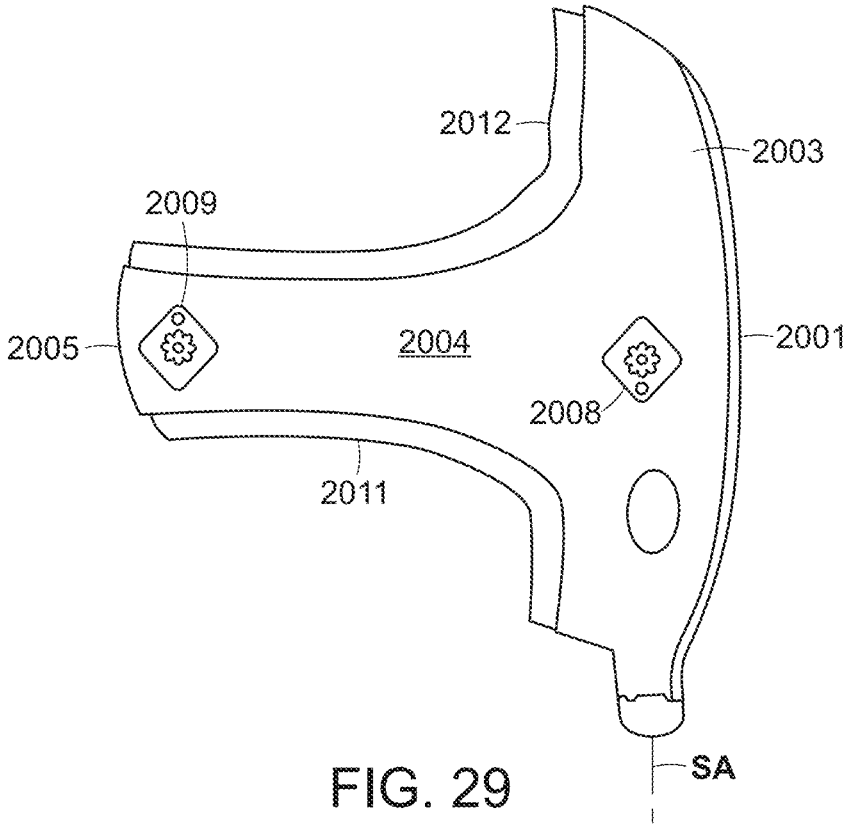
FIG. 29 of the accompanying drawings shows a bottom view of a body portion of the golf club head in accordance with an alternative embodiment of the presently disclosed technology shown in FIG. 27.
Figure 30:
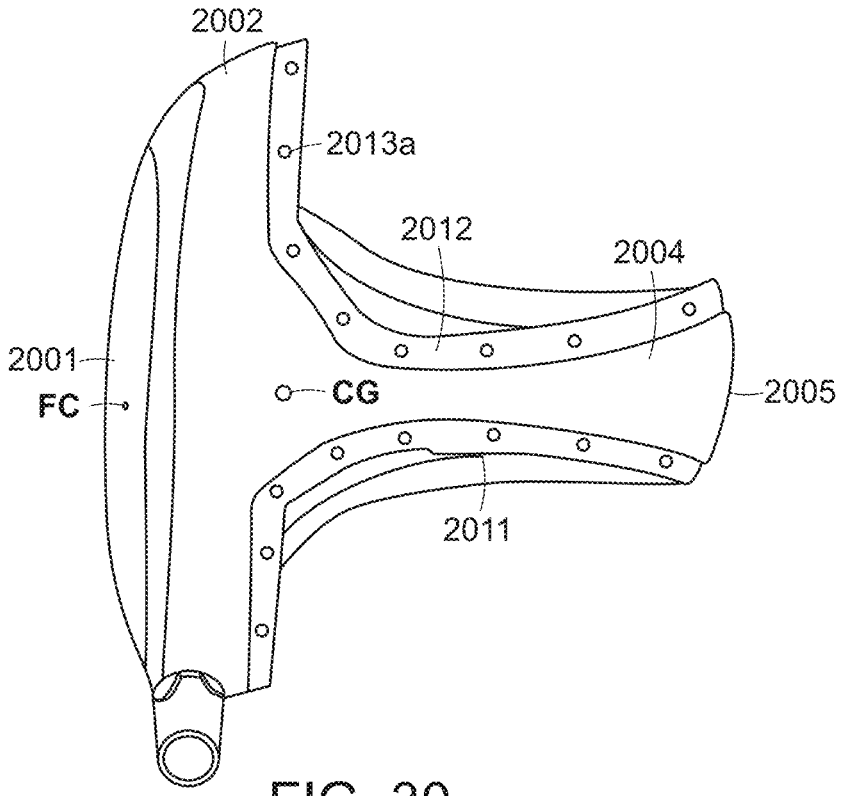
FIG. 30 of the accompanying drawings shows a top view of a body portion of the golf club head in accordance with an alternative embodiment of the presently disclosed technology shown in FIG. 27.

Referring to FIGS. 27-29 the golf club head 2000 has all of the mass and inertial properties discussed above. Further, the golf club head 2000 comprises frontal portion comprising a variable thickness striking face 2001 having a maximum thickness at the face center FC, a crown on the upper portion of the golf club head 2000 and a sole on the bottom portion of the golf club head 2000. The golf club head 2000 further comprises a crown return 2002 and a sole return 2003 adjacent the striking face 2001 as discussed above and a central body member 2004 that are all formed of metal. The central body member 2004 is located near the central portion of the golf club head 2000 in a heel-to-toe orientation, substantially in line along the z-axis as set forth above, and extends from the crown return 2002 and the sole return 2003 to a back edge 2005 of the golf club head 2000. As discussed above, the golf club head 2000 is further comprised of a heel body member 2006 made of a non-metallic material and coupled to a heel side of the central body member 2004 along the heel edge 2011 and a toe body member 2007 made of a non-metallic material is coupled to a toe side of the central body member 2004 along the toe edge 2012. The central body member 2004 can include a plurality of protrusions 2013*a* that create an adhesive filled gap and better lock the components together. The heel body member 2006 and the toe body member 2007 are essentially taco shell shaped, taco-shaped, in that they form a portion of the crown and a portion of the sole such that they have a c-shaped cross section. In some embodiments, as set forth above, the metal portions can be formed of a standard titanium materials such as TI-6-4, Ti-8-1-1, beta-titanium, and others that have a specific gravity of about 4 g/cc to 5 g/cc. The heel body member 2006 and the toe body member 2007 are formed of a standard composite fiber composite laminate, chopped fiber composite generally referred to as fiber-reinforced plastic (FRP), or a composite material such as those disclosed in U.S. Publication No. 2015-0360094, which is incorporated by reference in its entirety herein. Alternatively, the heel body member 2006 and the toe body member 2007 are formed of a thermoplastic material such as those disclosed in U.S. application Ser. No. 16/528,210, filed on Jul. 31, 2019, which is incorporated by reference in its entirety herein, polyetherimide (PEI), polyether ether ketone (PEEK), polyphenylene sulfide (PPS), polysulfone (PSU), polyacryletherketone (PEAK), polyetherketoneketone (PEKK) and polyvinyl chloride (PVC). The heel body member 2006 and the toe body member 2007 are formed by compression molding, injection molding or 3D printing.

In some embodiments, the heel body member 2006 and the toe body member 2007 are formed from a high crystallinity PPS, that is a PPS in which the crystallinity is greater than 40%, and, in some embodiments, greater than about 50% as measured using differential scanning calorimetry (DSC) at a heating rate of 20° C./min. The crystallinity percentage can be calculated using the following equation:

$$\%\ \text{crystallinty}=\Delta H_{sample}/\Delta H_{reference}\times 100$$

where: $\Delta H_{sample}$ is the sample melting enthalpy with unknown crystallinity percentage and $\Delta H_{reference}$ is the sample melting enthalpy with the known crystallinity. For PPS, 76.5 J/g may be utilized as the $\Delta H_{reference}$.

In order to increase the crystallinity level in PPS, it is recommended that the material be injection molded into molds that are at a temperature of greater than 115° C. and more particularly in a mold that is between about 125° C. and 135° C. In some embodiments, the PPS crystallinity is between about 50% and 70%. The material has a uniform thickness of about 0.5 mm to about 2 mm. However, in one embodiment, the toe body member 2007 has a thickness that is less than the thickness of the heel body member 2006. In another embodiment, the toe body member 2007 and the heel body member 2006 vary such that they are thinnest on the crown portion and thicker on the sole portion. In this embodiment, the crown portions of the toe body member 2007 and the heel body member 2006 have a thickness that is between about 0.5 mm and 1 mm and the sole portions of the toe body member 2007 and the heel body member 2006 are between about 1 mm and 2 mm thick.

The golf club head 2000 further has a center of gravity CG that is located a distance back from the face center, CG-z, a vertical distance up from the ground plane, CG-y, a perpendicular distance from the shaft axis, GC-SA, a horizontal distance from the face center toward the heel side, CG-x and a distance back, parallel to the z-axis, from the shaft axis, CG-C. As stated above, in the presently disclosed technology, the CG-z is generally between about 25 mm to about 40 mm, in some embodiments, between about 26 mm and about 38 mm, and, in some embodiments, between about 27 mm and about 36 mm, all measured rearward from the face center FC along the z-axis shown by the coordinate system above. In addition to the CG-z numbers, an alternative measurement method is provided to measure how far back the CG is located within the club head 2000. In this alternative method, the CG is measured from the shaft axis SA, and this measurement is illustrated as CG-C is generally measured to be between about 10 mm to about 25 mm, in some embodiments, between about 12 mm to about 23 mm, and, in some embodiments, between about 14 mm to about 21 mm, all measured rearward from the shaft axis SA along the z-axis shown by the coordinate system above.

As stated above, it is important that the strategic location of the CG location rearward along the z-axis be correct, irrespective of whether it is measured from the face center FC or the shaft axis SA, for the proper functionality of the current inventive golf club head 2000. If the CG location is too far forward, the golf club head 2000 can have a low MOI-X and MOI-Y and low backspin when contacting a golf ball. However, in the alternative, if the CG location is too far rearward, the golf club head 2000 can produce too much spin to yield desirable results. Hence, the CG location rearward along the z-axis is important for the performance of the golf club head 2000.

Figure 31:
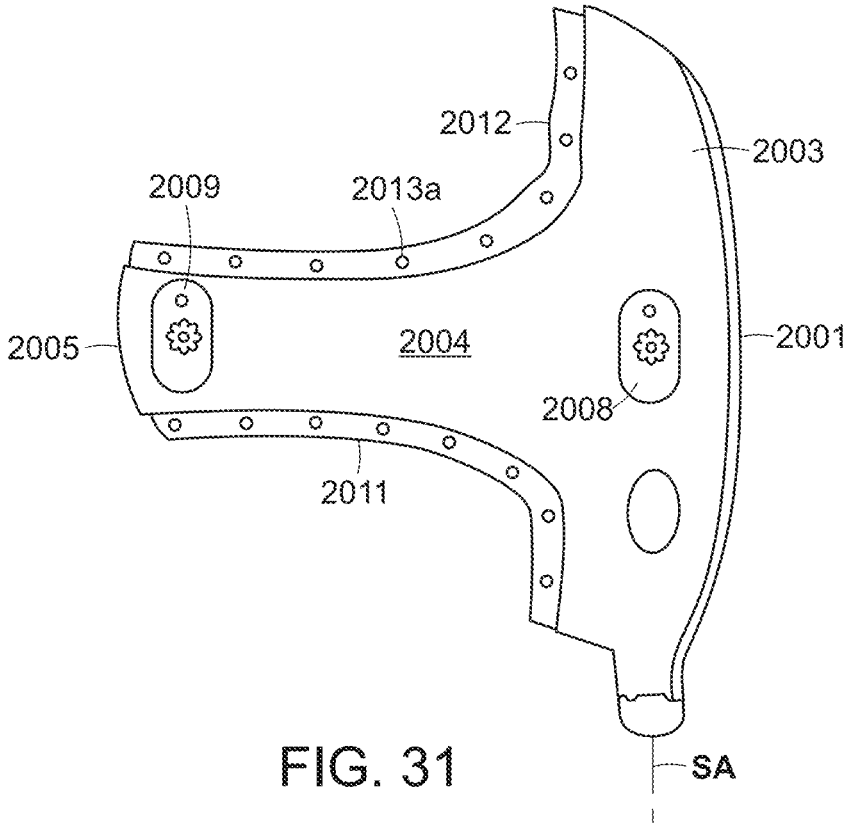
FIG. 31 of the accompanying drawings shows a bottom view of a body portion of the golf club head in accordance with an alternative embodiment of the presently disclosed technology.

As shown in FIGS. 29 and 31, the weight member 2008 has less mass than weight member 2009 and is made from steel (or at least a material that has a lower density that the density of weight member 2009). The first weight member 2008 can be located on the forward portion of the sole return 2003, near the striking face 2001 and the second weight member 2009 located on the sole portion of the golf club head 2000, aft near the back edge 2005. At least one of the weight members 2008 and 2009 may generally have a material density of greater than 13 g/cc, in some embodiments, greater than about 15 g/cc, and, in some embodiments, about 17 g/cc. In embodiments, at least one of the weight members 2008 and 2009 may generally have a material density of greater than 2 g/cc and less than about 9 g/cc, and, in some embodiments, between about 4 g/cc and about 8 g/cc. The weight members 2008 and 2009 have a mass of between about 0 grams and 50 grams, and in some embodiments, between about 5 grams and 25 grams. In one embodiment, the first weight member 2008 has a mass of at least two times the mass of the second weight member 2009. In another embodiment, the first weight member 2008 has a mass of less than half the mass of the second weight member 2009. in embodiments, the weight members 2008 and 2009 are the same shape and volume such that they are interchangeable so that the CG of the golf club head 2000 can be adjusted forward and rearward to control the club head's launch and spin characteristics. Furthermore, the center of the first weight member 2008 is located less than 30 mm from the striking face 2001 along the z-axis direction and the center of the second weight member 2009 is located less than 20 mm from the back edge 2005 along the z-axis direction such that the interchangeable weights can have a maximum effect on the spin and launch characteristics of the club head. in embodiments, the center of the first weight member 2008 is located less than 25 mm from the striking face 2001 along the z-axis direction and the center of the second weight member 2009 is located less than 20 mm from the back edge 2005 along the z-axis direction.

Figure 32:
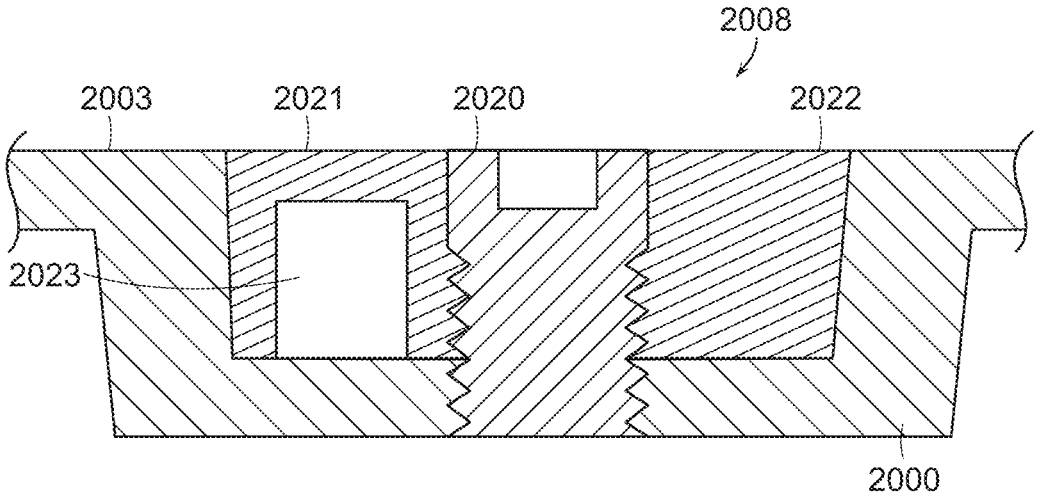
FIG. 32 of the accompanying drawings shows a cross-sectional view of a first weight member shown in FIG. 31.

As shown in FIG. 32, the first weight member 2008 is releasably coupled to the sole return 2003 portion of the golf club head 2000 by a fastener 2020. The first weight member 2008 may generally have a material density of greater than 4 g/cc, in some embodiments, greater than about 7 g/cc, and, in some embodiments, between about 7 g/cc and 8 g/cc. The first weight member has a light side 2021 and a heavy side 2022. The heavy side 2022 is substantially solid and as shown in FIGS. 29 and 31 is the side identified with indicia such as with a dot. In embodiments, the first weight member 2008 has a hollow portion 2023 that forms the light side 2021 of the weight member 2008.

Figure 33:
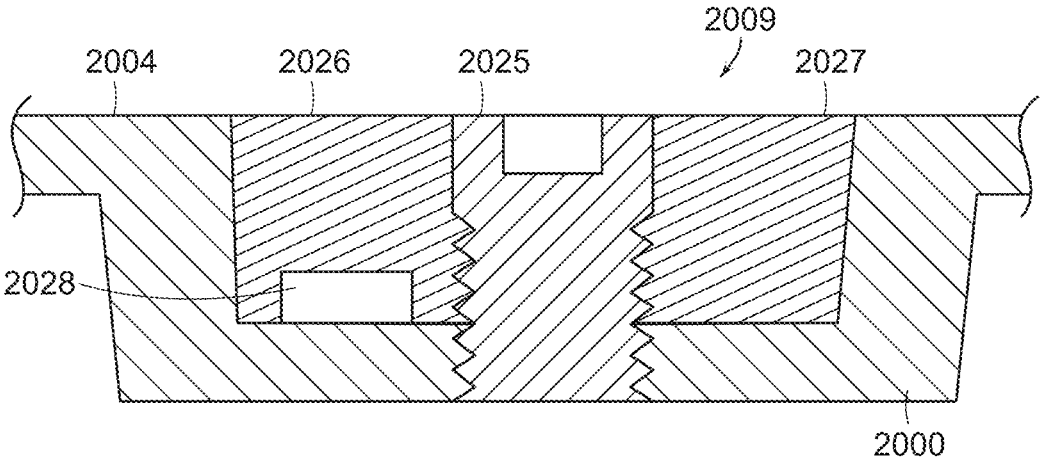
FIG. 33 of the accompanying drawings shows a cross-sectional view of a second weight member shown in FIG. 31.

As shown in FIGS. 33, the second weight member 2009 is also releasably coupled to the sole portion of the central body member 2004 portion of the golf club head 2000 by a fastener 2025. The second weight member 2009 may generally have a material density of greater than 13 g/cc, in some embodiments, greater than about 15 g/cc, and, in some embodiments, greater than or equal to about 17 g/cc. The second weight member 2009 has a light side 2026 and a heavy side 2027. The heavy side 2027 is substantially solid and as shown in FIGS. 29 and 31 is the side identified with indicia such as with a dot. In embodiments, the weight member 2009 has a hollow portion 2028 that forms the light side 2026 of the second weight member 2009.

In embodiments, at least one or both of the weight members 2008 or 2009 are comprised of a light side 2021 and 2026 that includes a hollow portion 2023 and 2028 and a heavy side 2022 and 2027 that is substantially solid or is solid enough that the mass on the heavy side is greater than the mass on the light side. Alternatively, at least one or both of the weight members 2008 or 2009 are comprised of a light side 2021 and 2026 that includes a hollow portion 2023 and 2028 that can be filled with a material having a density of less than 4 g/cc and a heavy side 2022 and 2027 that is a hollow portion that is filled with a material having a density of greater than about 7 g/cc and in some embodiments, greater than or equal to about 15 g/cc. As shown in FIGS. 29 and 31, the weight member 2008 has less mass than weight member 2009 and is made from steel (or at least a material that has a lower density that the density of weight member 2009). In some embodiments, the first weight member 2008 has a mass of about 7 g and 14 g and the second weight member has a mass of between about 15 g and 22 g. In embodiments, the first weight member 2008 and the second weight member 2009 can be interchanged in the front and aft locations as shown in FIGS. 29 and 31 to move the CG-C by approximately 1 mm to 5 mm and in some embodiments, by about 2.5 mm to 3.5 mm. In embodiments, the CG-C can be between about 14 mm and 21 mm when the first weight member 2008 is in the aft location adjacent the back edge 2005 and the CG-C can be between about 22 mm and 30 mm when the first weight member 2008 is in the forward position adjacent the striking face 2001. Further, the first weight member 2008 and the second weight member 2009 have approximately the same difference in mass between the light sides 2021 and 2026 and the heavy sides 2022 and 2027. In embodiments, the difference in mass between the light sides 2021 and 2026 and the heavy sides 2022 and 2027 is between about 4 g and 8 g. Thus, if one of the weight members has the heavy side toward the heel in the x-axis direction and the other has the heavy side toward the toe in the x-axis direction, the CG of the golf club head 2000 can be neutral in the x-axis direction as shown in FIG. 29. However, if the weight members have both of their heavy sides 2022 and 2027 toward the toe or the heel in in the x-axis direction, the CG can be moved away from the neutral position along the x-axis direction toward the toe or heel, respectively. in embodiments, the golf club head CG can be moved at least 0.5 mm toward the toe or the heel from the neutral location and in some embodiments, between about 0.7 mm and 1.5 mm. As shown in FIG. 31, both the first weight member 2008 and the second weight member 2009 have the heavy sides 2022 and 2027 toward the toe in the x-axis direction such that the golf club head CG is moved toward the toe by about 1 mm from the neutral position GC-n. These weight members can both be rotated about the fastener such that the CG is moved toward the heel by about 1 mm from the neutral position CG-n and 2 mm from the far toe CG position as shown in FIG. 31.

Figure 34:
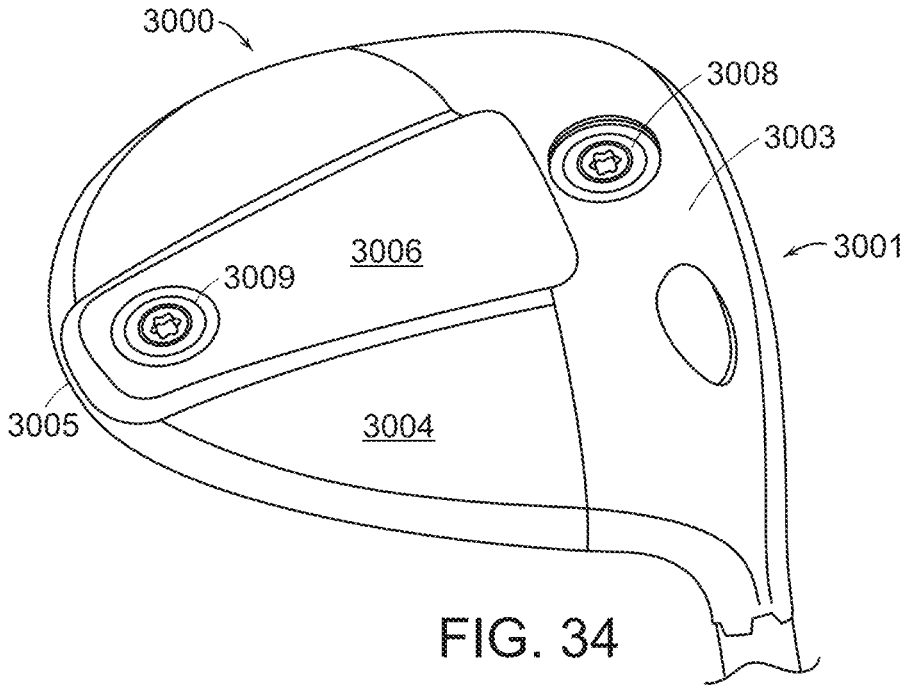
FIG. 34 of the accompanying drawings shows a bottom perspective view of another embodiment of a golf club head in accordance with the presently disclosed technology.

FIGS. 34 through 37 show different perspective and cross-sectional views of golf club heads and their internal components that are used to achieve the performance characteristics described above. FIG. 34 shows a perspective view of an exemplary design of a golf club head 3000 that capable of achieving the performance characteristics previously discussed with respect to the embodiments in FIGS. 1-3 and 13-15 in particular. The golf club head 3000 is comprised of the essential components previously discussed in FIGS. 1 and 13 in terms of a frontal portion having a striking face 3001, a crown return 3002 and a sole return 3003 and a rear portion 3004 comprised of an aft body. In order to achieve the performance numbers above of a higher MOI-Y, a higher MOI-X, and a lower MOI-Z, a significant amount of mass is allocated towards the center of the golf club head away from the perimeter. In order to achieve this, the presently disclosed technology utilizes two weighting members that are comprised of high density materials that have a higher density than the frontal portion 3001, 3002 and 3003 and the rear portion 3004. In embodiments, as set forth above, the frontal portion 3001, 3002 and 3003 can be formed of a standard titanium material such as TI-6-4, Ti-8-1-1, beta-titanium, and others that have a density of about 4 g/cc to 5 g/cc. The rear portion 3004 is formed of a standard composite fiber composite laminate, chopped fiber composite generally referred to as fiber-reinforced plastic (FRP), or a composite material such as those disclosed in U.S. Publication No. 2015-0360094, which is incorporated by reference in its entirety herein. Alternatively, the rear portion 3004 is formed of structural material having a density of less than 3.0 g/cc such as a thermoplastic materials such as those disclosed in U.S. application Ser. No. 16/528,210, filed on Jul. 31, 2019, which is incorporated by reference in its entirety herein, polyetherimide (PEI), polyether ether ketone (PEEK), polyphenylene sulfide (PPS), polysulfone (PSU), polyacryletherketone (PEAK), polyetherketoneketone (PEKK) and polyvinyl chloride (PVC). The rear portion 3004 is formed by compression molding, injection molding or 3D printing. Additionally, the golf club head 3000 includes a sole plate member 3006 secured to an outer surface of the rear portion 3004. In embodiments, the sole plate member 3006 is also formed from standard titanium materials such as TI-6-4, Ti-8-1-1, beta-titanium, and others that have a density of about 4 g/cc to 5 g/cc. In some embodiments, the sole plate member 3006 is formed from stainless steel or similar material having a density of about 7 g/cc to 8 g/cc.

The golf club head 3000 also includes weight members 3008 and 3009. In a first embodiment, the weight members 3008 and 3009 can have equal mass, for example between 10 and 15 grams each, such that the CG of the club head 3000 is in a neutral position along the z-axis direction. However, the weight members 3008 and 3009 can also be comprised of a heavy weight, for example greater than 15 grams, and a light weight, for example less than 10 grams, such that the CG can be moved forward or back along the z-axis direction depending on the placement of the weights. With the heavy weight located in the aft weight member 3009, the MOI-Y is increased and is greater than about 450 kg-mm$^2$. Thus, in a golf club head 3000, the MOI-Y is greater than or equal to approximately 2 times the MOI-Z. Conversely, when the heavy weight is in the forward weight member 3008, the CG-C can be significantly decreased. For example, a golf club head 3000 can have a GC-C of between 14 mm to 21 mm.

Figure 35:
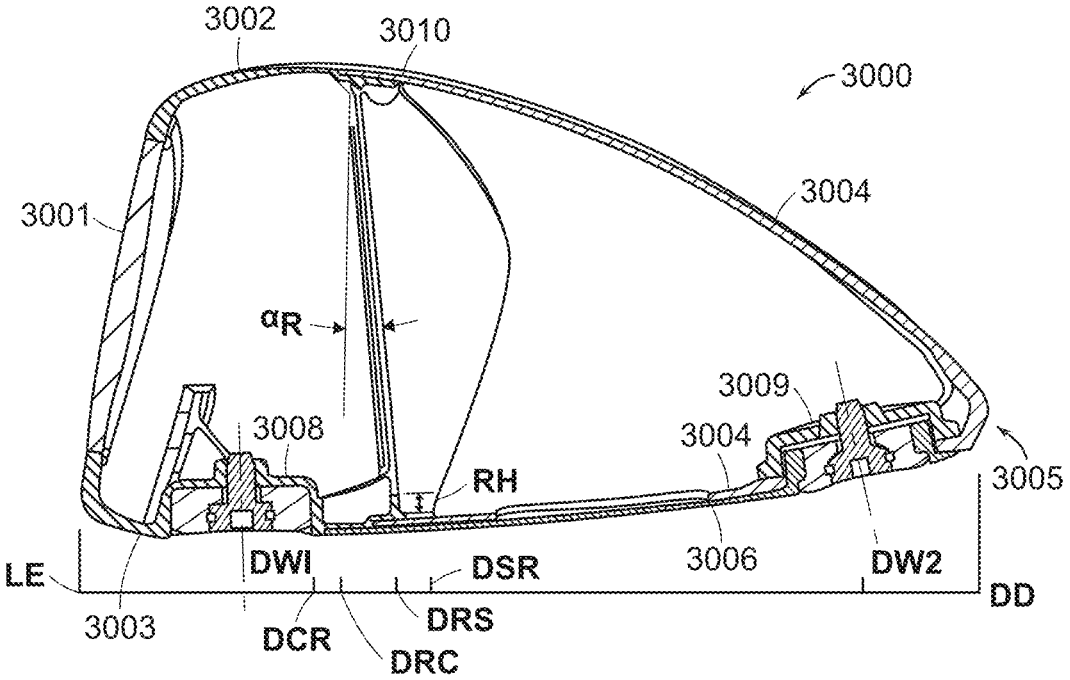
FIG. 35 of the accompanying drawings shows a cross-sectional view of the golf club head in accordance with an alternative embodiment of the presently disclosed technology shown in FIG. 34.

Referring to FIG. 35, the golf club head 3000 further includes an internal rib member 3010 that is located in the frontal portion. The rib member 3010 is located near or at the overlapping juncture of the frontal portion and the rear portion 3004. In some embodiments, the depth DD of the golf club head from the leading edge LE to the back edge 3005 is between 105 mm and 125 mm, and in some embodiments, between about 118 mm and 122 mm. The distance of the crown return DCR from the leading edge to where the crown return 3002 abuts the rear portion 3004 is about 20 mm and 35 mm and in some embodiments, between about 30 mm and 34 mm. The distance of the sole return DSR from the leading edge to where the back end of the sole return 3003 is about 24 mm and 44 mm and in some embodiments, between about 35 mm and 42 mm. The rib member 3010 is therefore located a distance from the leading edge that is between the DCR and the DSR or between 20 mm and 44 mm. In some embodiments, the rib member 3010 is angled such that the distance from the leading edge to the crown portion of the rib member 3010 (at the center of the crown in the heel-to-toe direction, back from the face center) DRC is less than the distance from the leading edge to the sole portion of the rib member 3010 (at the center of the sole in the heel-to-toe direction, back from the face center) DRS. In some embodiments, DRC is between 22 mm and 33 mm and DRS is between 26 mm and 42 mm and is at least 10% greater than DRC. Thus, the rib member 3010 forms an angle $\alpha_R$ that is between about 2° and 10° from the vertical plane at the DRC to a point on the sole at the DRS. The rib member 3010 has a rib height RH (the height of the rib member from the inner surface of the frontal portion) that also varies from the crown center to the sole center and at the heel and toe. In some embodiments, the rib height RH is between about 2 mm and 8 mm and is greatest at the sole center and shortest at the heel and toe. In some embodiments, the rib member 3010 has a rib height RH of about 5 mm at the sole center, 4 mm at the crown center and is 3 mm to 3.5 mm at the heel and toe.

The center of the first weight member 3008 is located a distance DW1 from the leading edge LE of about 15 mm to 25 mm. The center of the second weight member 3009 is located a distance DW2 from the leading edge LE of about 80 mm to 115 mm.

Figure 36:
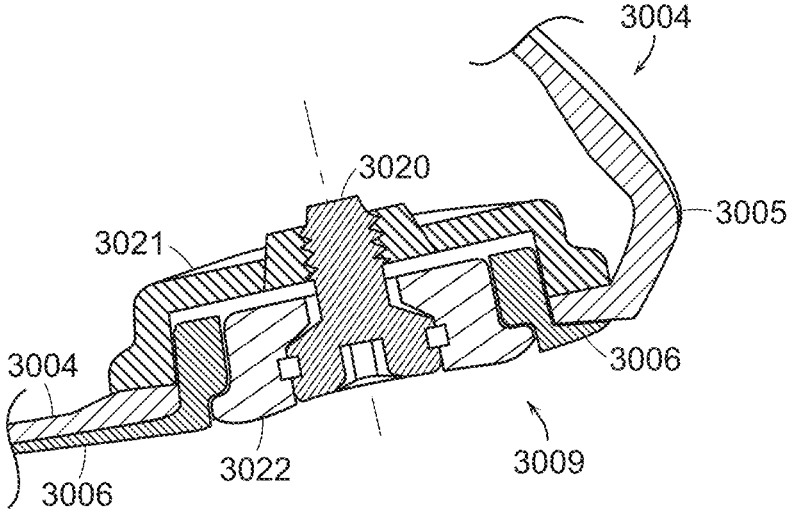
FIG. 36 of the accompanying drawings shows a close-up, cross-sectional view of the golf club head in accordance with an alternative embodiment of the presently disclosed technology shown in FIG. 34.
Figure 37:
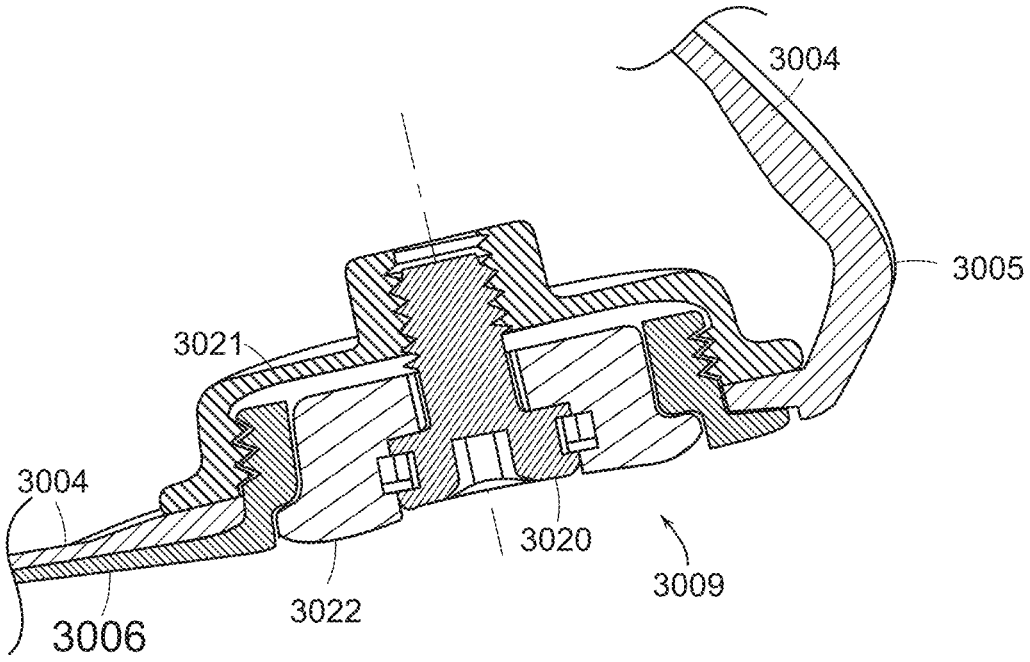
FIG. 37 of the accompanying drawings shows a close-up, cross-sectional view of the golf club head in accordance with an alternative embodiment of the presently disclosed technology shown in FIG. 34.
Figure 38:
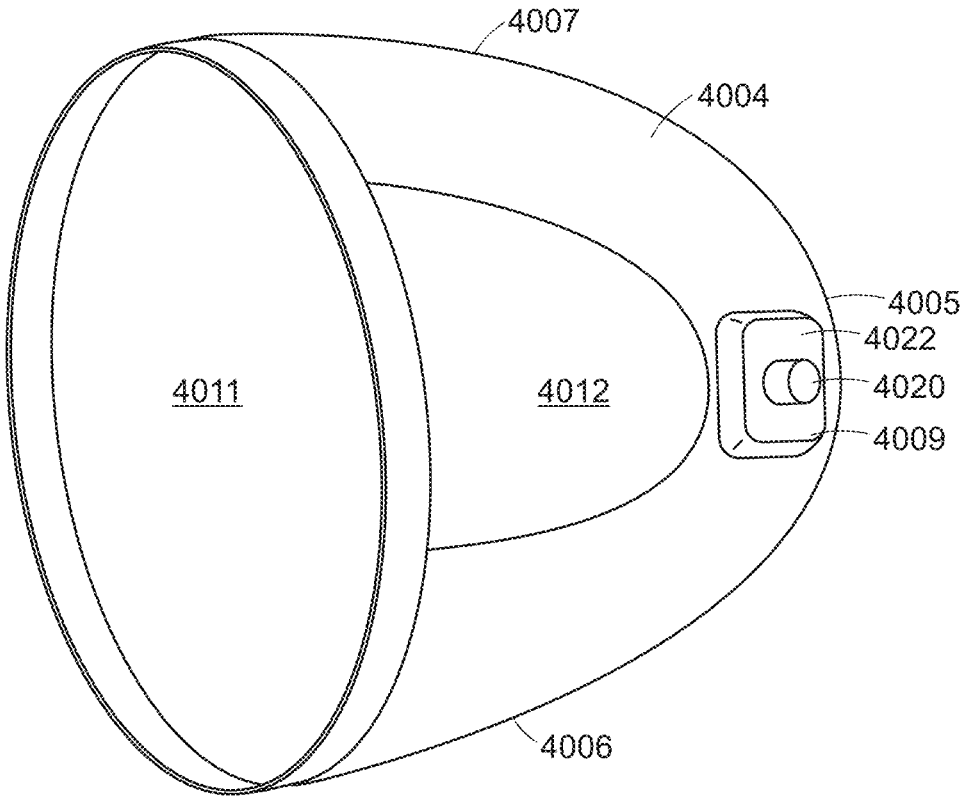
FIG. 38 of the accompanying drawings shows a bottom perspective view of another embodiment of a golf club head rear portion in accordance with the presently disclosed technology.
Figure 39:
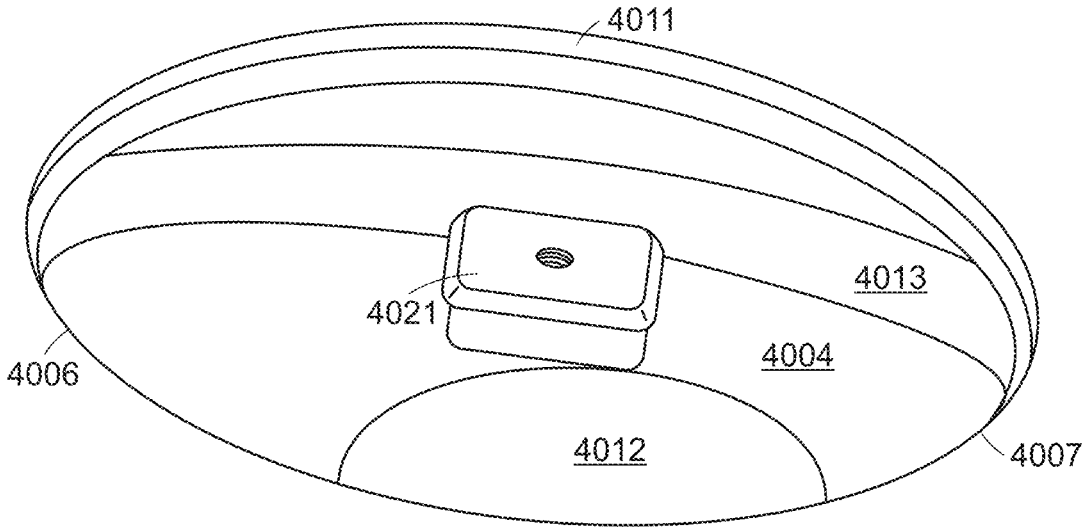
FIG. 39 of the accompanying drawings shows a frontal view of the golf club head rear portion in accordance with an alternative embodiment of the presently disclosed technology shown in FIG. 38.
Figure 40:
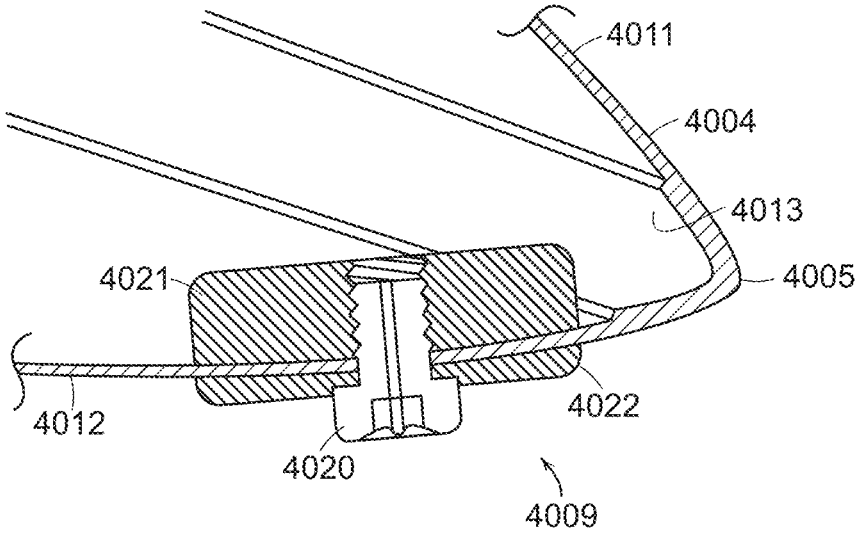
FIG. 40 of the accompanying drawings shows a close-up, cross-sectional view of the golf club head in accordance with an alternative embodiment of the presently disclosed technology shown in FIG. 38.
Figure 41:
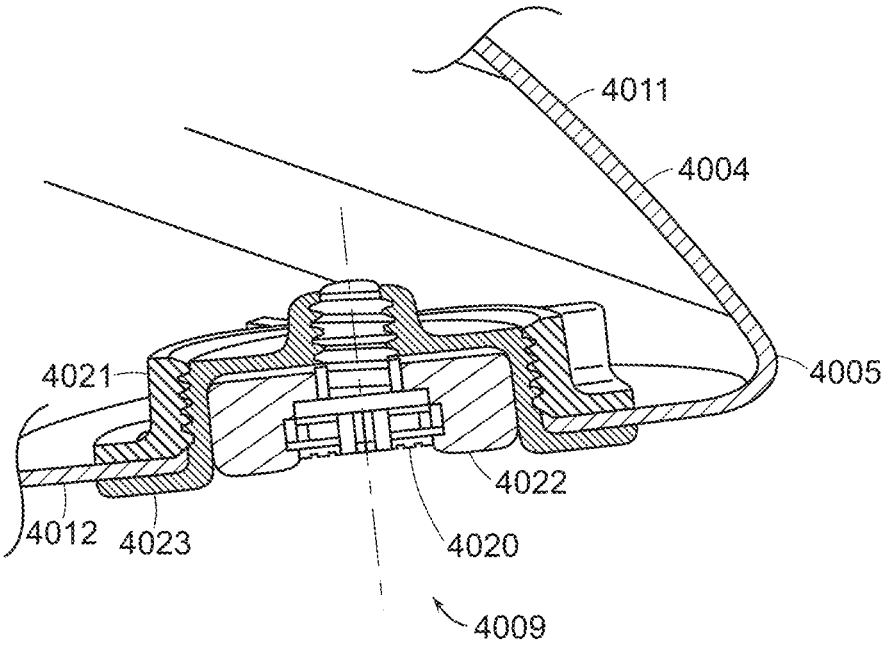
FIG. 41 of the accompanying drawings shows a close-up, cross-sectional view of the golf club head in accordance with an alternative embodiment of the presently disclosed technology shown in FIG. 38.

Referring to FIGS. 36 and 37, the second weight member 3009 is shown in a close-up cross-sectional view. The second weight member 3009 is comprised of an internal weight member 3021 and an external weight member 3022 with a fastener 3020 coupling the members together to the rear portion 3004. The first weight member 3008 has a similar construction but would secure about the frontal portion on the sole return 3003. In some embodiments, the first weight member 3008 and the second weight member 3009 have similar shaped external weight members 3022 that can be interchanged. In this embodiment, the internal weight member 3021 and the external weight member also secure the sole plate member 3006 to the rear portion 3004 by having the rear portion 3004 and the sole plate member 3006 compressed between the internal weight member 3021 and the external weight member 3022. In the weight embodiment shown in FIG. 37, the sole plate member 3006 and the internal weight member 3021 are also threaded so that they can be coupled to the rear portion 3004 before the external weight member 3022 is couple by the fastener 3020.

Referring to FIGS. 38-41, another embodiment of a rear portion 4004 is shown with a pinch weight member 4009 secured near the back edge 4005 that is used to achieve the performance characteristics described above. The pinch weight member 4009 is similar to the second weight member 3009 discussed above. The pinch weight member 4009 is comprised of an internal weight member 4021 and an external weight member 4022 with a fastener 4020 coupling the members together to compress the rear portion 4004. A first weight member, not shown, has a similar construction, but would secure about a frontal portion, also not shown. In the weight embodiment shown in FIG. 41, the sole portion 4012 is compressed between the internal weight member 4021 and a weight retaining pocket 4023 which are also threaded so that they can be coupled to the rear portion 4004 before the external weight member 4022 is coupled to the weight retaining pocket 4023 by the fastener 4020. The exterior surface of the weight retaining pocket 4023 is cylindrical with treads and the interior surface is hexagonal or other polygon and matches the shape of the the exterior weight member 4022 such that the exterior weight member 4022 cannot rotate in the weight retaining pocket 4023.

In some embodiments, the rear portion 4004 is formed from a crown portion 4011 and a sole portion 4012 that can be coupled by a joint connector 4013. The crown portion 4011 and the sole portion 4012 are injection molded separately and then coupled by the joint connector 4013. The materials for the crown portion 4011 and the sole portion 4012 are the same and the material for the joint connector is the same or is at least compatible such that it easily joins to the crown portion 4011 and the sole portion 4012.

In some embodiments, the rear portion 4004 is formed from a high crystallinity PPS, that is a PPS in which the crystallinity is greater than 40%, and in some embodiments, greater than about 50% as measured using differential scanning calorimetry (DSC) at a heating rate of 20° C./min. In order to increase the crystallinity level in PPS, it is recommended that the material be injection molded into molds that are at a temperature of greater than 115° C. and more particularly in a mold that is between about 125° C. and 135° C. In some embodiments, the PPS crystallinity is between about 50% and 70%. In some embodiments, the PPS can be formed without any filler or can contain a filler such as glass filler. In the glass filler PPS embodiment, the PPS has greater than about 20% glass filler, in some embodiments, between about 20% and 50% and, in some embodiments, between about 30% and 50%. The material has a uniform thickness of about 0.5 mm to about 2 mm. However, in one embodiment, the heel side 4007 has a thickness that is less than the thickness of the toe side 4006. In another embodiment, the thickness varies such that it is thinnest on the crown portion 4011 and thicker on the sole portion 4012. In this embodiment, the crown portion 4011 has a thickness that is between about 0.5 mm and 1 mm and the sole portion 4012 thickness is between about 1 mm and 2 mm.

Figure 42:
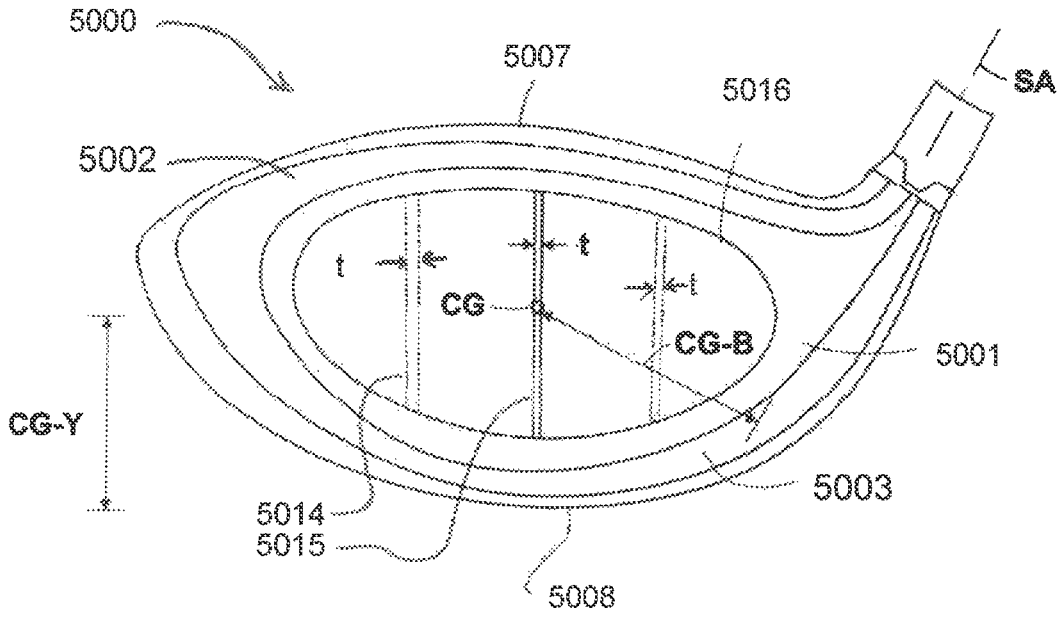
FIG. 42 of the accompanying drawings shows a front view of another golf club head in accordance with an embodiment of the presently disclosed technology.
Figure 43:
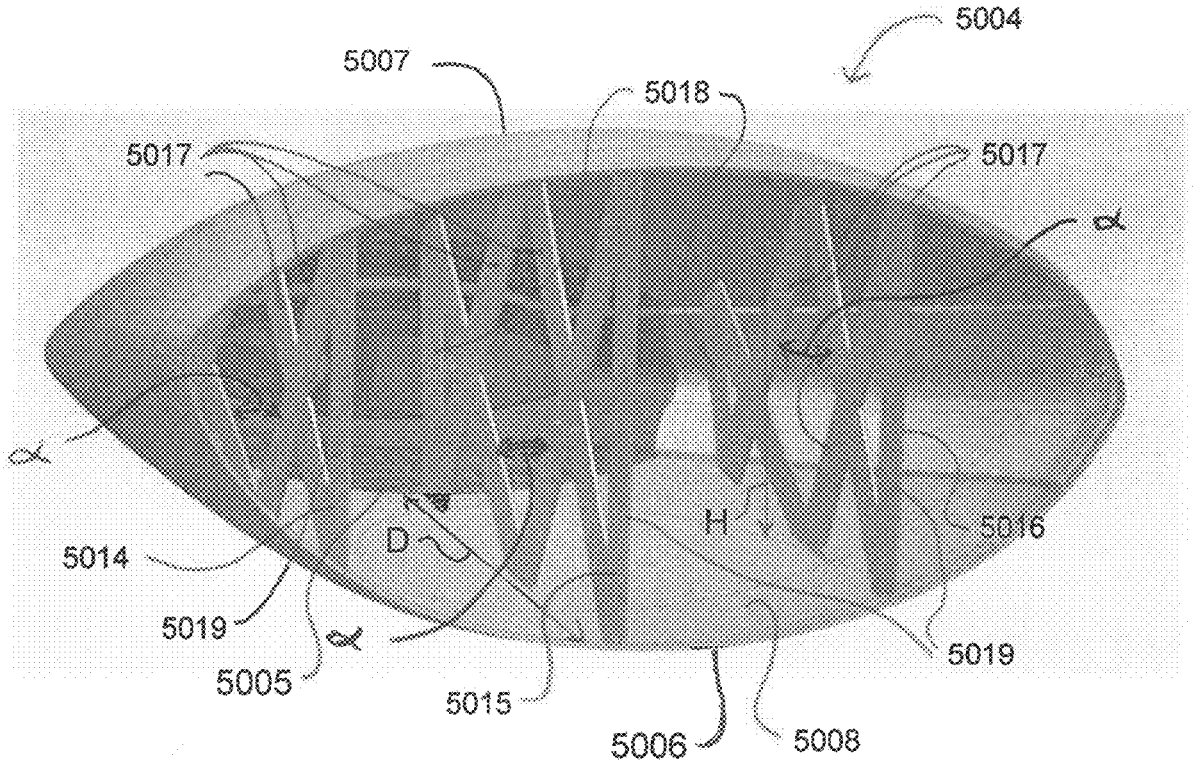
FIG. 43 of the accompanying drawings shows a perspective view of a portion of another golf club head in accordance with an embodiment of the presently disclosed technology.

In yet another embodiment of the presently disclosed technology, with reference to FIGS. 42-43, the golf club head and their internal components that are used to achieve the performance characteristics described above. FIG. 42 shows a front view of an exemplary design of a golf club head 5000 that capable of achieving the performance characteristics previously discussed with respect to the embodiments in FIGS. 1-3 and 13-15 in particular. The golf club head 5000 is comprised of the essential components previously discussed in FIGS. 1 and 13 in terms of a frontal portion 5001 having a striking face, not shown, a crown return 5002 and a sole return 5003 and a rear portion 5004 comprised of an aft body. In order to achieve the performance numbers above of a higher MOI-Y, a higher MOI-X, and a lower MOI-Z, a significant amount of mass is allocated towards the center of the golf club head away from the perimeter. In order to achieve this, the presently disclosed technology can utilize weighting members as discussed above that are comprised of high density materials that have a higher density than the frontal portion 5001 and the rear portion 5004. In some embodiments, as set forth above, the frontal portion 5001 can be formed of a standard titanium material such as TI-6-4, Ti-8-1-1, beta-titanium, and others that have a density of about 4 g/cc to 5 g/cc. The rear portion 5004 is formed from a multi-layer thermoplastic composite construction as set forth in co-pending U.S. application Ser. Nos. 17/205,678 and 17/225,862, which are incorporated by reference herein in their entirety. Alternatively, the rear portion 5004 is formed of structural material having a density of less than 3.0 g/cc such as thermoplastic materials such as those disclosed in U.S. application Ser. No. 16/528,210, filed on Jul. 31, 2019, which is incorporated by reference in its entirety herein, polyetherimide (PEI), polyether ether ketone (PEEK), polyphenylene sulfide (PPS), polysulfone (PSU), polyacryletherketone (PEAK), polyetherketoneketone (PEKK) and polyvinyl chloride (PVC).

In this embodiment, the golf club head 5000 can be comprised of a plurality of support members 5014, 5015, and 5016 that extend from the crown to the sole of the rear portion 5004 and from the back edge 5005 toward the front edge 5006 of the rear portion 5004, essentially perpendicular to the face. The support member 5015 is in the center of the club head in the toe-to-heel direction, parallel to the x-axis. The support member 5014 is on the toe side, between 20% and 70% of the distance from the support member 5015 and the furthest edge on the toe side. The support member 5016 is on the heel side, between 20% and 70% of the distance from the support member 5015 and the furthest edge on the heel side. In some embodiments, support members 5014 and 5016 are equidistance from the support member 5015. The support members 5014, 5015 and 5016 have a maximum height H parallel to the y-axis, a maximum depth D parallel to the z-axis and a thickness t. The depth D is greater than the maximum height H and the thickness t is between about 0.5 mm and 1.5 mm. In some embodiments, the support members 5014, 5015, and 5016 are comprised of a plurality of angled strut members 5017 that form angles $\alpha$ in between the struts of between 30 degrees and 100 degrees. Thus, in a first embodiment, the support members are a lattice structure. In embodiments, the support members 5014, 5015, and 5016 are also comprised of vertical strut members 5018 and 5019, extending substantially parallel to the y-axis, at the rear and the front of the rear portion 5004, respectively. The angled strut members 5017 couple the vertical strut members 5018 and 5019.

The advantage of the support members 5014, 5015 and 5016 is that they prevent the crown portion 5007 of the rear portion 5004 from deflecting relative to the sole portion 5008 of the rear portion 5004 in the y-axis and also prevents the portions from shearing with respect to each other in the z-axis. In embodiments, the support members 5014, 5015 and 5016 are formed from the same material as the rear portion 5004 and can be thermal formed/welded to the crown portion 5007 and the sole portion 5008 or coupled via an adhesive.

Still further, the club heads discussed above have a peak amplitude and Critical Time similar to those discussed with reference to FIG. 11 in U.S. Pat. No. 10,245,479, which issued on Apr. 2, 2019, the entirety of which is incorporated by reference herein.

In another embodiment of the presently disclosed technology, the frontal portion 5001 and the rear portion 5004 can be formed of a standard titanium materials such as TI-6-4, Ti-8-1-1, beta-titanium, and others that have a density of about 4 g/cc to 5 g/cc. The frontal portion 5001 comprises a cast crown return 5002 and sole return 5003 and a stamped striking face. In this embodiment, the support members 5014, 5015 and 5016 are again formed from the same material as the rear portion 5004. In some embodiments, the method of forming the support members 5014, 5015 and 5016 comprises forming a wax of the rear portion having a plurality of tabs on the inner surface and preforming a plurality of wax support members. The preformed wax support members can then be coupled to the wax rear portion by "welding" the wax support members to the tabs on the inner surface of the wax rear portion to form a final rear wax for casting. Then, the rear portion 5004 can be cast such that the support members 5014, 5015 and 5016 are integrally formed therewith.

Figure 44:
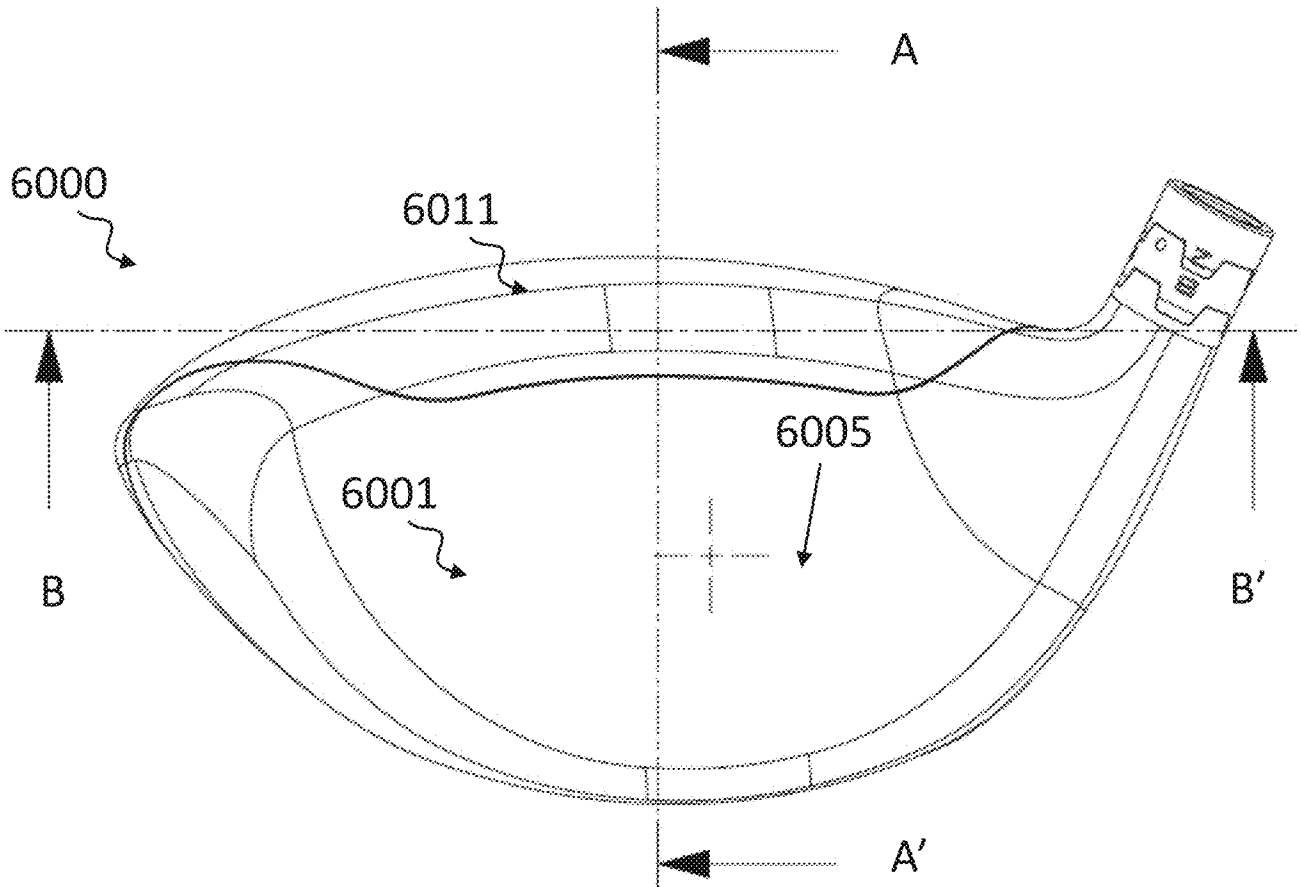
FIG. 44 illustrates a front view of a golf club head in accordance with one or more embodiments of the presently disclosed technology.

FIGS. 44-47, the golf club head and its internal components that are used to achieve the performance characteristics described above. FIG. 44 shows a front view of golf club head 6000 capable of achieving the performance characteristics previously discussed at least with respect to the embodiments in FIGS. 1-3 and 13-15. Golf club head 6000 may include the components previously discussed in at least FIGS. 1 and 13, including, for example, frontal portion 6001 having striking face 6005, crown return, sole return, and rear portion 6004 comprised of an aft body. In order to achieve the performance numbers above of a higher MOI-Y, a higher MOI-X, and a lower MOI-Z, mass may be allocated toward the center of the golf club head away from the perimeter. In order to achieve this, the presently disclosed technology can utilize weighting members as discussed above that are comprised of high density materials that have a higher density than frontal portion 6001 and rear portion 6004. As set forth above, frontal portion 6001 can be formed of a standard titanium material such as TI-6-4, Ti-8-1-1, beta-titanium, and others that have a density of about 4 g/cc to about 5 g/cc. Rear portion 6004 may be formed from a multi-layer thermoplastic composite construction, including, for example, the type set forth in U.S. Pat. No. 11,766,592 and U.S. application Ser. No. 17/225,862, which are incorporated by reference herein in their entirety. In some embodiments, rear portion 6004 may be formed of structural material having a density of less than 3.0 g/cc such as thermoplastic materials such as those disclosed in U.S. Pat. No. 11,219,805, which is incorporated by reference in its entirety herein, including polyetherimide (PEI), polyether ether ketone (PEEK), polyphenylene sulfide (PPS), polysulfone (PSU), polyacryletherketone (PEAK), polyetherketoneketone (PEKK) and polyvinyl chloride (PVC). Golf club head 6000 may improve characteristic time, stress, sound, mass properties, and/or other golf club characteristics.

Figure 45:
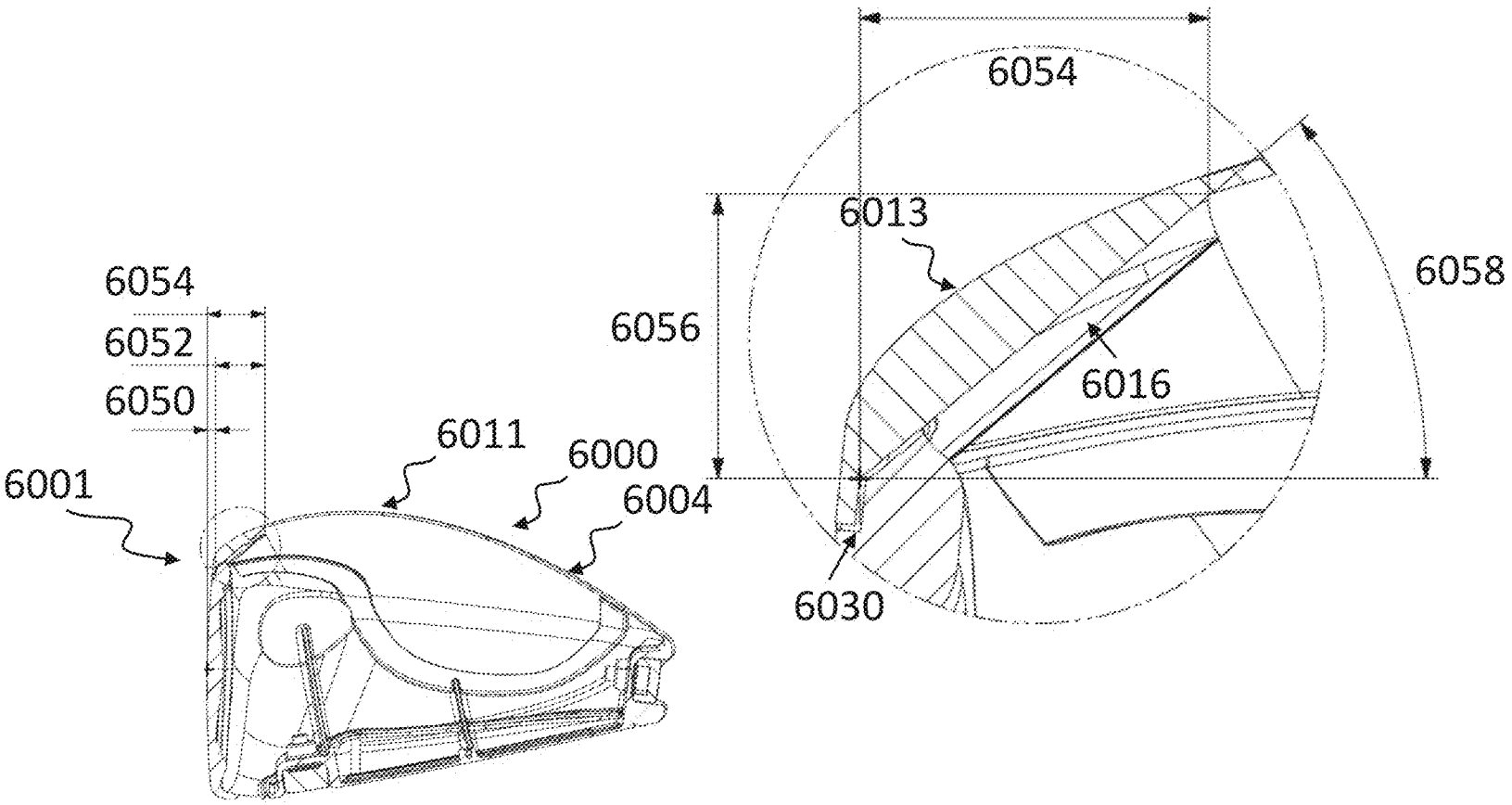
FIG. 45 illustrates cross-sectional views, including a magnified view, of a golf club head in accordance with one or more embodiments of the presently disclosed technology taken substantially along taken along line A-A' in FIG. 44.
Figure 46:
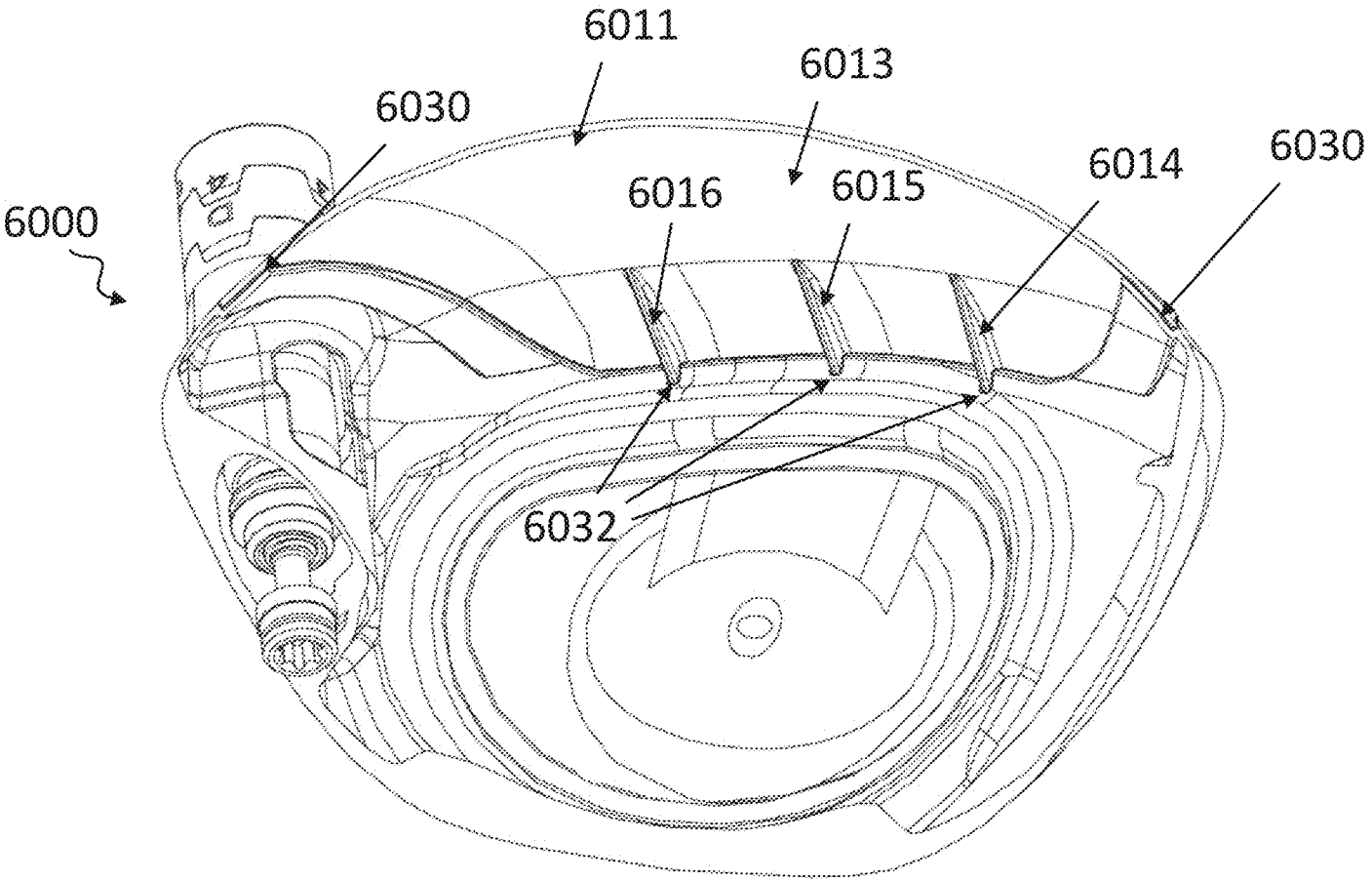
FIG. 46 illustrates a cross-sectional rear view of a golf club head in accordance with one or more embodiments of the presently disclosed technology.
Figure 47:
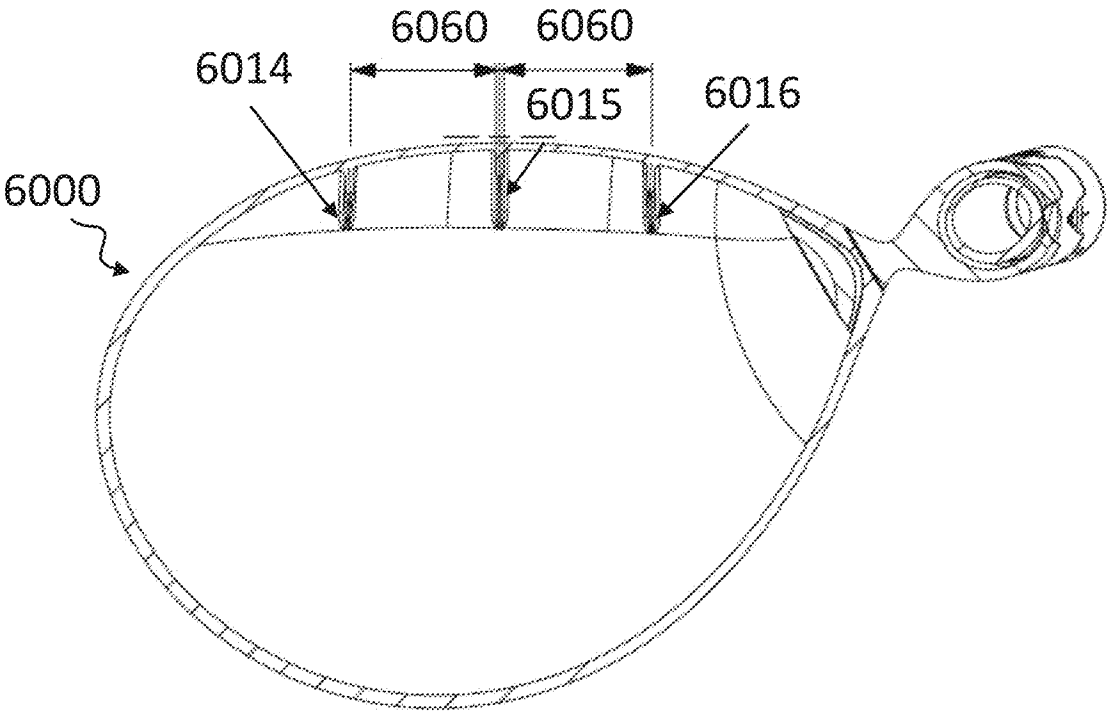
FIG. 47 illustrates a cross-sectional view of a golf club head in accordance with one or more embodiments of the presently disclosed technology taken substantially along taken along line B-B' in FIG. 44.

FIGS. 44-47 illustrate golf club head 6000 in accordance with one or more embodiments of the presently disclosed technology. For example, FIG. 44 illustrates a front view of a golf club head in accordance with one or more embodiments of the presently disclosed technology. FIG. 45 illustrates cross-sectional views, including a magnified view, of a golf club head in accordance with one or more embodiments of the presently disclosed technology taken substantially along taken along line A-A' in FIG. 44. FIG. 46 illustrates a cross-sectional rear view of a golf club head in accordance with one or more embodiments of the presently disclosed technology. FIG. 47 illustrates a cross-sectional view of a golf club head in accordance with one or more embodiments of the presently disclosed technology taken substantially along taken along line B-B' in FIG. 44. Each of these figures may provide different views of the same or similar components, and may be discussed together herein. Referring first to FIG. 44, golf club head 6000 may include frontal portion 6001 and crown portion 6011. In some embodiments, crown portion 6011 may extend onto part of a frontal surface of golf club head 6000. Golf club head 6000 and one or more of its components may be the same as, or substantially similar to, other golf club heads discussed herein.

Referring to FIG. 45, frontal portion 6001 may include undercut 6030. The bottom left portion of FIG. 45 may illustrate all of golf club head 6000, while the top right portion may illustrate a magnified view of frontal crown portion 6013 of golf club head 6000. Crown portion 6011 may include heelward support member 6016. Golf club head 6000 may include a number of measurements. For example, one measurement may be undercut to face center distance 6050 measured along a back-to-front direction. This may be measured perpendicularly from a back of undercut 6030 to the face center. Crown to face center distance 6050 may be between about 1 mm to about 3 mm. Another measurement may be support member distance 6052 measured along a back-to-front direction. This may be measured perpendicularly from a front of a front-most point of a support member, for example, heelward support member 6016, to a back-most point of a support member, for example, heelward support member 6016. Support member distance 6052 may be between about 8 mm to about 14 mm. Another measurement may be support member to front of face distance 6054 measured along a back-to-front direction. This may be measured perpendicularly from a back-most point of a support member to the face center. For example, support member to front of face distance 6054 may be crown to face center distance 6050 added to support member distance 6052. Support member to front of face distance 6054 may be between about 9 mm to about 17 mm.

Another measurement may be face to crown transition distance 6056 measured perpendicularly along a bottom-to-top direction. This may be measured from a first point identified as where an internal surface of crown portion 6011 transitions from a substantially vertical surface to a first sloped surface to a second point identified as where the first sloped surface transitions to a second sloped surface that is upward and/or rearward from the first sloped surface. Face to crown transition distance 6056 may be between about. 5 mm to about 13 mm. Another measurement may be face to crown transition angle 6058 measured along a bottom-to-top rotational direction. This may be measured facing toeward starting at a ground plane and rotating counterclockwise to the first sloped surface. Face to crown transition angle 6058 may be between about 30 degrees and about 50 degrees.

Referring to FIG. 46, crown portion 6011 may include frontal crown portion 6013, heelward support member 6016, central support member 6015, and toeward support member 6014. Frontal crown portion 6013 may be on a frontal part of crown portion 6011. In some embodiments, frontal crown portion 6013 may extend onto part of a frontal surface of golf club head 6000. Collectively, toeward support member 6014, central support member 6015, and heelward support member 6016 may be referred to as a plurality of support members. The plurality of support members may extend downward from crown portion 6011. In some embodiments, the plurality of support member may extend backward and/or downward from frontal crown portion 6013. It should be appreciated that there may be more or fewer support members without departing from the spirit and scope of the presently disclosed technology, and these support members may be otherwise positioned or located without departing from the spirit and scope of the presently disclosed technology. The plurality of support members may be integrated, be co-molded, be cast together with, or otherwise form a unibody structural component with crown portion 6011. For example, the unibody structural component may include crown portion 6011 and toeward support member 6014, central support member 6015, and/or heelward support member 6016. The unibody structural component may include one of a composite, a plastic, and a metal. Composites may include a variety of materials known to those skilled in the art, including for example, graphite, carbon fiber, resins, ceramics, boron fiber, polymers, foams, and so on. The plastic may include thermosets, thermoplastics, and/or other plastics. The metal may include tungsten, steel, titanium, aluminum, scandium, zinc, nickel, copper, iron, alloys, and/or other metals without departing from the spirit and scope of the presently disclosed technology. Golf club head 6000 may be at least partially non-metallic. For example, rear portion 6004 may be at least partially non-metallic, using composite and/or plastic, in at least part of rear portion 6004. For example, crown portion 6011 may be at least partially non-metallic, using composite and/or plastic, in at least part of crown portion 6011. Frontal portion 6001 may include frontal slots 6032. Frontal slots 6032 may receive frontal portions of the plurality of support members. Frontal slots 6032 may be adjacent to crown portion 6011. In some embodiments, the plurality of support members may be glued, adhered, mechanically locked, pressure fit, friction fit, or otherwise secured into or to the plurality of frontal slots without departing from the spirit and scope of the presently disclosed technology.

Referring to FIG. 47, central support member 6015 may be centered on face center. In some embodiments, central support member 6015 may be centered on a central portion of a variable face thickness profile. In embodiments, central support member 6015 may be otherwise positioned or offset, as discussed below. Toeward support member 6014 may have support member distance 6060. Support member distance 6060 may be less than about 25 mm away, along a heel-to-toe direction, from central support member 6015. Heelward support member 6016 may be less than about 25 mm away, along a heel-to-toe direction, from central support member 6015. Toeward support member 6014 and heelward support member 6016 may be symmetrical along a heel-to-toe direction from central support member 6015. In some embodiments, toeward support member 6014, central support member 6015, and/or heelward support member 6016 may extend less than about 25% of a total height of golf club head 6000 along a bottom-to-top direction. The total height may be measured from an exterior surface of golf club head 6000 from a lowest point and a highest point at address. In embodiments, toeward support member 6014, central support member 6015, and/or heelward support member 6016 may extend less than about 25% of a total depth of golf club head 6000 along a back-to-front direction. Each of the plurality of support members may have a thickness, measured along a heel-to-toe direction, of less than about 5 mm. The total depth may be measured from an exterior surface of golf club head 6000 from a forward-most point and a backward-most point at address.

Figure 48:
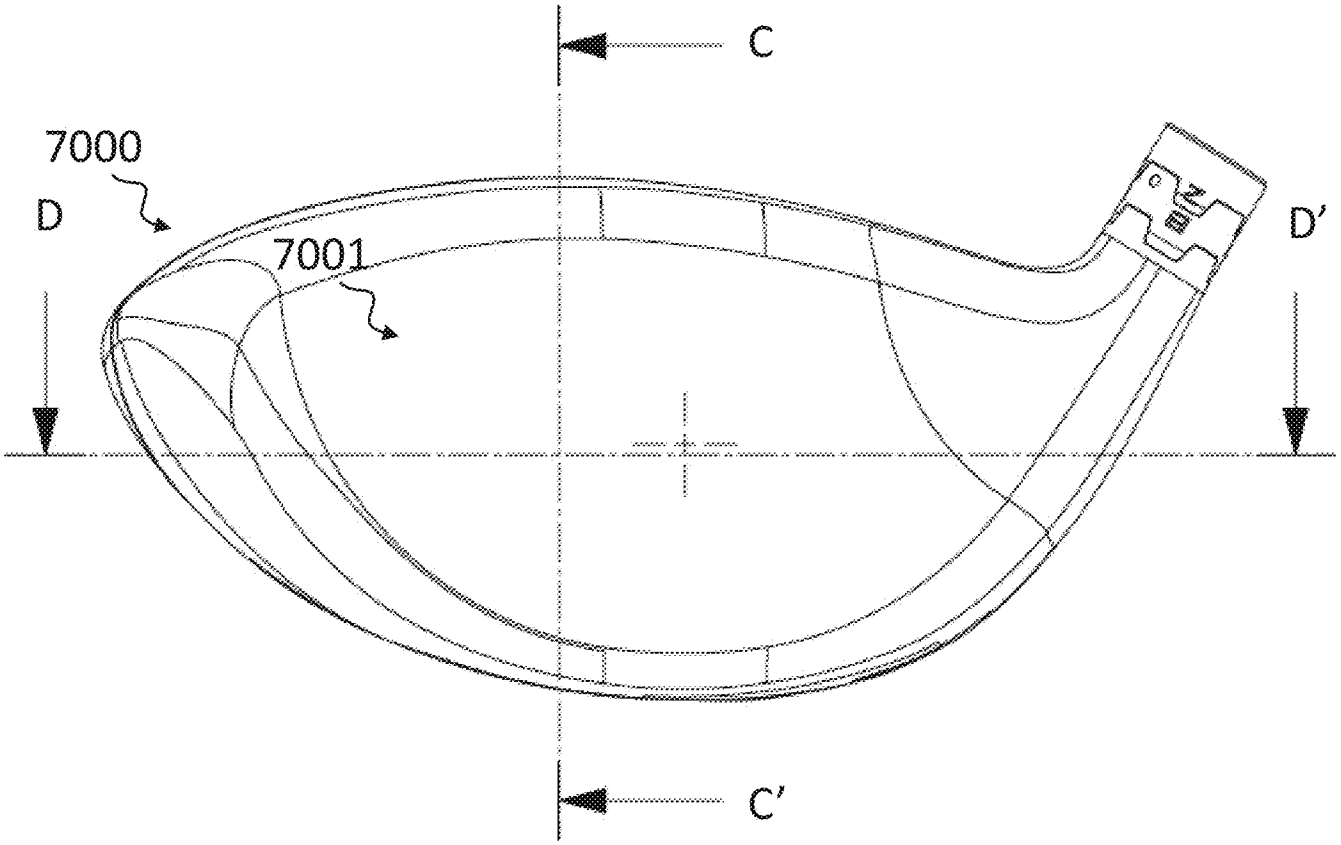
FIG. 48 illustrates a front view of a golf club head in accordance with one or more embodiments of the presently disclosed technology.
Figure 49:
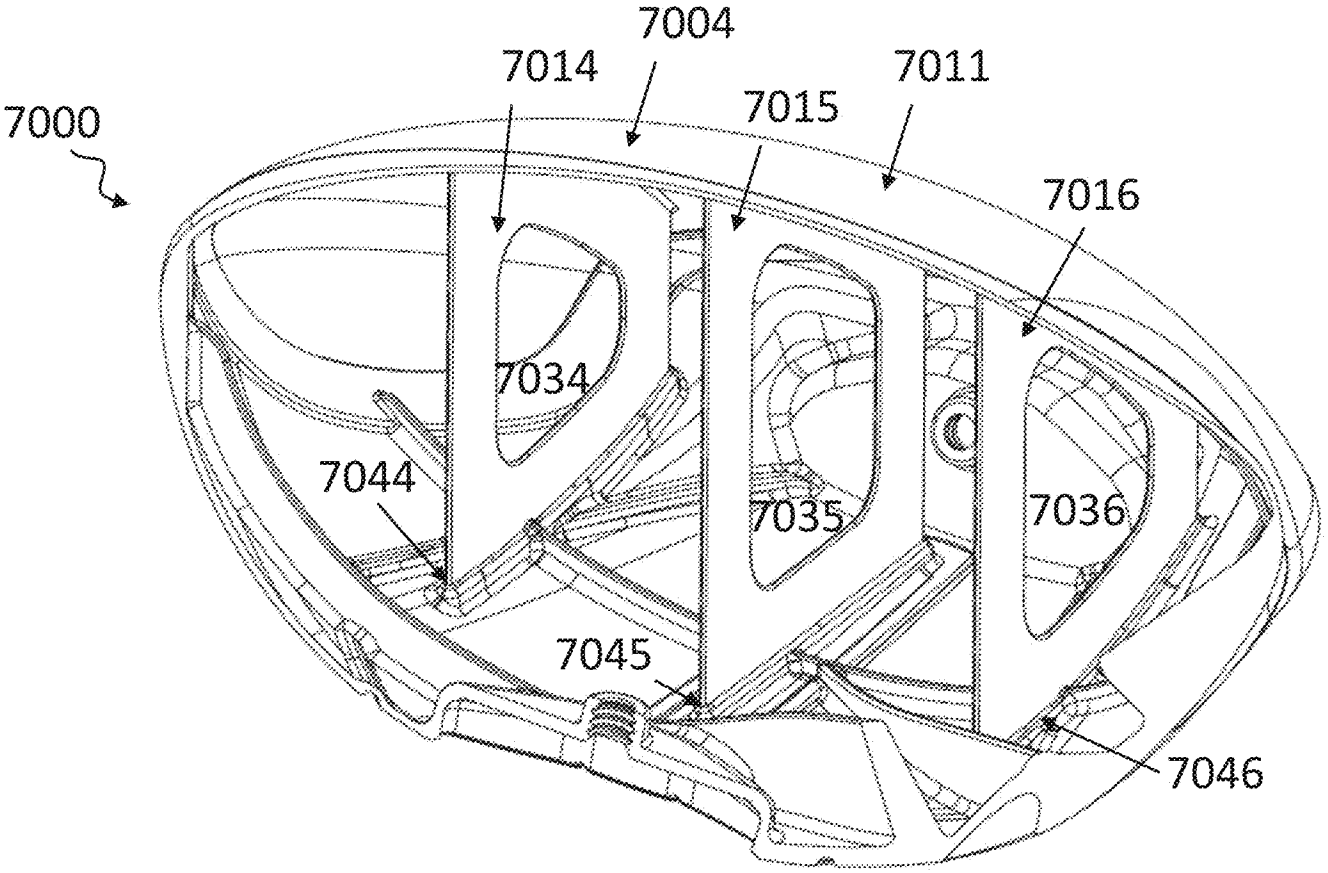
FIG. 49 illustrates a cross-sectional view of at least part of an aft body in accordance with one or more embodiments of the presently disclosed technology.
Figure 50:
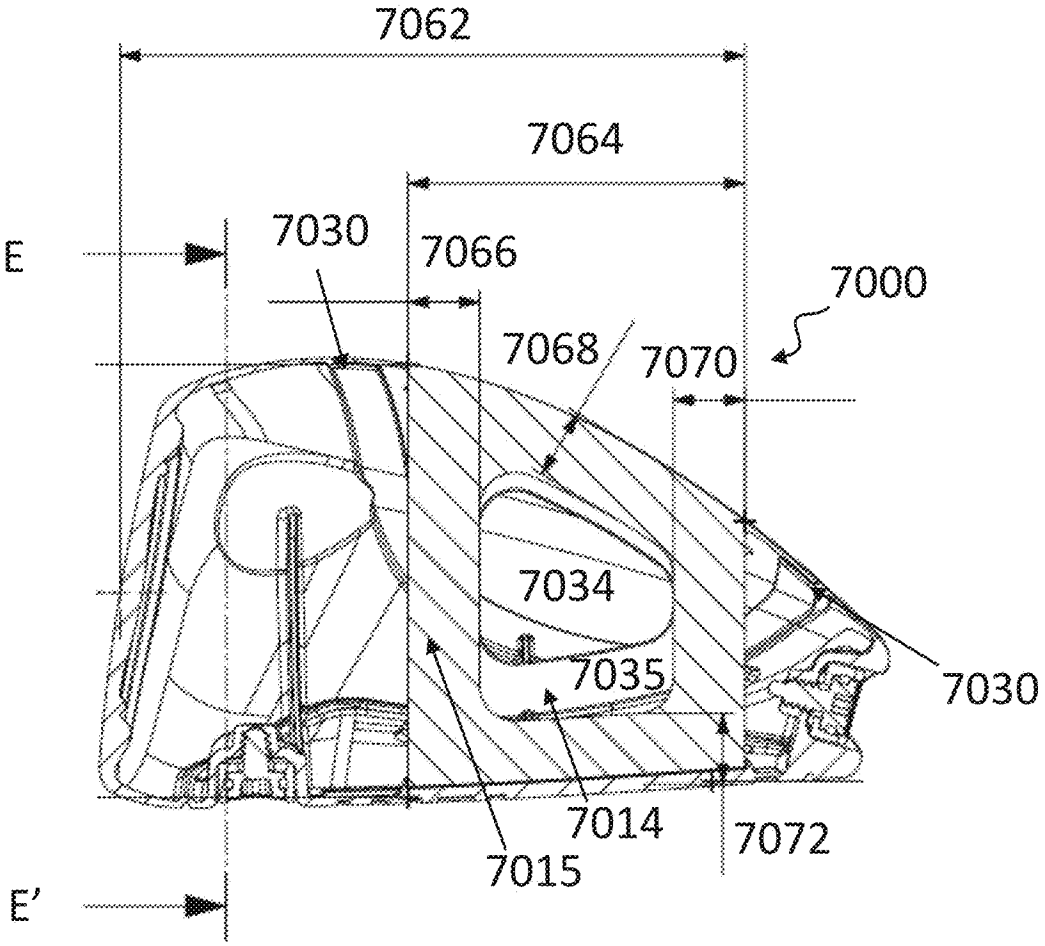
FIG. 50 illustrates a cross-sectional view of a golf club head in accordance with one or more embodiments of the presently disclosed technology taken substantially along taken along line C-C' in FIG. 48.
Figure 51:
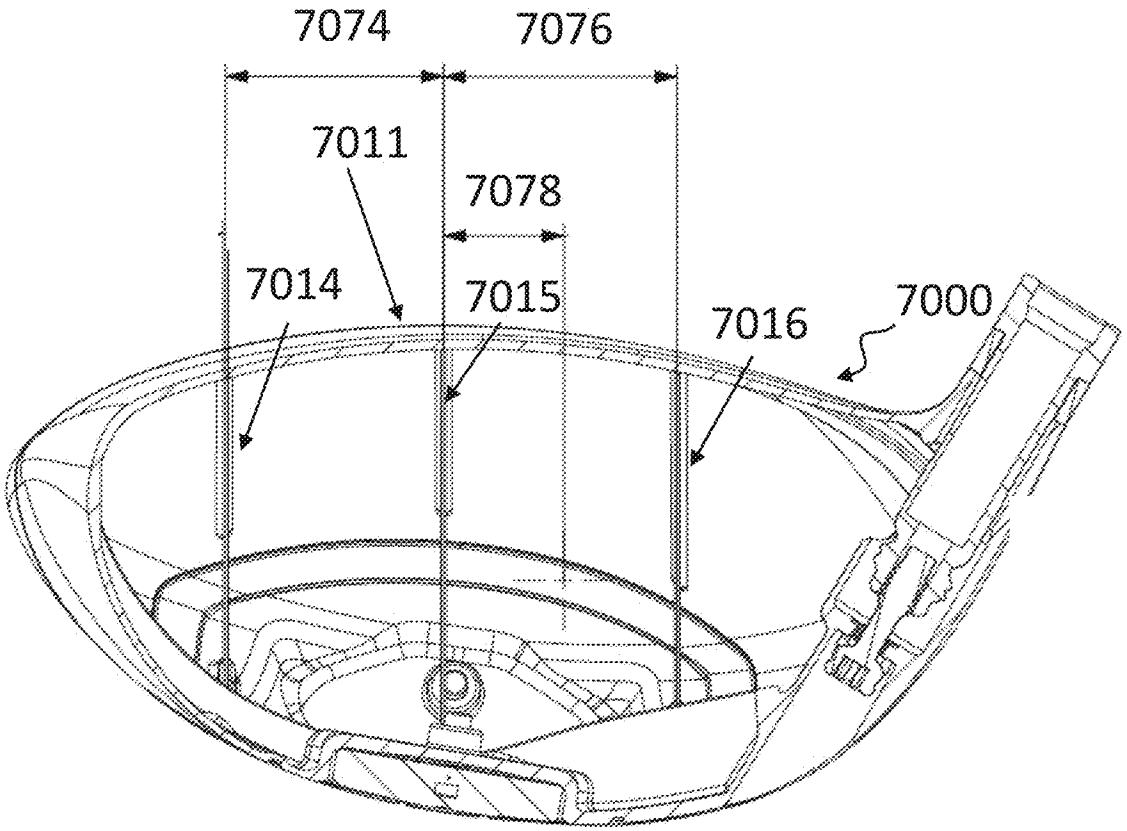
FIG. 51 illustrates a cross-sectional view of a golf club head in accordance with one or more embodiments of the presently disclosed technology taken substantially along taken along line E-E' in FIG. 50.
Figure 52:
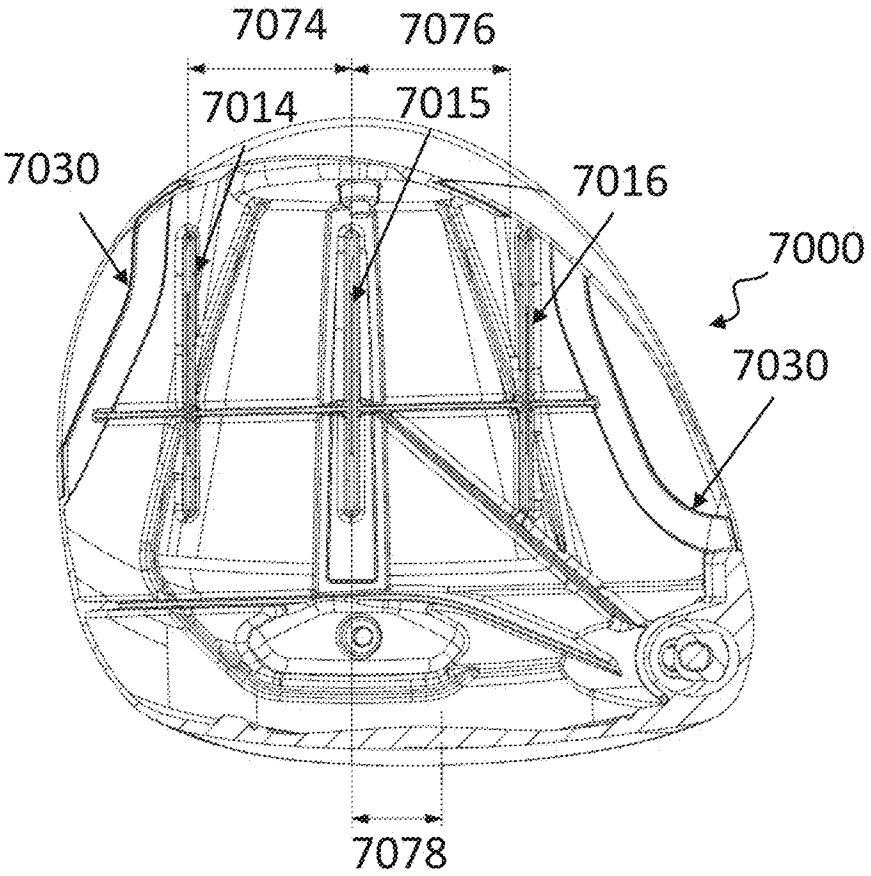
FIG. 52 illustrates a front view of a golf club head in accordance with one or more embodiments of the presently disclosed technology taken substantially along taken along line D-D' in FIG. 48.

FIGS. 48-52 illustrate golf club head 7000 in accordance with one or more embodiments of the presently disclosed technology. For example, FIG. 48 illustrates a front view of a golf club head in accordance with one or more embodiments of the presently disclosed technology. FIG. 49 illustrates a cross-sectional view of at least part of an aft body in accordance with one or more embodiments of the presently disclosed technology. FIG. 50 illustrates a cross-sectional view of a golf club head in accordance with one or more embodiments of the presently disclosed technology taken substantially along taken along line C-C' in FIG. 48. FIG. 51 illustrates a cross-sectional view of a golf club head in accordance with one or more embodiments of the presently disclosed technology taken substantially along taken along line E-E' in FIG. 50. FIG. 52 illustrates a front view of a golf club head in accordance with one or more embodiments of the presently disclosed technology taken substantially along taken along line D-D' in FIG. 48. Each of these figures may provide different views of the same or similar components, and may be discussed together herein. Referring first to FIG. 48, golf club head 7000 and its one or more components may be the same as, or substantially similar to, golf club head 6000 or other golf club heads discussed herein. Golf club head 7000 may include frontal portion 7001. Referring to FIG. 49, crown portion 7011 may include toeward support member 7014, central support member 7015, and/or heelward support member 7016. Toeward support member 7014, central support member 7015, and/or heelward support member 7016 may extend to the sole. The sole may include toeward slot 7044, center slot 7045, and/or heelward slot 7046. For example, toeward support member 7014, central support member 7015, and/or heelward support member 7016 may extend downward to fit into toeward slot 7044, center slot 7045, and/or heelward slot 7046, respectively. In some embodiments, the plurality of support members may be glued, adhered, mechanically locked, pressure fit, friction fit, or otherwise secured into or to the plurality of slots without departing from the spirit and scope of the presently disclosed technology. The plurality of support members may be integrated, be co-molded, be cast together with, or otherwise form a unibody structural component with crown portion 7011. In some embodiments, toeward support member 7014, central support member 7015, and/or heelward support member 7016 may be part of an aft body construction, including rear portion 7004, such that they may be integrated, be co-molded, be cast together with, or otherwise formed with a crown portion and a sole portion. Toeward support member 7014 may be located between about 20% and about 70% of a total width of golf club head 7000 toeward from central support member 7015. Heelward support member 7016 may be located between about 20% and about 70% of the total width of the golf club head heelward from central support member 7015. The total width may be measured from an exterior surface of golf club head 7000 from a toeward-most point and a heelward-most point at address.

Toeward support member 7014 may include toeward support member hole 7034. Toeward support member hole 7034 may extend along a bottom-to-top direction. Toeward support member hole 7034 may be trapezoidal with rounded edges, though it should be appreciated that toeward support member hole 7034 may be otherwise shaped, sized, and/or dimensioned without departing from the spirit and scope of the presently disclosed technology. Central support member 7015 may include central support member hole 7035. Central support member hole 7035 may extend along a bottom-to-top direction. Central support member hole 7035 may be trapezoidal with rounded edges, though it should be appreciated that central support member hole 7035 may be otherwise shaped, sized, and/or dimensioned without departing from the spirit and scope of the presently disclosed technology. Heelward support member 7016 may include heelward support member hole 7036. Heelward support member hole 7036 may extend along a bottom-to-top direction. Heelward support member hole 7036 may be trapezoidal with rounded edges, though it should be appreciated that heelward support member hole 7036 may be otherwise shaped, sized, and/or dimensioned without departing from the spirit and scope of the presently disclosed technology. Collectively, they may be referred to as support member holes. Each of the plurality of support member may include support member holes. In some embodiments, the support member holes may be solid and there may be no holes. Toeward support member hole 7034 may be differently shaped, sized, and/or dimensioned from central support member hole 7035 and/or heelward support member hole 7036. In some embodiments, toeward support member hole 7034 may be the same as, or substantially similar to, in shape, size, and/or dimension, to at least one of central support member hole 7035 and/or heelward support member hole 7036.

Referring to FIG. 50, golf club head 7000 may include a number of measurements. For example, one measurement may be face center to rear of support member distance 7062. This may be measured perpendicularly from face center to a back point of a support member (e.g., central support member 7015) along a back to front direction. Face center to rear of support member distance 7062 may be between about 70 mm to about 110 mm. Another measurement may be back to front support member distance 7064. This may be measured perpendicularly from a frontward-most portion of a support member (e.g., central support member 7015) to a backward-most portion of the support member. Back to front support member distance 7064 may be between about 40 mm to about 60 mm. Another measurement may be front to frontward hole distance 7066. This may be measured perpendicularly from a frontward-most portion of a support member (e.g., central support member 7015) to a frontward-most portion of a corresponding support member hole (e.g., central support member hole 7035). Front to frontward hole distance 7066 may be between about 5 mm to about 15 mm. Another measurement may be crown to upward hole distance 7068. This may be measured perpendicularly from an upward-most portion of a support member (e.g., central support member 7015) to an upward-most portion of a corresponding support member hole (e.g., central support member hole 7035) measured. Crown to upward hole distance 7068 may be between about 5 mm to about 15 mm. Another measurement may be back to backward hole distance 7070. This may be measured perpendicularly from a backward-most portion of a support member (e.g., central support member 7015) to a backward-most portion of a corresponding support member hole (e.g., central support member hole 7035). Back to backward hole distance 7070 may be between about 5 mm to about 15 mm. Another measurement may be back to sole to lower hole distance 7072. This may be measured perpendicularly from a lower-most portion of a support member (e.g., central support member 7015) to a lower-most portion of a corresponding support member hole (e.g., central support member hole 7035). Sole to lower hole distance 7072 may be between about 5 mm to about 15 mm.

Referring to FIGS. 51 and 52, golf club head 7000 may include additional measurements. One measurement may be a support member width. Each support member may have a support member width less than about 8 mm. Another measurement may be central support member to toeward support member distance 7074. This may be measured perpendicularly from a center of central support member 7015 to a center of toeward support member 7014. Central support member to toeward support member distance 7074 may be between about 25 mm to about 35 mm. Another measurement may be central support member to heelward support member distance 7076. This may be measured perpendicularly from a center of central support member 7015 to a center of heelward support member 7016. Central support member to heelward support member distance 7076 may be between about 25 mm to about 35 mm. In some embodiments, central support member to toeward support member distance 7074 may be smaller than central support member to heelward support member distance 7076. In embodiments, they may be the same distance. In some embodiments, central support member to heelward support member distance 7076 may be smaller than central support member to toeward support member distance 7074. Another measurement may be central support member offset from center distance 7078. This may be measured perpendicularly from a face center to central support member 7015. In some embodiments, this may be measured perpendicularly from a center of a variable face thickness profiled to central support member 7015. In embodiments, this may be measured from a sweet spot of golf club head 7000. Central support member offset from center distance 7078 may be less than about 25 mm. Portions of undercut 7030 may be illustrated in FIG. 52.

Other than in at least some of the operating examples, or unless otherwise expressly specified, all of the numerical ranges, amounts, values and percentages such as those for amounts of materials, moment of inertias, center of gravity locations, loft, angles, various ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and appended claims are approximations that may vary depending upon the desired properties sought to be obtained by the presently disclosed technology. At the very least, and not as an attempt to limit the application of the doctrine of equivalents to the scope of the claims, each numerical parameter should at least be construed in light of the number of reported significant digits and by applying ordinary rounding techniques.

In some examples, substantially parallel may be defined to include zero degrees, or between zero degrees and one degree, or between zero degrees and two degrees, or between zero degrees and five degrees, or between zero degrees and ten degrees of deviation from being exactly parallel to the disclosed front surface. Substantially may be defined to be a value within 10% of the identified value.

Notwithstanding that the numerical ranges and parameters setting forth the broad scope of the presently disclosed technology are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

While various embodiments of the disclosed technology have been described above, it should be appreciated these are examples only, and not limiting. Likewise, the various figures may depict an example configuration or structure to aid in understanding the features and functionality that can be included in the disclosed technology. The presently disclosed technology is not intended to be restricted to the illustrated example configurations and structures, and the desired features can be implemented with a variety of alternative configurations and structures. It may be apparent to one of skill in the art how alternative embodiments can be implemented to impart the desired features of the presently disclosed technology. Therefore, it will be understood that the appended claims are intended to cover all such modifications and embodiments, which would come within the spirit and scope of the presently disclosed technology.

While the presently disclosed technology may be described herein in terms of various exemplary embodiments, it should be understood that the various features described in any individual embodiment is not limited to its particular embodiment, and can be applied, whether alone or in combinations with features of other embodiments, to another embodiment, whether or not such an embodiment is described herein or described as part of a single embodiment. Thus, the breadth and scope of the presently disclosed technology should not be limited to any of the above-described exemplary embodiments.

Words, phrases, and their variations that are used herein, unless otherwise expressly stated, should be construed as open ended, not as limiting. For example, the term "include" should be read to mean "include, without limitation"; the term "example" should be read to mean the following provides exemplary instances, not an exhaustive or limiting list thereof; "a" or "an" should be read as meaning "at least one," "one or more" etc.; and "traditional," "normal," and similar terms should not be construed as limiting to a given time period, but should be read to encompass traditional, normal, like technologies that may be known now or at any future point; and a heel-to-toe direction should be read as meaning either the toe-to-heel direction or the heel-to-toe direction, a bottom-to-top direction should be read as meaning either the bottom-to-top direction or the top-to-bottom direction, and a back-to-front direction should be read as meaning either a back-to-front direction or a front-to-back direction. In addition, references herein to technologies that would be apparent or known to one of ordinary skill in the art includes such technologies that are apparent or known to one of ordinary skill in the art now or at any time in the future.

The presence of words and phrases such as "one or more," "at least," "not limited to," or other similar phrases shall not be read to necessarily mean that the narrower case is intended in instances where such broadening phrases may be absent. The presence of words such as "first," "second," or other similar words shall not be read to mean that there can only be one or two elements.

What is claimed is:

1. A golf club comprised of a golf club head, a shaft having a shaft axis coupled to the golf club head at a first end of the shaft and a grip coupled to the shaft at a second end of the shaft, wherein the golf club head comprises:

wherein an x-axis is defined as a horizontal axis tangent to a face center with a positive x direction towards a heel of the golf club head, a y-axis is a vertical axis orthogonal to the x-axis with a positive y direction towards a crown, and a z-axis being orthogonal to both the x-axis and the y-axis with a positive z direction extending forward;

a frontal portion comprised of metal comprising a striking face having the face center located at a forward portion of the golf club head; and a partially non-metallic rear portion coupled to and located aft of the frontal portion, the partially non-metallic rear portion comprising:

a non-metallic crown portion at an upper portion of the golf club head; and a sole on a bottom portion of the golf club head;

wherein the non-metallic crown portion comprises a plurality of support members extending from the non-metallic crown portion toward the sole, the plurality of support members essentially perpendicular to the striking face, the plurality of support members comprising a central support member being located near a central portion of the golf club head in a heel-to-toe orientation, extending substantially in line, along the z-axis, with the face center, and wherein the non-metallic crown portion and the plurality of support members form a unibody structural component;

wherein the golf club head has a moment of inertia about the y-axis (MOI-Y) passing through a center of gravity (CG) of the golf club head, the golf club head has a moment of inertia about the z-axis (MOI-Z) passing through the CG, and the golf club head has a moment of inertia about the x-axis (MOI-X) passing through the CG.

2. The golf club of claim 1, wherein the plurality of support members extend less than about 25% of a total height of the golf club head along a bottom-to-top direction.

3. The golf club of claim 2, wherein the plurality of support members extend less than about 25% of a total depth of the golf club head along a back-to-front direction.

4. The golf club of claim 2, wherein the non-metallic crown portion further comprises a frontal crown portion on a frontal part of the non-metallic crown portion, and wherein the plurality of support members extend from the frontal crown portion.

5. The golf club of claim 1, wherein the plurality of support members extend to the sole.

6. The golf club of claim 5, wherein each of the plurality of support members comprise support member holes.

7. The golf club of claim 1, wherein the plurality of support members comprise a toe side support member located toeward of the central support member between about 20% and about 70% of a total width of the golf club head, and a heel side support member located heelward of the central support member between about 20% and about 70% of the total width of the golf club head.

8. The golf club of claim 1, wherein the unibody structural component comprises one of a composite and a metal.

9. The golf club of claim 1, wherein the central support member is offset from the face center less than about 25 mm.

10. A golf club head comprising:

an x-axis is defined as a horizontal axis tangent to a face center with a positive x direction towards a heel of the golf club head, a y-axis is a vertical axis orthogonal to the x-axis with a positive y direction towards a crown, and a z-axis being orthogonal to both the x-axis and the y-axis with a positive z direction extending forward;

a frontal portion comprised of metal comprising a striking face having the face center located at a forward portion of the golf club head; and a partially non-metallic rear portion coupled to and located aft of the frontal portion, the partially non-metallic rear portion comprising:

a non-metallic crown portion at an upper portion of the golf club head; and a sole on a bottom portion of the golf club head;

wherein the non-metallic crown portion comprises a plurality of support members extending from the non-metallic crown portion toward the sole, the plurality of support members essentially perpendicular to the striking face, the plurality of support members comprising a central support member being located near a central portion of the golf club head in a heel-to-toe orientation, extending substantially in line, along the z-axis, with the face center, and wherein the non-metallic crown portion and the plurality of support members form a unibody structural component, wherein the plurality of support members extend less than about 25% of a total height of the golf club head along a bottom-to-top direction;

wherein the golf club head has a moment of inertia about the y-axis (MOI-Y) passing through a center of gravity (CG) of the golf club head, the golf club head has a moment of inertia about the z-axis (MOI-Z) passing through the CG, and the golf club head has a moment of inertia about the x-axis (MOI-X) passing through the CG.

11. The golf club head of claim 10, wherein the plurality of support members extend less than about 25% of a total depth of the golf club head along a back-to-front direction.

12. The golf club head of claim 10, wherein the non-metallic crown portion further comprises a frontal crown portion on a frontal part of the non-metallic crown portion, and wherein the plurality of support members extend from the frontal crown portion.

13. The golf club head of claim 10, wherein the plurality of support members comprise a toe side support member located toeward of the central support member between about 20% and about 70% of a total width of the golf club head, and a heel side support member located heelward of the central support member between about 20% and about 70% of the total width of the golf club head.

14. The golf club head of claim 10, wherein the unibody structural component comprises one of a composite and a metal.

15. The golf club head of claim 10, wherein the central support member is offset from the face center less than about 25 mm.

16. A golf club head comprising:

an x-axis is defined as a horizontal axis tangent to a face center with a positive x direction towards a heel of the golf club head, a y-axis is a vertical axis orthogonal to the x-axis with a positive y direction towards a crown, and a z-axis being orthogonal to both the x-axis and the y-axis with a positive z direction extending forward;

a frontal portion comprised of metal comprising a striking face having the face center located at a forward portion of the golf club head; and a partially non-metallic rear portion coupled to and located aft of the frontal portion, the partially non-metallic rear portion comprising:

a non-metallic crown portion at an upper portion of the golf club head; and a sole on a bottom portion of the golf club head;

wherein the non-metallic crown portion comprises a plurality of support members extending from the non-metallic crown portion toward the sole, the plurality of support members essentially perpendicular to the striking face, the plurality of support members comprising a central support member being located near a central portion of the golf club head in a heel-to-toe orientation, extending substantially in line, along the z-axis, with the face center, and wherein the non-metallic crown portion and the plurality of support members form a unibody structural component, wherein the plurality of support members extend to the sole;

wherein the golf club head has a moment of inertia about the y-axis (MOI-Y) passing through a center of gravity (CG) of the golf club head, the golf club head has a moment of inertia about the z-axis (MOI-Z) passing through the CG, and the golf club head has a moment of inertia about the x-axis (MOI-X) passing through the CG.

17. The golf club head of claim 16, wherein each of the plurality of support members comprise support holes.

18. The golf club head of claim 16, wherein the plurality of support members comprise a toe side support member located toeward of the central support member between about 20% and about 70% of a total width of the golf club head, and a heel side support member located heelward of the central support member between about 20% and about 70% of the total width of the golf club head.

19. The golf club head of claim 16, wherein the unibody structural component comprises one of a composite and a metal.

20. The golf club head of claim 16, wherein the central support member is offset from the face center less than about 25 mm.

* * * * *